US010825414B2

(12) United States Patent
Tanaka et al.

(10) Patent No.: US 10,825,414 B2
(45) Date of Patent: Nov. 3, 2020

(54) SCANNING SIGNAL LINE DRIVE CIRCUIT, DISPLAY DEVICE PROVIDED WITH SAME, AND DRIVE METHOD FOR SCANNING SIGNAL LINE

(71) Applicant: Sharp Kabushiki Kaisha, Sakai, Osaka (JP)

(72) Inventors: Kohhei Tanaka, Sakai (JP); Takuya Watanabe, Sakai (JP); Yasuaki Iwase, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/659,681

(22) Filed: Oct. 22, 2019

(65) Prior Publication Data

US 2020/0135132 A1 Apr. 30, 2020

Related U.S. Application Data

(60) Provisional application No. 62/750,853, filed on Oct. 26, 2018.

(51) Int. Cl.
*G09G 3/36* (2006.01)

(52) U.S. Cl.
CPC ..... *G09G 3/3677* (2013.01); *G09G 3/3688* (2013.01); *G09G 2310/0291* (2013.01)

(58) Field of Classification Search
None
See application file for complete search history.

(56) References Cited

U.S. PATENT DOCUMENTS

2009/0278782 A1* 11/2009 Chen ..... G09G 3/3677 345/100
2012/0105395 A1* 5/2012 Hachida ..... G11C 19/28 345/204
2014/0092082 A1* 4/2014 Choi ..... G09G 3/3677 345/213
2015/0255171 A1* 9/2015 Nishi ..... G11C 19/28 377/54
2019/0114984 A1 4/2019 Tanaka et al.

FOREIGN PATENT DOCUMENTS

JP 2014-71451 A 4/2014

OTHER PUBLICATIONS

Wang et al., "Novel 1-to-N Architecture of Bidirectional Gate Driver for Ultra-Narrow-Border Display", SID 2018 Digest, p. 12, May 30, 2018, pp. 1223-1226.

* cited by examiner

*Primary Examiner* — Krishna P Neupane
(74) *Attorney, Agent, or Firm* — Keating & Bennett, LLP

(57) ABSTRACT

An active-matrix display device has a gate driver for driving a plurality of gate bus lines of a display portion in accordance with a multi-phase gate clock signal. The gate driver includes first and second gate drivers disposed to opposite sides of the display portion. Each of the first and second gate drivers includes a plurality of buffer circuits connected to the gate bus lines and a plurality of bistable circuits cascaded together so as to constitute a shift register. Each bistable circuit controls two buffer circuits. The bistable circuits are disposed in an interlaced arrangement between the first and second gate drivers. Each of the two buffer circuits controlled by each bistable circuit includes a boost capacitor, and one of the two buffer circuits includes a transistor for isolating a boost effect.

14 Claims, 24 Drawing Sheets

SCANNING SIGNAL LINE DRIVE CIRCUIT, DISPLAY DEVICE PROVIDED WITH SAME, AND DRIVE METHOD FOR SCANNING SIGNAL LINE

CROSS REFERENCE TO RELATED APPLICATIONS

This application claims priority to U.S. Provisional Patent Application No. 62/750,853, entitled "SCANNING SIGNAL LINE DRIVE CIRCUIT, DISPLAY DEVICE PROVIDED WITH SAME, AND DRIVE METHOD FOR SCANNING SIGNAL LINE", filed on Oct. 26, 2018, the content of which is incorporated herein by reference.

BACKGROUND OF THE INVENTION

1. Field of the Invention

The present invention relates to display devices, more specifically to a scanning signal line drive circuit and a drive method, both of which are intended to drive scanning signal lines provided in a display portion of a display device.

2. Description of the Related Art

A conventionally known matrix display device is provided with a display portion including a plurality of data signal lines (also referred to as "source bus lines"), a plurality of scanning signal lines (also referred to as "gate bus lines") crossing the data signal lines, and a plurality of pixel forming portions disposed in a matrix along the data signal lines and the scanning signal lines. Such a matrix display device includes a data signal line drive circuit (also referred to as a "data driver" or a "source driver") for driving the data signal lines, and a scanning signal line drive circuit (also referred to as a "gate driver") for driving the scanning signal lines. The scanning signal line drive circuit applies a plurality of scanning signals respectively to the scanning signal lines such that the scanning signal lines are sequentially selected during each frame period, and in conjunction with such sequential selection of the scanning signal lines, the data signal line drive circuit applies a plurality of data signals, which represent an image to be displayed, to the data signal lines. As a result, the pixel forming portions are provided with respective pieces of pixel data included in image data that represents the image to be displayed.

Incidentally, as for conventional active-matrix liquid crystal display devices, it is often the case that the scanning signal line drive circuit is mounted as an integrated circuit (IC) chip on a peripheral portion of a substrate included in a liquid crystal panel which includes a display portion as above and serves as a display panel. However, recent years have seen a gradually increasing number of scanning signal line drive circuits being directly formed on substrates. Such a scanning signal line drive circuit is referred to as a "monolithic gate driver" or suchlike, and a display panel including such a scanning signal line drive circuit is referred to as a "gate-driver monolithic panel" or a "GDM panel".

A known example of the monolithic gate driver is a monolithic gate driver that includes first and second gate drivers disposed so as to be opposed with respect to a display portion, as shown in (A) and (B) of FIG. 30. For such a configuration, there are two known input schemes in which the gate drivers provide gate bus lines with scanning signals, one being a double-ended input scheme in which scanning signals are applied to both ends of the gate bus lines, as shown in (A) of FIG. 30, and the other being a single-ended input scheme in which scanning signals are applied alternatingly from one end and from the other end to the gate bus lines of the display portion, as shown in (B) of FIG. 30, e.g., the first gate driver applies scanning signals to odd-numbered gate bus lines, and the second gate driver applies scanning signals to even-numbered gate bus lines (see, for example, Japanese Laid-Open Patent Publication No. 2014-71451).

In general, the gate driver is configured such that a plurality of unit circuits, each including one bistable circuit, are cascaded together, and each of the unit circuits is connected to any one of the gate bus lines of the display panel and applies a scanning signal to the gate bus line connected thereto. In the case of the single-ended input scheme in which the first gate driver and the second gate driver are disposed opposite each other, with the display portion positioned therebetween, as shown in (B) of FIG. 30, odd-numbered gate bus lines are connected to unit circuits in the first gate driver, and even-numbered gate bus lines are connected to unit circuits in the second gate driver. Specifically, the unit circuits connected to the gate bus lines are disposed alternatingly to a first-end side (within the first gate driver) of the gate bus lines and to a second-end side (within the second gate driver). Accordingly, the gate drivers for the single-ended input scheme as shown in (B) of FIG. 30 will be referred to herein as "interlaced-arrangement-type" gate drivers.

By employing such an interlaced arrangement for the single-ended input scheme, it is possible to achieve a narrower picture-frame area when compared to the case where the gate drivers for the double-ended input scheme are used, as shown in (A) of FIG. 30. However, in the case of the interlaced-arrangement-type gate driver, each gate bus line is provided with a scanning signal from one end, and therefore, the scanning signal suffers from waveform rounding at the other end, resulting in a reduced speed for pixel capacitor charging. Accordingly, medium- or large-sized display panels have difficulty in displaying satisfactory images using interlaced-arrangement-type gate drivers. Therefore, relatively large display panels employ the double-ended input scheme as shown in (A) of FIG. 30, which makes it difficult to achieve narrow picture-frame areas.

On the other hand, the liquid crystal display device disclosed in Japanese Laid-Open Patent Publication No. 2014-71451 is configured such that a plurality of stages (unit circuits) in first and second gate drivers are disposed alternatingly in an interlaced arrangement, and each gate bus line is coupled at one end to a stage STLi in the first or second gate driver and at the other end to a discharge circuit (discharge transistor) TRi (see FIG. 3 of the publication). In this configuration, both gate drivers output gate drive voltages alternatingly, rather than simultaneously, which renders it possible to reduce the number of stages, and other discharging means (discharge transistors) are provided between the stages in order to assist in discharging the gate bus lines, thereby preventing delayed gate drive voltage discharge (see paragraphs 0042 and 0065 to 0066 of the publication).

However, in the liquid crystal display device disclosed in the above publication, the discharge transistor for assisting the discharging of the gate bus line starts transitioning from OFF to ON state after the discharging of the gate bus line is started, and therefore, the discharge transistor cannot perform the discharging at sufficiently high speed. Moreover, in this liquid crystal display device, the charging of each gate bus line is performed solely by the stage that is coupled to one end of that gate bus line, and therefore, the liquid crystal display device has only low charge capability. Accordingly, the configuration disclosed in the publication is not suitable for display devices with large display panels.

SUMMARY OF THE INVENTION

Therefore, it is desired to provide a display device capable of achieving a narrow picture-frame area and also capable of both discharging and charging gate bus lines at high speed even when the display device has a large display panel.

(1) Scanning signal line drive circuits according to several embodiments of the present invention are each a scanning signal line drive circuit for selectively driving a plurality of scanning signal lines provided in a display portion of a display device, the circuit including:

a first scanning signal line driver portion configured to be operated in accordance with a multi-phase clock signal and disposed near first ends of the plurality of scanning signal lines; and a second scanning signal line driver portion configured to be operated in accordance with the multi-phase clock signal and disposed near second ends of the plurality of scanning signal lines, wherein, the first scanning signal line driver portion includes:

a first shift register having a plurality of first bistable circuits cascaded together and provided in one-to-one correspondence with a plurality of scanning signal line groups, each group consisting of two or more adjacent scanning signal lines selected from the plurality of scanning signal lines; and a plurality of buffer circuits connected to the first ends of the plurality of scanning signal lines in one-to-one correspondence to the plurality of scanning signal lines, the second scanning signal line driver portion includes:

a second shift register having a plurality of second bistable circuits cascaded together and provided in one-to-one correspondence with a plurality of scanning signal line groups, each group consisting of two or more adjacent scanning signal lines selected from the plurality of scanning signal lines; and a plurality of buffer circuits connected to the second ends of the plurality of scanning signal lines in one-to-one correspondence to the plurality of scanning signal lines, the plurality of scanning signal lines are grouped such that none of the scanning signal line groups corresponding to the first bistable circuits are identical to any of the scanning signal line groups corresponding to the second bistable circuits, the first and second shift registers are configured such that the first bistable circuits and the second bistable circuits sequentially output active signals out of phase with each other in accordance with the grouping of the plurality of scanning signal lines, the first and second scanning signal line driver portions are configured such that:

for each of the groups respectively corresponding to the first bistable circuits, the buffer circuits that are respectively connected to the first ends of the two or more scanning signal lines in the group are supplied with clock signals included in the multi-phase clock signal and being out of phase with each other, for each of the groups respectively corresponding to the second bistable circuits, the buffer circuits that are respectively connected to the second ends of the two or more scanning signal lines in the group are supplied with clock signals included in the multi-phase clock signal and being out of phase with each other, and the buffer circuits that are respectively connected to the first and second ends of the same scanning signal line are supplied with the same clock signal in the multi-phase clock signal, the buffer circuits that are respectively connected to the first ends of the plurality of scanning signal lines each include a buffer transistor that has a control terminal at which to receive an output signal from a corresponding first bistable circuit, a first conductive terminal at which to receive the supplied clock signal, and a second conductive terminal connected to the first end of a corresponding scanning signal line, and the buffer circuits that are respectively connected to the second ends of the plurality of scanning signal lines each include a buffer transistor that has a control terminal at which to receive an output signal from a corresponding second bistable circuit, a first conductive terminal at which to receive the supplied clock signal, and a second conductive terminal connected to the second end of a corresponding scanning signal line.

In this configuration, the scanning signal lines of the display portion are connected at the first ends to buffer circuits in one-to-one correspondence and also at the second ends to other buffer circuits in one-to-one correspondence. Two or more buffer circuits respectively charge or discharge two or more scanning signal lines from their first ends in accordance with an output signal from one first bistable circuit. Two or more other buffer circuits respectively charge or discharge two or more scanning signal lines from their second ends in accordance with an output signal from one second bistable circuit. Thus, it is rendered possible to reduce the area of a shift register, resulting in a display panel with a narrow picture-frame area. Moreover, by charging or discharging the scanning signal lines from both ends, it is rendered possible to drive even a large display portion at high speed. Furthermore, even when there is a difference in charge/discharge capability between buffer circuits corresponding to a single first or second bistable circuit, the first and second bistable circuits output active signals out of phase with each other, with the result that the scanning signal lines are driven uniformly. Thus, it is rendered possible to provide satisfactory display free of artifacts such as stripe patterns.

(2) Moreover, scanning signal line drive circuits according to several embodiments of the present invention are each a scanning signal line drive circuit including the configuration of above (1), wherein, the buffer circuits that are respectively connected to the first ends of the plurality of scanning signal lines and the buffer circuits that are respectively connected to the second ends of the plurality of scanning signal lines each further include a capacitor and a transmission gate, the control terminal of the buffer transistor is connected to the second conductive terminal via the capacitor and to an output terminal of the corresponding bistable circuit via the transmission gate, and the transmission gate is configured to transmit a voltage within a range between a predetermined value corresponding to a power supply voltage for turning on the buffer transistor among power supply voltages for the first and second scanning signal line driver portions and a voltage value for turning off the buffer transistor, and to prevent a voltage that turns on the buffer transistor but is out of the range from being transmitted.

(3) Moreover, scanning signal line drive circuits according to several embodiments of the present invention are each a scanning signal line drive circuit including the configuration of above (1), wherein, the first bistable circuits are in one-to-one correspondence with a plurality of scanning signal line groups, each consisting of two adjacent scanning signal lines selected from the plurality of scanning signal lines, the second bistable circuits are in one-to-one correspondence with a plurality of scanning signal line groups, each consisting of two adjacent scanning signal lines selected from the plurality of scanning signal lines, for each bistable circuit of the first and second bistable circuits, the buffer circuit that is connected to one of two scanning signal lines in a group corresponding to the bistable circuit and receives an output signal from the bistable circuit is a first-type buffer circuit that includes the buffer transistor as a first transistor and further includes a first capacitor, the control terminal of the first transistor is connected to the second conductive terminal of the first transistor via the first capacitor as well as directly connected to the output terminal of the corresponding bistable circuit, for each bistable circuit of the first and second bistable circuits, the buffer circuit that is connected to the other of the two scanning signal lines in the group corresponding to the bistable circuit and receives the output signal from the bistable circuit is a second-type buffer circuit that includes the buffer transistor as a second transistor and further includes a second capacitor and a transmission gate, the control terminal of the second transistor is connected to the second conductive terminal of the second transistor via the second capacitor as well as to the output terminal of the corresponding bistable circuit via the transmission gate, and the transmission gate is configured to transmit a voltage within a range between a predetermined value corresponding to a power supply voltage for turning on the second buffer transistor among power supply voltages for the first and second scanning signal line driver portions and a voltage value for turning off the second buffer transistor, and to prevent a voltage that turns on the second buffer transistor but is out of the range from being transmitted.

(4) Moreover, scanning signal line drive circuits according to several embodiments of the present invention are each a scanning signal line drive circuit including the configuration of above (3), wherein, either or both of different size setting for the first and second transistors and different capacitance value setting for the first and second transistors are performed so as to reduce or eliminate a difference in scanning signal line drive capability between the first-type buffer circuit and the second-type buffer circuit.

(5) Moreover, scanning signal line drive circuits according to several embodiments of the present invention are each a scanning signal line drive circuit including the configuration of above (2) or (3), wherein, the transmission gate includes a field-effect transistor having a control terminal to which a power supply voltage for either the first or second scanning signal line driver portion is provided for turning on the buffer transistor in the buffer circuit that includes the transmission gate, and the control terminal of the buffer transistor in the buffer circuit that includes the transmission gate is connected to the output terminal of the corresponding bistable circuit via the field-effect transistor.

(6) Moreover, scanning signal line drive circuits according to several embodiments of the present invention are each a scanning signal line drive circuit including the configuration of above (2) or (3), wherein, the transmission gate includes two field-effect transistors of the same channel type, the two field-effect transistors being connected in parallel, each of the two field-effect transistors has a control terminal to which one clock signal included in the multi-phase clock signal is provided such that clock signals provided to the control terminals of the two field-effect transistors are opposite in phase, and the control terminal of the buffer transistor in the buffer circuit that includes the transmission gate is connected to the output terminal of the corresponding bistable circuit via the two field-effect transistors.

(7) Moreover, display devices according to several embodiments of the present invention are each a display device having a display portion provided with a plurality of data signal lines, a plurality of scanning signal lines crossing the data signal lines, and a plurality of pixel forming portions arranged in a matrix along the data signal lines and the scanning signal lines, the device including:

a data signal line drive circuit configured to drive the data signal lines;

a scanning signal line drive circuit including the configuration of any one of above (1) through (4); and a display control circuit configured to control the data signal line drive circuit and the scanning signal line drive circuit.

(8) Moreover, display devices according to several embodiments of the present invention are each a display device including the configuration of above (7), wherein, the scanning signal line drive circuit and the display portion are integrally formed on the same substrate.

(9) Moreover, display devices according to several embodiments of the present invention are each a display device including the configuration of above (7), wherein, the display control circuit controls the data signal line drive circuit and the scanning signal line drive circuit such that one frame period includes a non-scanning period in which the scanning signal lines are stopped from being driven between scanning periods in which the scanning signal lines are driven, the multi-phase clock signal consists of a plurality of clock signals out of phases with each other, voltage levels of the clock signals alternating between ON and OFF levels in predetermined cycles during the scanning period, the ON and OFF levels respectively corresponding to selection and deselection of the scanning signal lines, and the display control circuit generates the multi-phase clock signal such that, before the non-scanning period starts, the voltage levels of the clock signals are sequentially changed from the ON level to the OFF level and kept at the OFF level, and after the non-scanning period, the voltage levels of the clock signals are sequentially changed from the OFF level to the ON level and then alternate between the ON level and the OFF level in the predetermined cycles.

(10) Moreover, drive methods according to several embodiments of the present invention are each a drive method for selectively driving a plurality of scanning signal lines provided in a display portion of a display device, the method including:

a first scanning signal line drive step of driving the plurality of scanning signal lines from first ends of the plurality of scanning signal lines in accordance with a multi-phase clock signal; and a second scanning signal line drive step of driving the plurality of scanning signal lines from second ends of the plurality of scanning signal lines in accordance with the multi-phase clock signal, wherein, the first scanning signal line drive step includes:

a first shift operation step of sequentially outputting active signals from a plurality of first bistable circuits constituting a first shift register by being cascaded together and provided in one-to-one correspondence with a plurality of scanning signal line groups, each group consisting of two or more adjacent scanning signal lines selected from the plurality of scanning signal lines; and a first charge/discharge step of charging or discharging the plurality of scanning signal lines by a plurality of buffer circuits connected to the first ends of the plurality of scanning signal lines in one-to-one correspondence with the plurality of scanning signal lines, the second scanning signal line drive step includes:

a second shift operation step of sequentially outputting active signals from a plurality of second bistable circuits constituting a second shift register by being cascaded together and provided in one-to-one correspondence with a plurality of scanning signal line groups, each group consisting of two or more adjacent scanning signal lines selected from the plurality of scanning signal lines; and a second charge/discharge step of charging or discharging the plurality of scanning signal lines by a plurality of buffer circuits connected to the second ends of the plurality of scanning signal lines in one-to-one correspondence with the plurality of scanning signal lines, the plurality of scanning signal lines are grouped such that none of the scanning signal line groups corresponding to the first bistable circuits are identical to any of the scanning signal line groups corresponding to the second bistable circuits, in the first and second shift operation steps, the first bistable circuits and the second bistable circuits sequentially output active signals out of phase with each other in accordance with the grouping of the plurality of scanning signal lines, the first charge/discharge step includes a first clock supply step of supplying clock signals included in the multi-phase clock signal and being out of phase with each other, to the buffer circuits respectively connected to the first ends of the two or more scanning signal lines in each of the groups respectively corresponding to the first bistable circuits, the second charge/discharge step includes a second clock supply step of supplying clock signals included in the multi-phase clock signal and being out of phase with each other, to the buffer circuits respectively connected to the second ends of the two or more scanning signal lines in each of the groups respectively corresponding to the second bistable circuits, in the first and second clock supply steps, the buffer circuits that are respectively connected to the first and second ends of the same scanning signal line are supplied with the same clock signal in the multi-phase clock signal, in the first charge/discharge step, by means of buffer transistors each having a control terminal at which to receive an output signal from a corresponding first bistable circuit, a first conductive terminal at which to receive the supplied clock signal, and a second conductive terminal connected to the first end of a corresponding scanning signal line, the buffer circuits that are respectively connected to the first ends of the plurality of scanning signal lines charge or discharge the corresponding scanning signal lines from the first ends in accordance with the supplied clock signals when active signals are being outputted by the corresponding first bistable circuits, and in the second charge/discharge step, by means of buffer transistors each having a control terminal at which to receive an output signal from a corresponding second bistable circuit, a first conductive terminal at which to receive the supplied clock signal, and a second conductive terminal connected to the second end of a corresponding scanning signal line, the buffer circuits that are respectively connected to the second ends of the plurality of scanning signal lines charge or discharge the corresponding scanning signal lines from the second ends in accordance with the supplied clock signals when active signals are being outputted by the corresponding second bistable circuits.

These and other objects, features, aspects, and effects of the present invention will be made more clear from the following detailed description of the present invention with reference to the accompanying drawings.

DESCRIPTION OF THE EMBODIMENTS

Hereinafter, embodiments will be described with reference to the accompanying drawings. Note that as for each transistor to be mentioned below, a gate terminal corresponds to a control terminal, either a drain or source terminal corresponds to a first conductive terminal, and the other corresponds to a second conductive terminal. Moreover, all transistors in the embodiments are N-channel thin-film transistors (TFTs), but the present invention is not limited to this. Note that, of the two conductive terminals of the N-channel transistor, the one with the higher potential is the drain terminal, and the other is the source terminal, but herein, even in the case where the potential levels of the two conductive terminals are inverted during an operation, one of the two conductive terminals is always referred to as the "drain terminal", and the other as the "source terminal". Moreover, unless otherwise specified, the term "connection" herein is intended to mean "electrical connection", which may be either direct connection or indirect connection via another element without departing from the spirit and scope of the invention.

1. First Embodiment

1.1 Overall Configuration and Operation Outline

Figure 1:
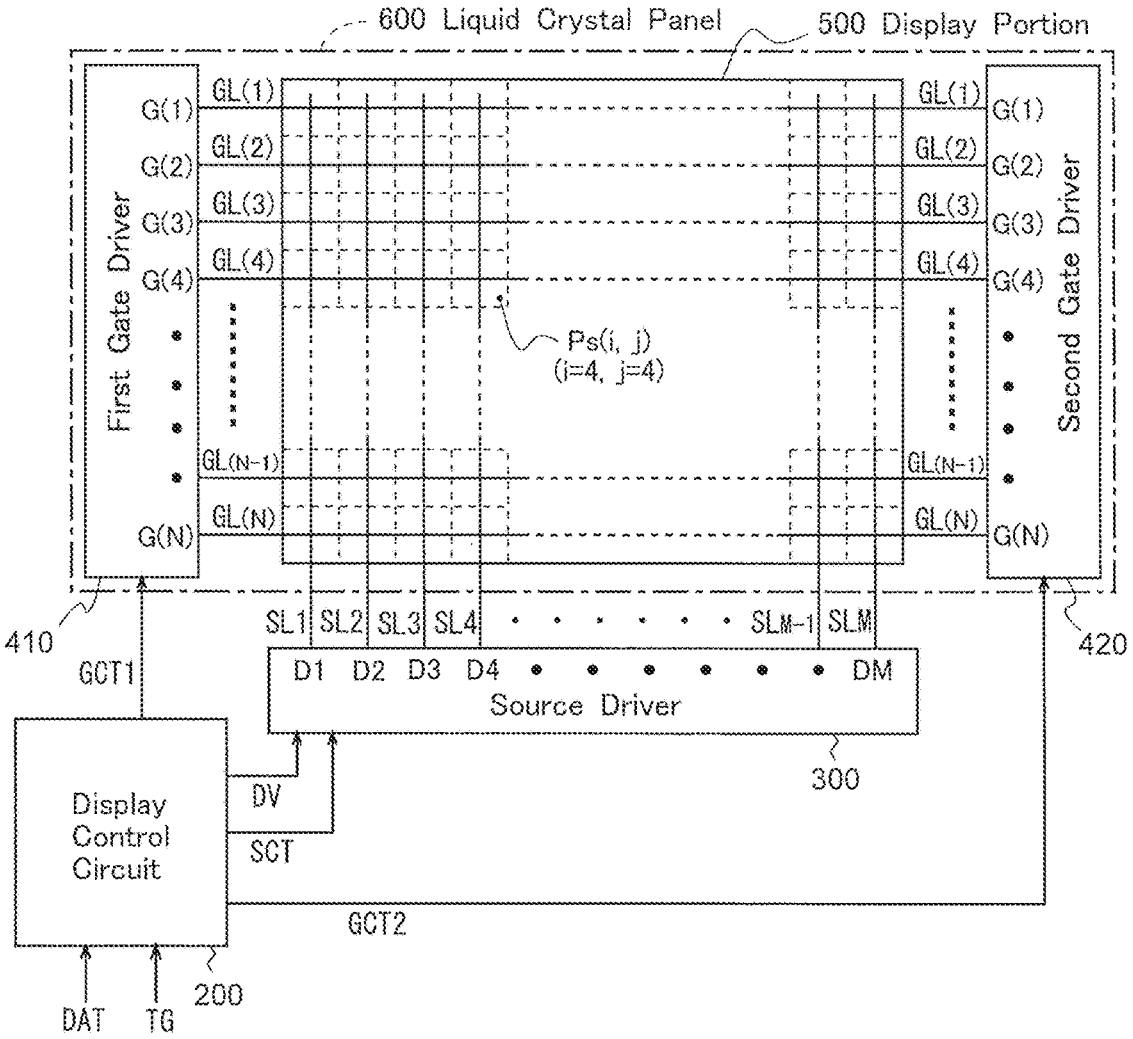
FIG. 1 is a block diagram illustrating an overall configuration of a display device according to a first embodiment.

FIG. 1 is a block diagram illustrating the overall configuration of an active-matrix liquid crystal display device according to the present embodiment. This liquid crystal display device includes a display control circuit 200, a source driver 300 serving as a data signal line drive circuit, and a liquid crystal panel 600, including a display portion 500 and a gate driver serving as a scanning signal line drive circuit. In the present embodiment, pixel circuits included in the display portion 500 and the gate driver are integrally formed on one of two substrates included in the liquid crystal panel 600 (the substrate being referred to as the "active-matrix substrate"), and the gate driver includes first and second gate drivers 410 and 420, which are disposed so as to be opposed to each other with respect to the display portion 500, as shown in FIG. 1.

The display portion 500 is provided with a plurality (M) of source bus lines $SL_1$ to $SL_M$ serving as data signal lines, a plurality (N) of gate bus lines GL(1) to GL(N) serving as scanning signal lines and crossing the source bus lines $SL_1$ to $SL_M$, and a plurality (M×N) of pixel forming portions Ps(i,j) (where i=1 to N, and j=1 to M) arranged in a matrix along the source bus lines $SL_1$ to $SL_M$ and the gate bus lines GL(1) to GL(N). Each pixel forming portion Ps(i,j) corresponds to one of the source bus lines $SL_1$ to $SL_M$ and also one of the gate bus lines GL(1) to GL(N). Note that the liquid crystal panel 600 is not limited to, for example, a vertical alignment (VA) or twisted nematic (TN) panel in which an electric field is applied vertically to a liquid crystal layer, and the liquid crystal panel 600 may be an in-plane switching (IPS) panel in which an electric field is applied approximately parallel to a liquid crystal layer.

Figure 2:
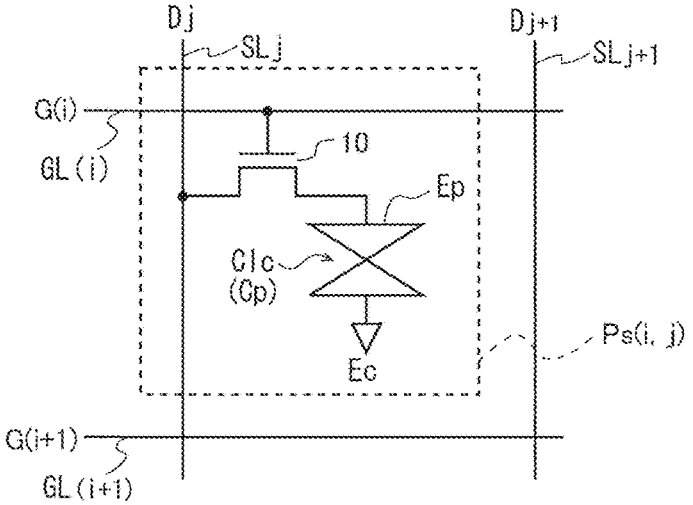
FIG. 2 is a circuit diagram illustrating electrical configuration of a pixel forming portion in the first embodiment.

FIG. 2 is a circuit diagram illustrating electrical configuration of one pixel forming portion Ps(i,j) of the display portion 500. As shown in FIG. 2, each pixel forming portion Ps(i,j) includes an N-channel thin-film transistor (TFT) 10, which serves as a pixel switching element and has a gate terminal connected to the gate bus line GL(i) that passes through a corresponding intersection and a source terminal connected to the source bus line $SL_j$ that passes through the intersection, a pixel electrode Ep connected to a drain terminal of the thin-film transistor 10, a common electrode Ec, which is an opposite electrode provided in common to the pixel forming portions Ps(i,j) (where i=1 to N, and j=1 to M), and a liquid crystal layer provided in common to the pixel forming portions Ps(i,j) (where i=1 to N, and j=1 to M) between the pixel electrode Ep and the common electrode Ec. Moreover, the pixel electrode Ep and the common electrode Ec constitute a liquid crystal capacitor Clc serving as a pixel capacitor Cp. Note that to reliably retain an electrical charge in the pixel capacitor Cp, an auxiliary capacitor is normally provided in parallel to the liquid crystal capacitor Clc, but the auxiliary capacitor is not directly relevant to the present invention, and therefore, any description and figure thereof will be omitted. Moreover, when the liquid crystal panel 600 is an IPS panel, the common electrode Ec is formed on the active-matrix substrate, one of the two substrates of the liquid crystal panel 600, and serves, together with the thin-film transistor 10 and the pixel electrode Ep, as the pixel circuit, but when the liquid crystal panel 600 is a VA panel or suchlike, the common electrode Ec is formed on the other of the two substrates.

Examples of the thin-film transistor that can be employed as the thin-film transistor 10 of the pixel forming portion Ps(i,j) include a thin-film transistor whose channel layer is made of amorphous silicon (a-Si TFT), a thin-film transistor whose channel layer is made of microcrystalline silicon, a thin-film transistor whose channel layer is made of oxide semiconductor (oxide TFT), and a thin-film transistor whose channel layer is made of low-temperature polysilicon (LTPS-TFT). An example of the oxide TFT that can be employed is a thin-film transistor whose oxide semiconductor layer includes an In—Ga—Zn—O based semiconductor (e.g., indium gallium zinc oxide). These apply similarly to thin-film transistors in the first and second gate drivers 410 and 420.

The display control circuit 200 is externally provided with an image signal DAT and a timing control signal TG, and outputs digital video signals DV, a data control signal SCT for controlling the operation of the source driver 300, and first and second scanning control signals GCT1 and GCT2 for respectively controlling the first and second gate drivers 410 and 420. The data control signal SCT includes a start pulse signal, a source clock signal, and a latch strobe signal. The first scanning control signal GCT1 includes a first gate start pulse signal GSP1 and first to fourth gate clock signals GCK1 to GCK4 out of phase with one another, and the second scanning control signal GCT2 includes a second gate start pulse signal GSP2 and the first to fourth gate clock signals GCK1 to GCK4. In the present embodiment, the gate driver consisting of the first and second gate drivers 410 and 420 is operated in accordance with a 4-phase clock signal consisting of the first to fourth gate clock signals GCK1 to GCK4.

The source driver 300 applies data signals D1 to DM respectively to the source bus lines $SL_1$ to $SL_M$ in accordance with the digital video signals DV and the data control signal SCT from the display control circuit 200. In this case, the source driver 300 sequentially holds the digital video signals DV, which indicate voltages to be applied to the source bus lines SL, at times when pulses of the source clock signal are generated. Then, the digital video signals DV being hold are converted into analog voltages at times when pulses of the latch strobe signal are generated. The resultant analog voltages are applied simultaneously to all the source bus lines $SL_1$ to $SL_M$ as data signals D1 to DM.

The first gate driver 410 is disposed to a first-end side of the gate bus lines GL(1) to GL(N), and applies the scanning signals G(1) to G(N) respectively to first ends of the gate bus lines GL(1) to GL(N) in accordance with the first scanning control signal GCT1 from the display control circuit 200. On the other hand, the second gate driver 420 is disposed to a second-end side of the gate bus lines GL(1) to GL(N), and applies the scanning signals G(1) to G(N) respectively to second ends of the gate bus lines GL(1) to GL(N) in accordance with the second scanning control signal GCT2 from the display control circuit 200. As a result, for each frame period, active scanning signals are sequentially applied to the gate bus lines GL(1) to GL(N) from both ends, and such application of the active scanning signals to the gate bus lines GL(i) (where i=1 to N) is repeated in cycles of one frame period (one vertical scanning period).

The liquid crystal panel 600 has an unillustrated backlight unit provided on a back-surface side and is backlit by the backlight unit. The backlight unit is also driven by the display control circuit 200, but may be driven by another method. Note that in the case where the liquid crystal panel 600 is of a reflective type, the backlight unit is dispensable.

In this manner, the data signals D1 to DM are applied to the source bus lines $SL_1$ to $SL_M$, and the scanning signal G(1) to G(N) are applied to the gate bus lines GL(1) to GL(N). Moreover, the common electrode Ec is supplied with a predetermined common voltage $V_{com}$ from an unillustrated power circuit. In addition, the backlight unit is supplied with a signal for driving the backlight unit. In such a display portion 500, the source bus lines $SL_1$ to $SL_M$, the gate bus lines GL(1) to GL(N), and the common electrode Ec are driven such that pixel data based on the digital video signals DV is written to the pixel forming portions Ps(i,j), the liquid crystal panel 600 is backlit by the backlight unit, with the result that the display portion 500 displays an image represented by the externally provided image signal DAT.

1.2 Basic Configuration of the Gate Driver

Next, the gate driver in the present embodiment will be described. First, before describing in detail the configuration and the operation of the gate driver in the present embodiment, a gate driver employing the single-ended input scheme will be described in relation to the gate driver in the present embodiment.

Figure 3:
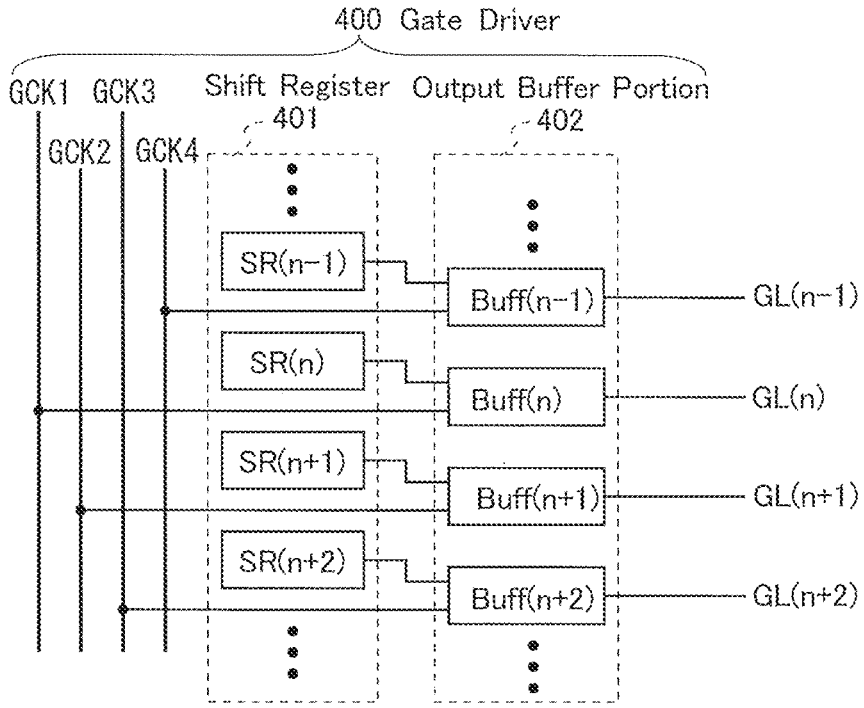
FIG. 3 is a schematic circuit diagram illustrating a configuration of a first single-ended-input gate driver in conjunction with the first embodiment.

FIG. 3 is a schematic circuit diagram illustrating the configuration of a gate driver (also referred to below as a "first single-ended-input gate driver") 400 employing a single-ended input scheme in which the gate driver 400 is provided simply to the first-end side of the gate bus lines GL(1) to GL(N). The gate driver 400 includes a shift register 401 and an output buffer portion 402, and is operated in accordance with a 4-phase gate clock signal consisting of first to fourth gate clock signals GCK1 to GCK4, as in the present embodiment.

The shift register 401 includes N bistable circuits SR(1) to SR(N) cascaded together, and is configured such that a start pulse provided by the display control circuit is transferred sequentially from the bistable circuit SR(1) in the first stage to the bistable circuit SR(N) in the last stage in accordance with the signals GCK1 to GCK4 in the 4-phase clock signal. The output buffer portion 402 includes N buffer circuits Buff(1) to Buff(N) respectively corresponding to the N bistable circuits SR(1) to SR(N) of the shift register 401, and the first to fourth gate clock signals GCK1 to GCK4 cyclically correspond to the N buffer circuits Buff(1) to Buff(N). The N buffer circuits Buff(1) to Buff(N) have output terminals respectively connected to the N gate bus lines GL(1) to GL(N), and each buffer circuit Buff(i) receives an output signal from a corresponding bistable circuit SR(i) and also a corresponding gate clock signal GCKk (where i=1 to N, and k is any number from 1 to 4), and generates a scanning signal G(i) to be applied to the gate bus line GL(i), on the basis of these signals. For example, the n'th buffer circuit Buff(n) generates a scanning signal G(n) based on an output signal from the n'th-stage bistable circuit SR(n) and the first gate clock signal GCK1, and applies the generated signal to the n'th gate bus line GL(n).

Figure 4:
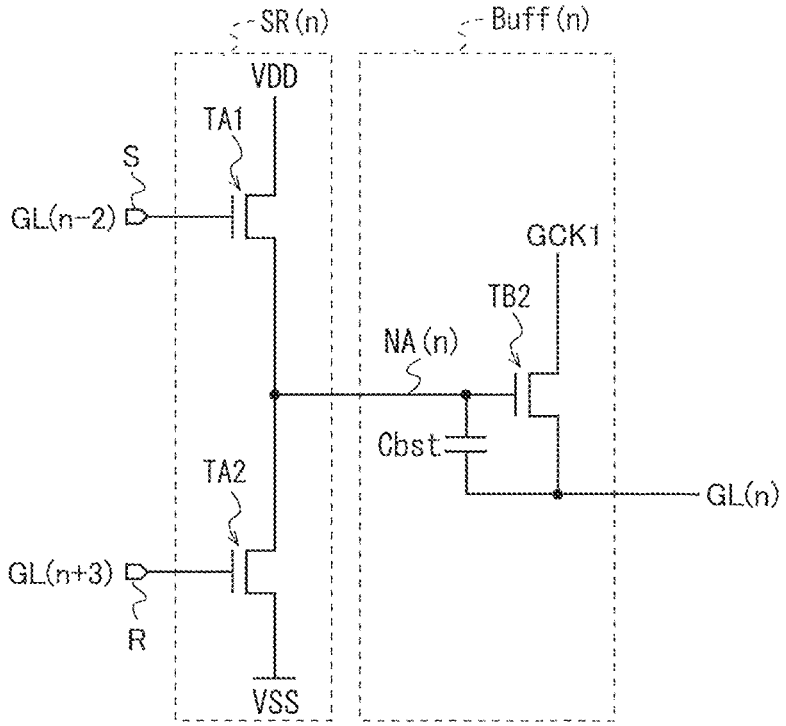
FIG. 4 is a circuit diagram illustrating a configuration of a unit circuit in the first single-ended-input gate driver.

FIG. 4 is a circuit diagram illustrating the configuration of the n'th stage unit circuit as an example of a circuit portion that corresponds to a bistable circuit in one stage of the first single-ended-input gate driver 400 (the circuit portion will be referred to below as the "gate driver unit circuit" or simply as the "unit circuit"). The n'th-stage unit circuit consists of the n'th-stage bistable circuit SR(n) of the shift register 401 and the n'th buffer circuit Buff(n) of the output buffer portion 402.

The bistable circuit SR(n) includes two N-channel thin-film transistors TA1 and TA2. The transistor TA1 has a drain terminal connected to a high-level power line VDD, the transistor TA2 has a source terminal connected to a low-level power line VSS, and a source terminal of the transistor TA1 and a drain terminal of the transistor TA2 are connected to each other, thereby forming an output terminal (a node including the output terminal will be referred to below as a "state node"). A gate terminal of the transistor TA1 serves as a SET terminal S, a gate terminal of the transistor TA2 serves as a RESET terminal R, and the bistable circuit SR(n) switches between two states by charging or discharging a capacitor connected to the state node NA(n) (the capacitor being, for example, gate capacitance of a transistor TB in the buffer circuit Buff(n), which will be described later). Specifically, when an active signal (i.e., a high-level (or H-level)

signal) is provided to the SET terminal S, which is the gate terminal of the transistor TA1, the bistable circuit SR(n) is rendered in SET state (in which a voltage at the state node NA(n) is at H level), and when an active signal (i.e., an H-level signal) is provided to the RESET terminal R, which is the gate terminal of the transistor TA2, the bistable circuit SR(n) is rendered in RESET state (in which the voltage of the state node NA(n) is at L level). In the n'th-stage bistable circuit SR(n) shown in FIG. 4, the SET terminal S is connected to the (n−2)'th gate bus line GL(n−2), and the RESET terminal R is connected to the (n+3)'th gate bus line GL(n+3). Note that when the bistable circuit SR(n) is in SET state, the bistable circuit SR(n) outputs an active signal from the output terminal. Herein, the active signal refers to an H-level signal (including a signal whose level is higher than a normal H level due to a boost operation to be described later).

The buffer circuit Buff(n) includes a buffer transistor TB, which is an N-channel thin-film transistor, and a boost capacitor $C_{bst}$. The buffer transistor TB has a drain terminal to which the first gate clock signal GCK1 that corresponds to the buffer circuit Buff(n) is provided. The buffer transistor TB has a gate terminal serving as an input terminal of the buffer circuit Buff(n) and connected to the state node NA(n). The buffer transistor TB has a source terminal serving as an output terminal of the buffer circuit Buff(n) and connected to the gate terminal via the boost capacitor $C_{bst}$ and also to the gate bus line GL(n).

Figure 5:
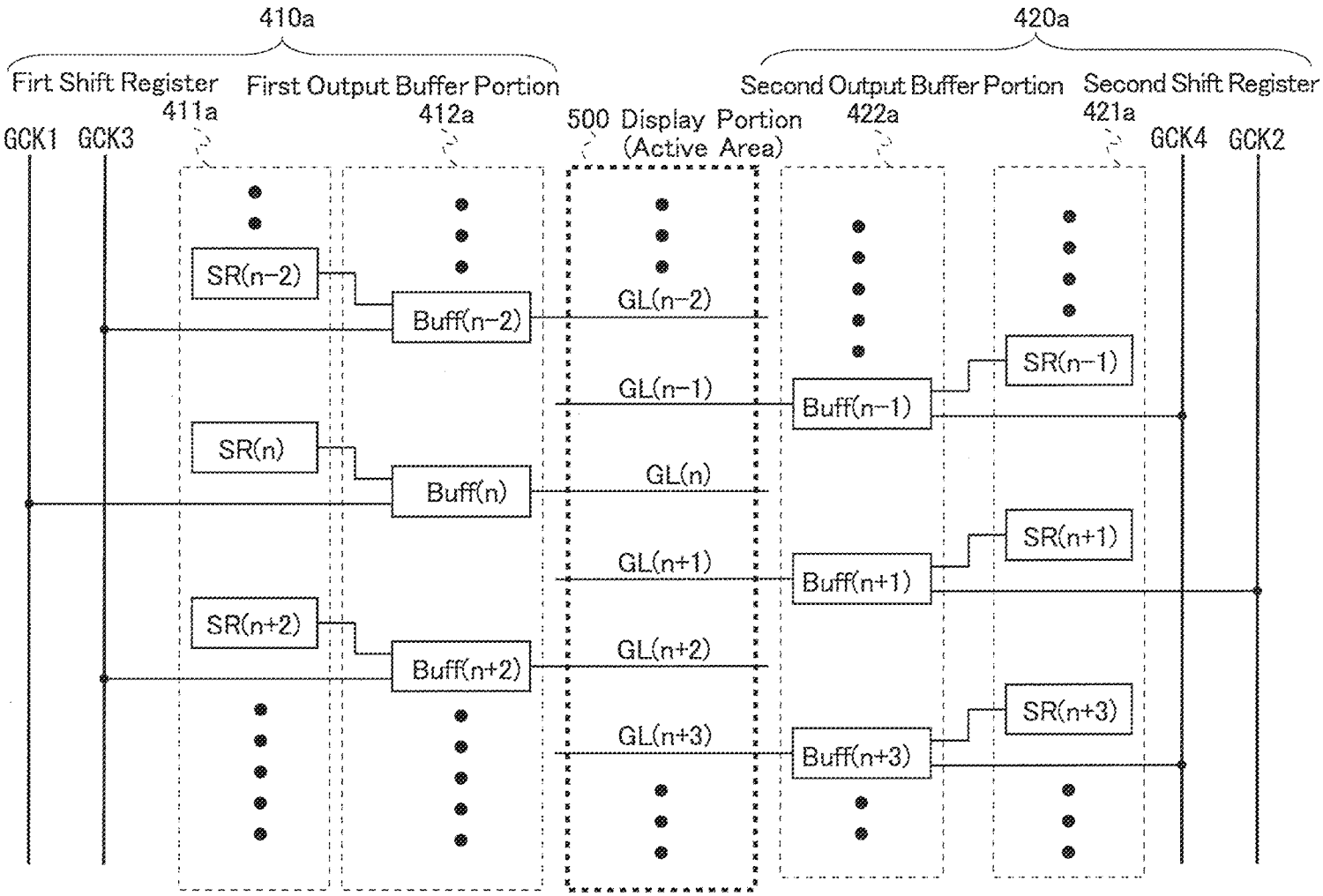
FIG. 5 is a schematic circuit diagram illustrating an overall configuration of a second single-ended-input gate driver, i.e., an interlaced-arrangement-type gate driver, in conjunction with the first embodiment.
Figure 30:
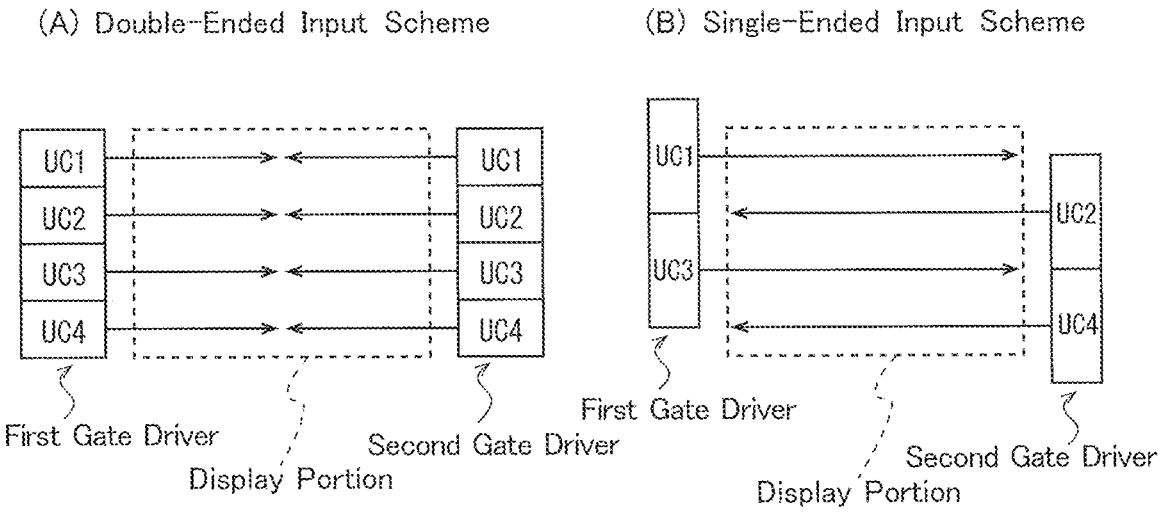
FIG. 30 consists of a schematic diagram (A) for describing a double-ended-input gate driver and a schematic diagram (B) for describing a single-ended-input gate driver.

FIG. 5 is a schematic circuit diagram illustrating the configuration of an interlaced-arrangement-type gate driver (referred to below as a "second single-ended-input gate driver") consisting of first and second gate drivers 410*a* and 420*a* respectively disposed to first-end and second-end sides of the gate bus lines GL(1) to GL(N) (see (B) of FIG. 30). In a display device using such an interlaced-arrangement-type gate driver, the gate bus lines connected to the first and second gate drivers 410*a* and 420*a* are disposed alternatingly in the display portion 500.

The interlaced-arrangement-type gate driver is also operated in accordance with a 4-phase gate clock signal consisting of first to fourth gate clock signals GCK1 to GCK4. In this gate driver, the first gate driver 410*a* is operated in accordance with the first and third gate clock signals GCK1 and GCK3, and the second gate driver 420*a* is operated in accordance with the second and fourth gate clock signals GCK2 and GCK4. The first gate driver 410*a* includes a first shift register 411*a* and a first output buffer portion 412*a*. The first shift register 411*a* is configured by a set of cascaded bistable circuits ( . . . , SR(n−2), SR(n), SR(n+2), . . . ) grouped by selecting every other bistable circuit from among N bistable circuits SR(1) to SR(N), as included in the shift register 401 of the first single-ended-input gate driver 400, and the first output buffer portion 412*a* includes buffer circuits ( . . . , Buff(n−2), Buff(n), Buff(n+2), . . . ) respectively corresponding to the bistable circuits ( . . . , SR(n−2), SR(n), SR(n+2), . . . ). Each buffer circuit Buff(k) in the first output buffer portion 412*a* generates a scanning signal G(k) to be applied to the gate bus line GL(k), on the basis of an output signal from the corresponding bistable circuit SR(k) and either the first or third gate clock signal GCK1 or GCK3 (where k= . . . , n−2, n, n+2, . . . ). On the other hand, the second gate driver 420*a* includes a second shift register 421*a* and a second output buffer portion 422*a*. The second shift register 421*a* has a set of cascaded bistable circuits ( . . . , SR(n−1), SR(n+1), SR(n+3), . . . ) which are from among the N bistable circuits SR(1) to SR(N) but are not included in the first shift register 411*a*, and the second output buffer portion 422*a* includes buffer circuits ( . . . , Buff(n−1), Buff(n+1), Buff(n+3), . . . ) respectively corresponding to the bistable circuits ( . . . , SR(n−1), SR(n+1), SR(n+3), . . . ). Each buffer circuit Buff(k) in the second output buffer portion 422*a* generates a scanning signal G(k) to be applied to the gate bus line GL(k), on the basis of an output signal from the corresponding bistable circuit SR(k) and either the second or fourth gate clock signal GCK2 or GCK4 (where k= . . . , n−1, n+1, n+3, . . . ).

In the interlaced-arrangement-type gate driver thus configured as shown in FIG. 5, the scanning signal G(i) is applied to each gate bus line GL(i) of the display portion (active area) 500 only from one end (where i=1 to N), and therefore, it is possible to reduce the area that is occupied by each of the first and second gate drivers 410 and 420, resulting in a narrow picture-frame area of the display device. However, since each gate bus line GL(i) is provided with the scanning signal G(i) only from one end, the scanning signal suffers from waveform rounding at the other end, resulting in a reduced speed for pixel capacitor charging. Note that as has already been described, Japanese Laid-Open Patent Publication No. 2014-71451 discloses a liquid crystal display device using an interlaced-arrangement-type gate driver and including discharging means for assisting in discharging gate bus lines. However, in this liquid crystal display device, each gate bus line is charged only from one end. Accordingly, the drive capability of the gate driver is not sufficient for driving a display panel at high speed or driving a large display panel.

Therefore, the gate driver in the present embodiment is configured as below with a view to allowing even a large display panel to be driven at high speed while achieving a narrow picture-frame area by employing an interlaced arrangement.

Figure 6:
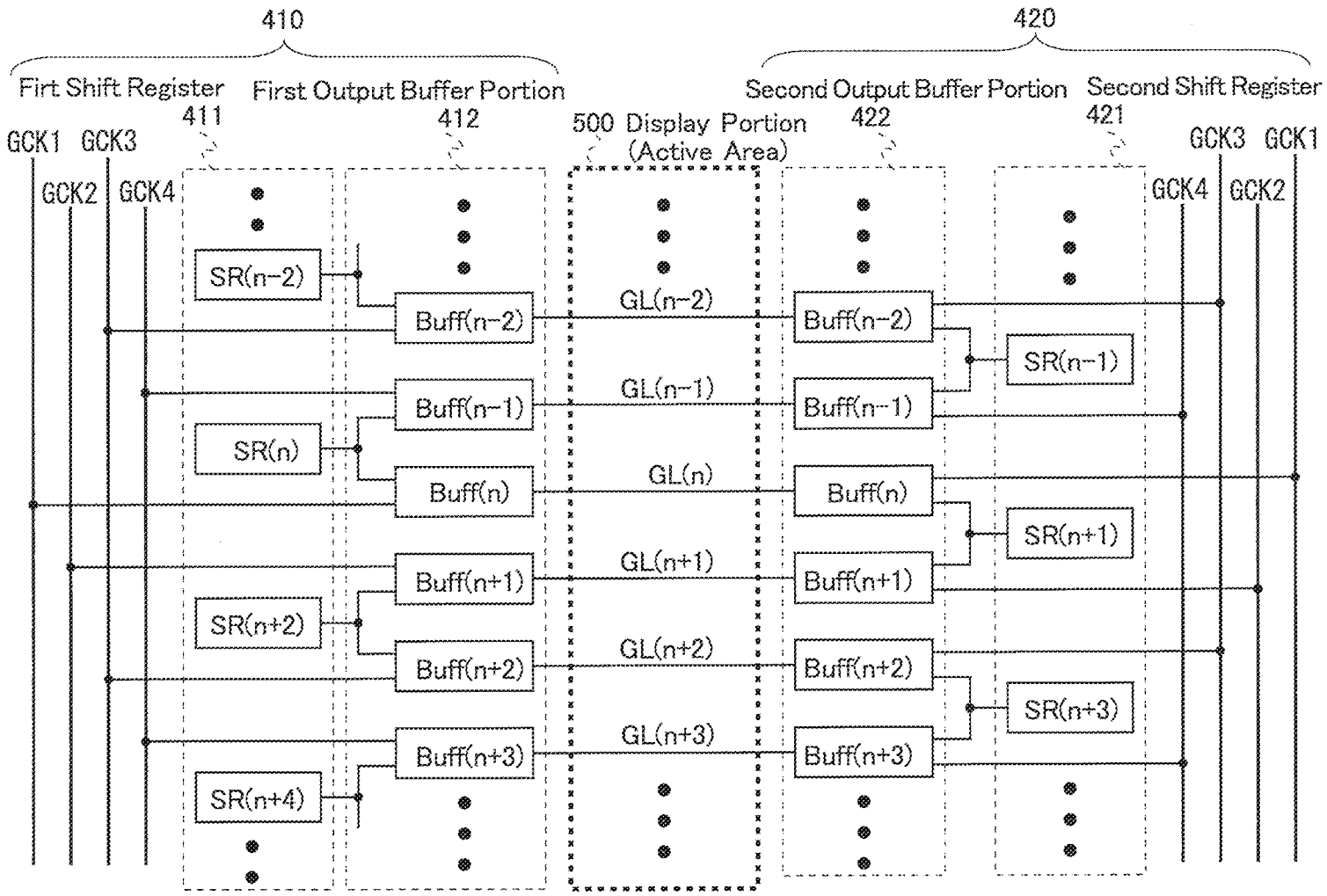
FIG. 6 is a schematic circuit diagram illustrating an overall configuration of a gate driver in the first embodiment.

FIG. 6 is a schematic circuit diagram illustrating the overall configuration of a gate driver in the present embodiment. This gate driver, as with the gate driver shown in FIG. 5, includes first and second gate drivers 410 and 420 respectively disposed to first-end and second-end sides of the gate bus lines GL(1) to GL(N), and is operated in accordance with a 4-phase clock signal consisting of first to fourth gate clock signals GCK1 to GCK4. Moreover, the first gate driver 410 in the present embodiment includes a first shift register 411 and a first output buffer portion 412, and the first shift register 411 is configured by a set of cascaded bistable circuits ( . . . , SR(n−2), SR(n), SR(n+2), . . . ) grouped by selecting every other bistable circuit from among N bistable circuits SR(1) to SR(N), as included in the shift register 401 of the first single-ended-input gate driver 400. The second gate driver 420 in the present embodiment includes a second shift register 421 and a second output buffer portion 422, and the second shift register 421 is configured by a set of cascaded bistable circuits ( . . . , SR(n−1), SR(n+1), SR(n+3), . . . ) which are from among the N bistable circuits SR(1) to SR(N) but are not included in the first shift register 411. However, in the gate driver in the present embodiment, unlike in the gate driver shown in FIG. 5, each bistable circuit SR(i) in the first and second shift registers 411 and 421 corresponds to two buffer circuits Buff(i−1) and Buff(i), and provides an output signal to the two buffer circuits Buff(i−1), and Buff(i), thereby controlling these buffer circuits (where i=1 to N).

Accordingly, each gate bus line GL(i) has one buffer circuit Buff(i) connected at each end (where i=1 to N), as shown in FIG. 6. In the present embodiment, correspondingly, both the first and second gate drivers 410 and 420 are supplied with all of the first to fourth gate clock signals GCK1 to GCK4, and the first to fourth gate clock signals GCK1 to GCK4 cyclically correspond to the N buffer circuits Buff(1) to Buff(N) in each of the first and second output buffer portions 412 and 422. Note that the same gate clock signal corresponds to the buffer circuits that are respectively connected to one end and the other of the same gate bus line. Each buffer circuit Buff(i) receives an output signal from the corresponding bistable circuit and a corresponding gate clock signal GCKk (where k is any number from 1 to 4), and generates a scanning signal G(i) to be applied to the gate bus line GL(i), based on these signals.

For example, in the first output buffer portion 412, the n'th buffer circuit Buff(n) generates a scanning signal G(n) based on an output signal from the bistable circuit SR(n) and the first gate clock signal GCK1, and applies the generated signal to the n'th gate bus line GL(n), and the (n−1)'th buffer circuit Buff(n−1) generates a scanning signal G(n−1) based on an output signal from the bistable circuit SR(n) and the fourth gate clock signal GCK4, and applies the generated signal to the (n−1)'th gate bus line GL(n−1).

It should be noted that to allow the bistable circuits included in the first shift register 411 to actually function as a shift register, it is necessary to provide dummy bistable circuits before the first-stage bistable circuit and after the last-stage bistable circuit depending on the number of phases of the gate clock signal and the number of bistable circuits to be controlled by one bistable circuit, but specific features related to this are obvious to those skilled in the art, and therefore, any description thereof will be omitted (the same applies to other embodiments to be described later and also to variants thereof).

Figure 7:
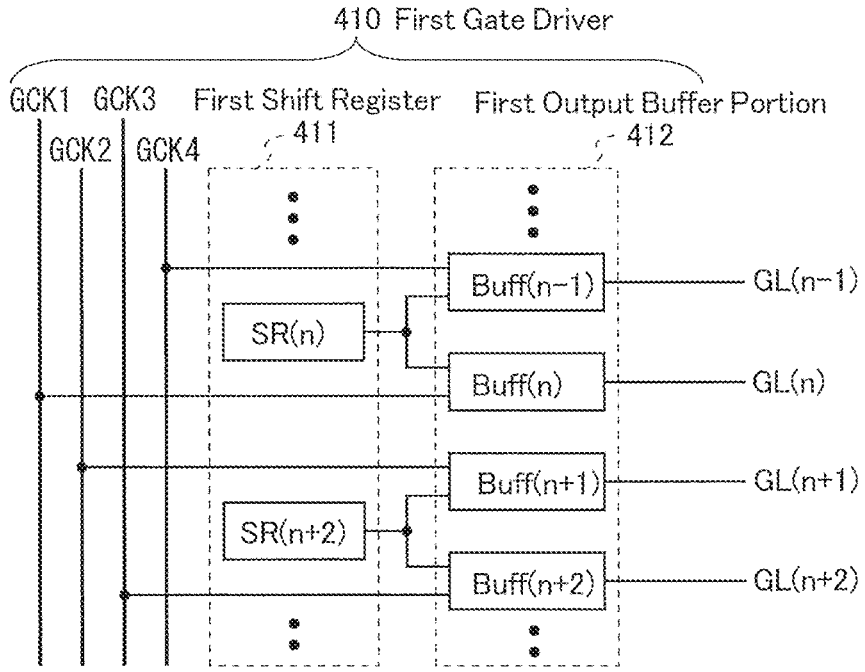
FIG. 7 is a schematic circuit diagram for describing a configuration of a first gate driver in the first embodiment.

The gate driver configuration in the present embodiment will be described in further detail below, focusing on the first gate driver 410. FIG. 7 is a schematic circuit diagram illustrating the configuration of the first gate driver 410. The first shift register 411 includes bistable circuits SR(n) and SR(n+2) cascaded together, as shown in FIG. 7. Here, the bistable circuits SR(n) and SR(n+2) correspond to the n'th-stage and (n+2)'th-stage bistable circuits SR(n) and SR(n+2) of the first single-ended-input gate driver 400 shown in FIG. 3. In the present embodiment, the bistable circuit SR(n) has an output terminal connected to input terminals of the (n−1)'th and n'th buffer circuits Buff(n−1) and Buff(n), and the bistable circuit SR(n+2) has an output terminal connected to input terminals of the (n+1)'th and (n+2)'th buffer circuits Buff(n+1) and Buff(n+2). Moreover, the buffer circuits Buff(n−1) to Buff(n+2) respectively receive fourth, first, second, and third gate clock signals GCK4, GCK1, GCK2, and GCK3. In the following, one bistable circuit SR(i) and two buffer circuits Buff(i−1) and Buff(i) connected thereto are collectively deemed as a unit circuit of the gate driver (the unit circuit will be referred to as below as the "i'th unit circuit" when it is necessary to distinguish the unit circuit from other unit circuits of the gate driver in the present embodiment). Accordingly, in FIG. 7, one bistable circuit SR(n) and two buffer circuits Buff(n−1) and Buff(n) constitute one unit circuit (n'th unit circuit), and one bistable circuit SR(n+2) and two buffer circuits Buff(n+1) and Buff (n+2) constitute another unit circuit ((n+2)'th unit circuit).

Figure 8:
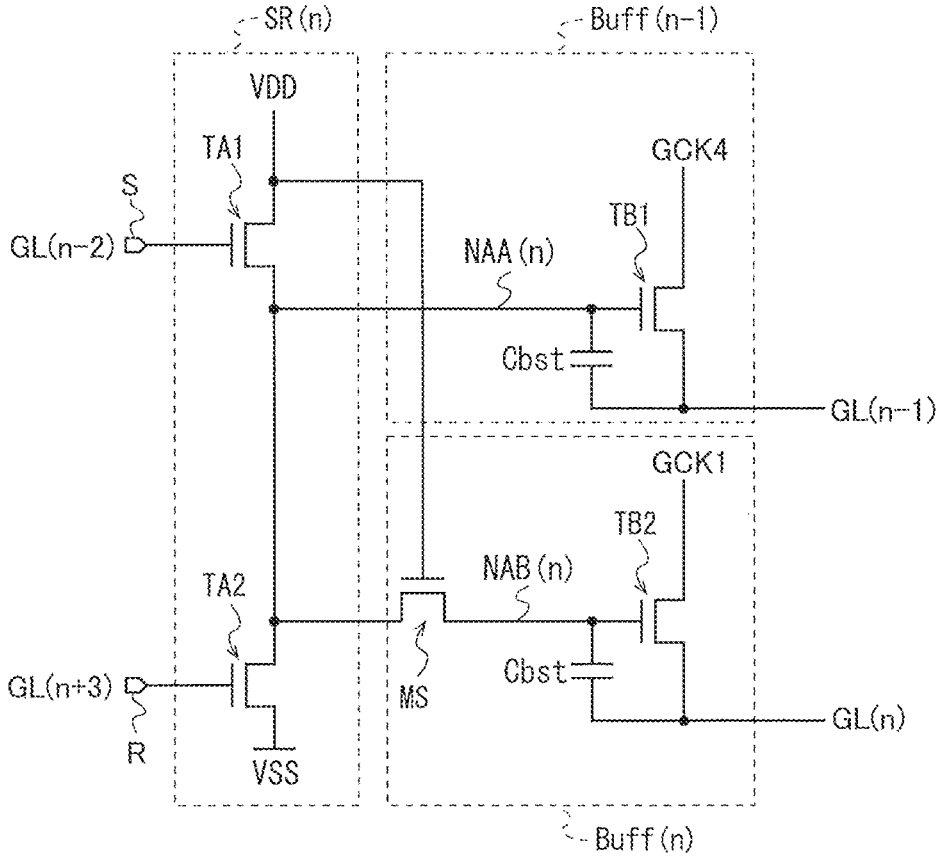
FIG. 8 is a circuit diagram illustrating a basic configuration of a unit circuit of the gate driver in the first embodiment.

FIG. 8 is a circuit diagram illustrating the basic configuration of the n'th unit circuit of the gate driver in the present embodiment. The other unit circuits also have the same configuration, except for input and output signals. The basic configuration of the unit circuit in the present embodiment will be described below, taking as an example the n'th unit circuit shown in FIG. 8.

The n'th unit circuit of the gate driver in the present embodiment includes one bistable circuit SR(n) and (n−1)'th and n'th buffer circuits Buff(n−1) and Buff(n). The bistable circuit SR(n) has the same configuration as the bistable circuit SR(n) of the first single-ended-input gate driver, i.e., the bistable circuit SR(n) shown in FIG. 4, and includes two N-channel thin-film transistors TA1 and TA2. A source terminal of the transistor TA1 and a drain terminal of the transistor TA2 are connected to each other, and a connecting point thereof serves as an output terminal of the bistable circuit SR(n). The output terminal is included in a node, which can selectively hold either an H-level or L-level voltage by utilizing capacitance attached thereto (the node will be referred to below as the "first state node").

The (n−1)'th buffer circuit Buff(n−1) has the same configuration as the buffer circuit Buff(n) shown in FIG. 4, and includes a buffer transistor TB1, which is an N-channel thin-film transistor, and a boost capacitor $C_{bst}$. However, the buffer transistor TB1 has a drain terminal to which the fourth gate clock signal GCK4 corresponding to the buffer circuit Buff(n−1) is provided, and also has a gate terminal serving as an input terminal and connected to the first state node NAA(n) of the bistable circuit SR(n).

The n'th buffer circuit Buff(n) includes an N-channel thin-film transistor MS, in addition to a buffer transistor TB2, which is also an N-channel thin-film transistor, and a boost capacitor $C_{bst}$. The buffer transistor TB2 has a drain terminal to which the first gate clock signal GCK1 corresponding to the buffer circuit Buff(n) is provided. The buffer transistor TB2 has a gate terminal connected to the first state node NAA(n), which serves as an output terminal of the bistable circuit SR(n), via the transistor MS, which is connected to the output terminal at a conductive terminal that serves as an input terminal of the buffer circuit Buff(n). A source terminal of the buffer transistor TB2 serves as an output terminal of the buffer circuit Buff(n), and is connected to the gate terminal of the buffer transistor TB2 via the boost capacitor $C_{bst}$ and also to the gate bus line GL(n).

In the n'th buffer circuit Buff(n), a gate terminal of the transistor MS is connected to a high-level power line VDD (hereinafter, a voltage on the high-level power line VDD will be referred to as a "high-level power supply voltage" and denoted by the same symbol "VDD"). Accordingly, in the case where a threshold voltage of the transistor MS is Vth(MS), when both voltages at source and drain terminals of the transistor MS are higher than the value VDD−Vth (MS), the transistor MS is in OFF state. Therefore, in the case where the buffer transistor TB2 is in ON state, even if a voltage at the gate terminal of the buffer transistor TB2, i.e., a voltage at a node (referred to below as a "second state node") NAB(n), which includes the gate terminal, is raised by a pulse of the first gate clock signal GCK1 via the boost capacitor $C_{bst}$, such a voltage rise does not affect a voltage at the first state node NAB(n) at the opposite end of the transistor MS. Moreover, in the case where the buffer transistor TB1 of the (n−1)'th buffer circuit Buff(n−1) is in ON state, even if a voltage at the gate terminal of the buffer transistor TB1, i.e., the voltage at the first state node NAA(n), is raised by a pulse of the fourth gate clock signal GCK4 via the boost capacitor $C_{bst}$, such a voltage rise does not affect the voltage at the second state node NAA(n) at the opposite end of the transistor MS. The reason for this is that the transistor MS is operated as a transmission gate based on field-effect transistor characteristics thereof, so as to transmit voltages less than or equal to the value VDD−Vth(MS) and prevent transmission of voltages greater than the value VDD−Vth(MS). More specifically, the transistor MS is operated as a transmission gate which transmits voltages less than or equal to the value VDD−Vth(MS) close to the high-level power supply voltage VDD, which turns on the buffer transistor TB2, and prevents transmission of voltages greater than the value close to the high-level power supply voltage VDD. The transistor MS functioning as such a transmission gate is positioned between the first state node NAA(n) and the second state node NAB(n) so as to keeping a boost effect of either one of the first and second state nodes NAA(n) and NAB(n) from affecting the other. Accordingly, the transistor MS will be referred to below as the "boost isolation transistor".

1.3 Detailed Configuration of the Gate Driver

Figure 9:
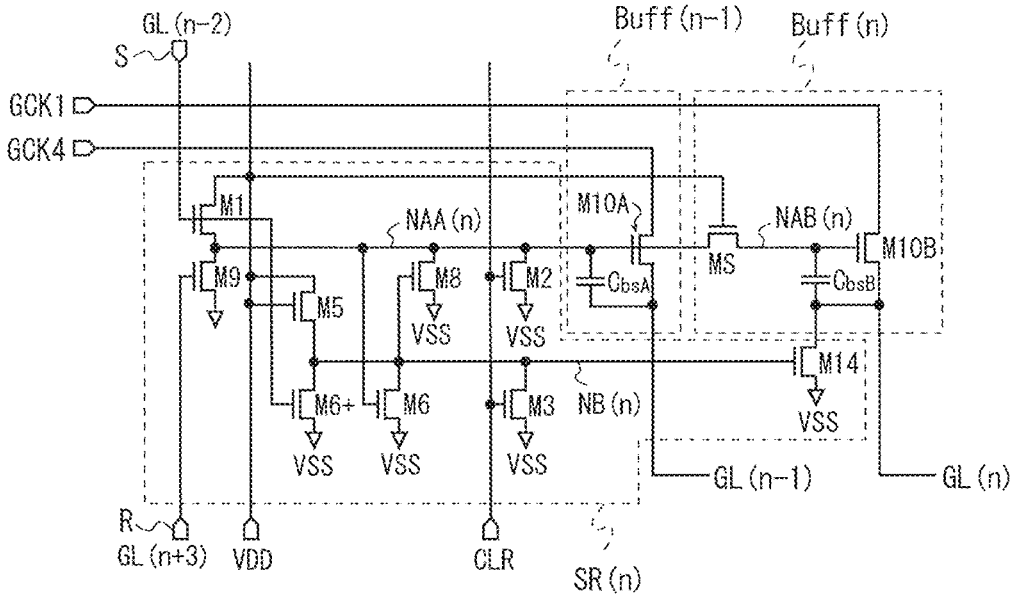
FIG. 9 is a circuit diagram for describing a detailed configuration example of the unit circuit of the gate driver in the first embodiment.

FIG. 9 is a circuit diagram for describing a detailed configuration example of the gate driver in the present embodiment and illustrates an example of the actual configuration of the n'th unit circuit in the first gate driver 410, as shown in FIG. 8. The n'th unit circuit in the first gate driver 410 will be described herein by way of example, and the other unit circuits also have the same configuration as the n'th unit circuit.

In the configuration example shown in FIG. 9, the n'th bistable circuit SR(n) is realized by connecting N-channel thin-film transistors M1, M2, M3, M5, M6, M6+, M8, M9, and M14 as shown in FIG. 9, and has a SET terminal S and a RESET terminal R respectively connected to the (n−2)'th and (n+3)'th gate bus lines GL(n−2) and GL(n+3). The transistors M1 and M9 of the n'th bistable circuit SR(n) respectively correspond to the transistors TA1 and TA2 shown in FIG. 8. A connecting point of the transistors M1 and M9 serves as an output terminal of the bistable circuit SR(n), and a node including the output terminal is a first state node NAA(n). Moreover, the bistable circuit SR(n) has a CLEAR terminal CLR serving as an input terminal for a CLEAR signal for initializing a shift register, and the CLEAR terminal CLR is connected to gate terminals of the transistors M2 and M3. Note that a node NB(n) including a connecting point of the transistors M5 and M6 will be referred to below as a "third state node".

The (n−1)'th buffer circuit Buff(n−1) shown in FIG. 9 has the same configuration as that of the (n−1)'th buffer circuit Buff(n−1) shown in FIG. 8, and includes an N-channel thin-film transistor M10A and a boost capacitor $C_{bsA}$. The transistor M10A and the capacitor $C_{bsA}$ correspond to the buffer transistor TB1 and the boost capacitor $C_{bst}$ of the buffer circuit Buff(n−1) shown in FIG. 8. The buffer transistor M10A has a drain terminal to which the fourth gate clock signal GCK4 corresponding to the buffer circuit Buff(n−1) is provided, and also has a source terminal connected to the (n−1)'th gate bus line GL(n−1).

The n'th buffer circuit Buff(n) shown in FIG. 9 has the same configuration as that of the n'th buffer circuit Buff(n) shown in FIG. 8, and includes two N-channel thin-film transistors M10B and MS and a boost capacitor $C_{bsB}$. The transistor M10B, the transistor MS, and the capacitor $C_{bsB}$ respectively correspond to the buffer transistors TB2, the boost isolation transistor MS, and the boost capacitor $C_{bst}$ of the buffer circuit Buff(n) shown in FIG. 8. The buffer transistor M10B has a drain terminal to which the gate clock signal GCK1 corresponding to the buffer circuit Buff(n) is provided, and also has a source terminal connected to the n'th gate bus line GL(n). Note that the buffer transistor M10B has a gate terminal connected to the first state node NAA(n) via the boost isolation transistor MS, and a node including the gate terminal is a second state node NAB(n).

1.4 Operation of the Gate Driver

Figure 10:
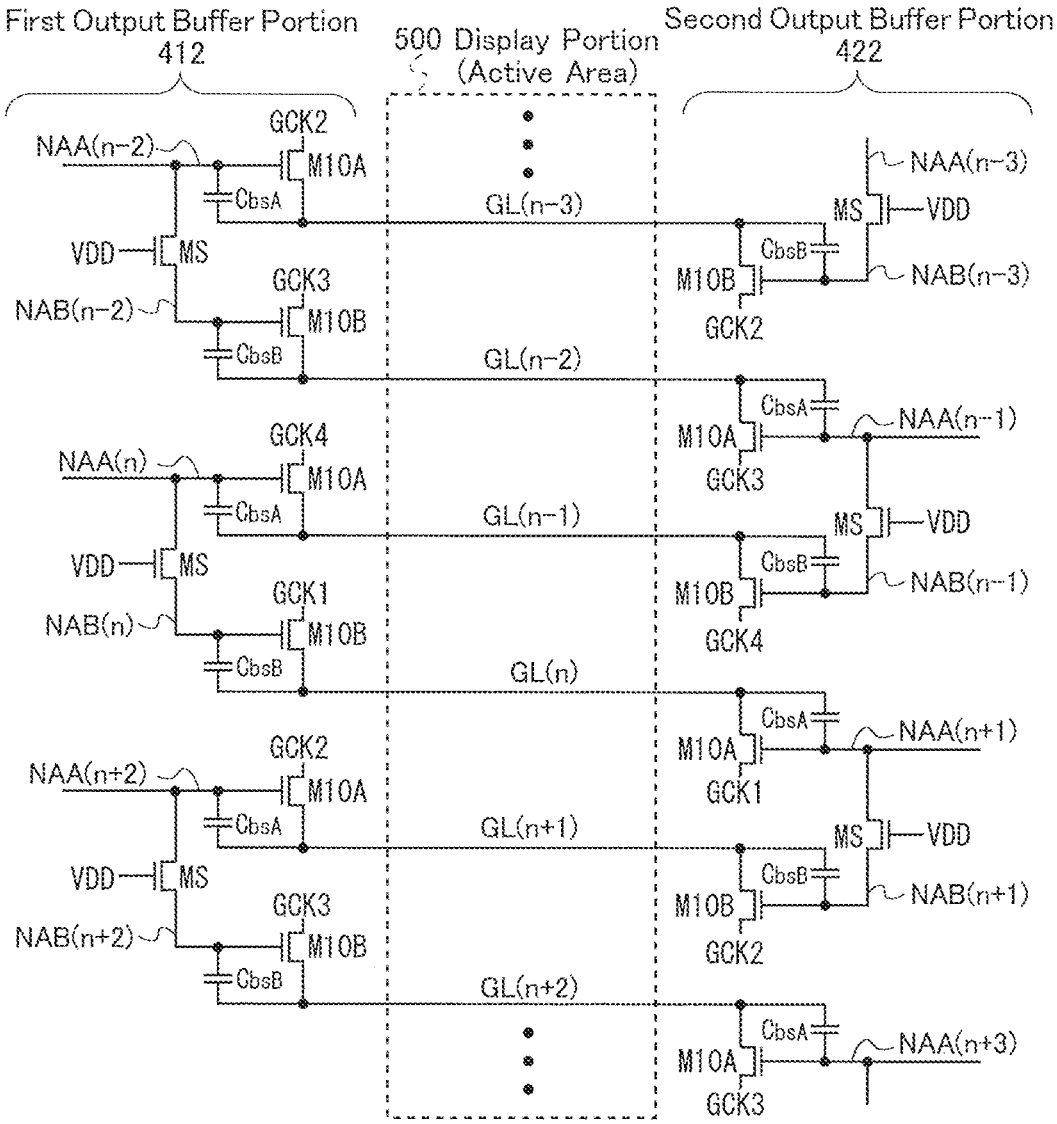
FIG. 10 is a circuit diagram for describing an operation of the gate driver in the first embodiment.
Figure 11:
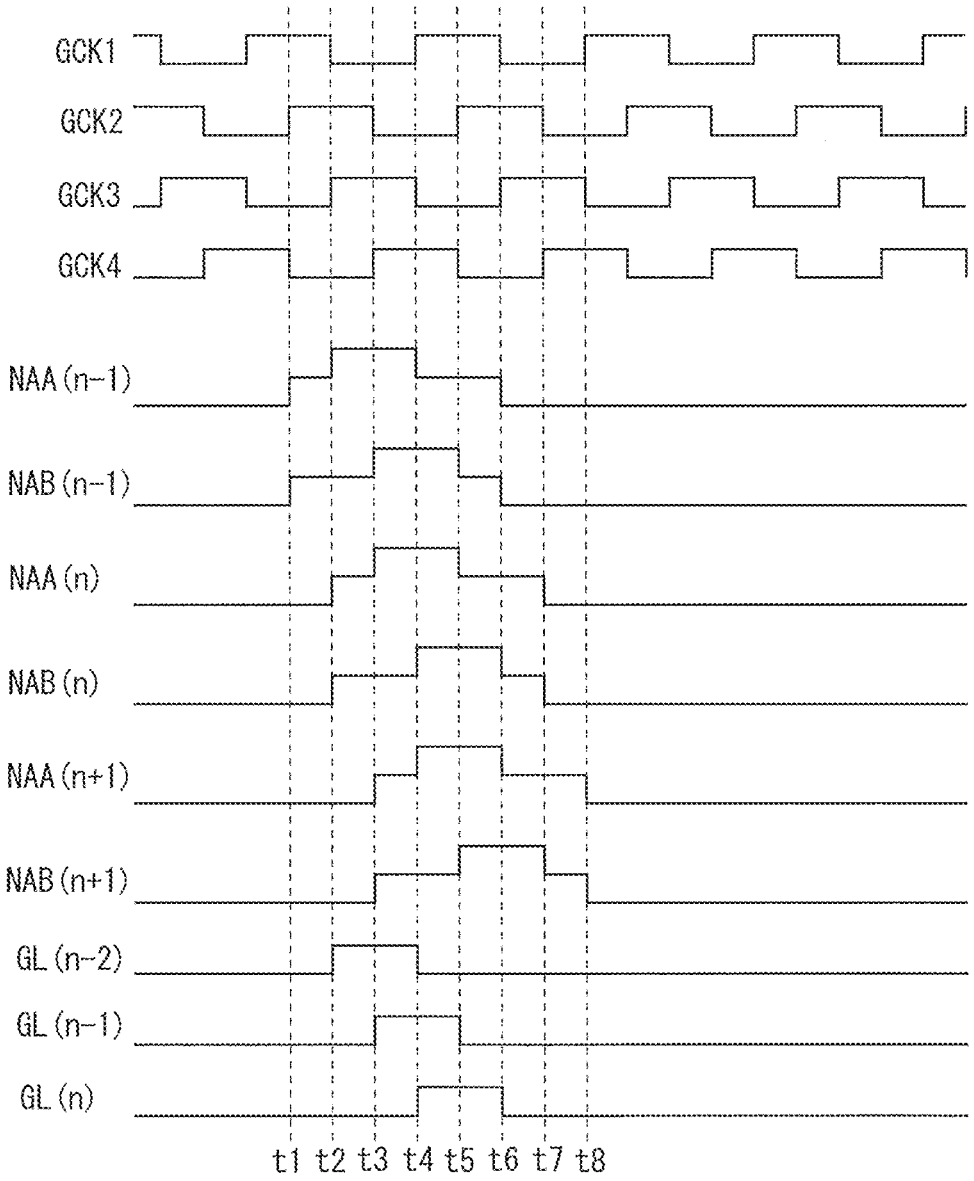
FIG. 11 is a signal waveform chart for describing the operation of the gate driver in the first embodiment.

FIG. 10 is a circuit diagram for describing the operation of the gate driver in the present embodiment and illustrates gate bus lines GL(i) (where i=1, . . . , n−3, n−2, n−1, n, n+1, n+2, . . . ) of the display portion 500 and buffer circuits Buff(i) of the first and second output buffer portions 412 and 422 in the first and second gate drivers 410 and 420 connected to their respective ends of the gate bus lines GL(i). FIG. 11 is a signal waveform chart for describing the operation of the gate driver in the present embodiment. The operation of the gate driver in the present embodiment will be described below with reference to FIGS. 10 and 11, along with FIG. 9 illustrating the configuration of the unit circuit of the gate driver in the present embodiment.

In each unit circuit of the gate driver, an initialization signal, which is a signal that is set at H level for a predetermined time period, is provided to the CLEAR terminal CLR of the bistable circuit SR(i) at startup of the display device. As a result, voltages at the first, second, and third state nodes NAA(i), NAB(i), and NB(i) (where i=1 to N) in the unit circuit are set to low level (L level). Consider now the operation of the first gate driver 410 where the (n−2)'th gate bus line GL(n−2) connected to the SET terminal S of the n'th bistable circuit SR(n) experiences a voltage change from L level to H level at time t2 after the initialization, as shown in FIG. 11. In this case, the transistor M1 in the n'th bistable circuit SR(n) is changed to ON state, with the result that the first state node NAA(n) is precharged to H level (this H level is a voltage level lower than the high-level power supply voltage VDD by a threshold voltage Vth(M1) of the transistor M1, and will be referred to as a "precharge voltage level"). The high-level power supply voltage VDD is being provided to the gate terminal of the transistor MS, and therefore, by rendering the transistor M1 in ON state, the second state node NAB(n) is precharged to H level as well. As will be described later, the threshold voltage Vth(MS) of the transistor MS is higher than the threshold voltage Vth(M1) of the transistor M1, and therefore, this H level is a voltage level lower than the high-level power supply voltage VDD by the threshold voltage Vth (MS) of the transistor MS, and will be referred to as the "precharge voltage level" as well.

The fourth gate clock signal GCK4 is changed from L level to H level at time t3 (see FIG. 11). As a result, the first output buffer portion 412 starts charging the (n−1)'th gate bus line GL(n−1) via the buffer transistor M10A. In this case, due to a change in voltage on the gate bus line GL(n−1), the boost capacitor $C_{bsA}$ pushes up the voltage at the first state node NAA(n), so that a voltage sufficiently higher than a normal H level is applied to the gate terminal of the buffer transistor M10A. As a result, the transistor M10A is rendered in complete ON state, and the (n−1)'th gate bus line GL(n−1) is charged to a complete H level from a first end (in FIG. 10, from the left). Moreover, in this case, in the (n−1)'th buffer circuit Buff(n−1) in the second output buffer portion 422, the (n−1)'th bistable circuit SR(n−1) precharges the second state node NAB(n−1) to H level, so that the transistor M10B is rendered in ON state, and thereafter, the boost capacitor $C_{bsB}$ pushes up the voltage at the second state node NAB(n−1). As a result, the transistor M10B is rendered in complete ON state, and the (n−1)'th gate bus line GL(n−1) is charged to a complete H level also from a second end (in FIG. 10, from the right). Note that the second state node NAB(n−1) is connected to the first state node NAA(n−1) via the boost isolation transistor MS, and the threshold voltage Vth(MS) of the transistor MS is higher than the threshold voltage Vth(M1) of the transistor M1, as will be described later. Accordingly, at the time immediately before the boost operation by the capacitor $C_{bsB}$ (i.e., immediately before the rise of the fourth gate clock signal GCK4), the voltage at the second state node NAB(n−1) does not become higher than the value (VDD−Vth(MS)), which is lower than the high-level power supply voltage VDD by the threshold voltage Vth(MS) of the transistor MS.

The first gate clock signal GCK1 is changed from L level to H level at time t4 (see FIG. 11). As has already been described, at time t2 preceding this change, the n'th bistable circuit SR(n) in the first gate driver 410 precharges the second state node NAB(n) to H level, so that the buffer transistor M10B is rendered in ON state, but the first gate clock signal GCK1 is set at L level during the period from time t2 to time t4. Once the first gate clock signal GCK1 is changed to H level at time t4, the buffer transistor M10B starts charging the n'th gate bus line GL(n). In this case, due to a change in voltage on the gate bus line GL(n), the boost capacitor $C_{bsB}$ pushes up the voltage at the second state node NAB(n), so that a voltage sufficiently higher than a normal H level is applied to the gate terminal of the buffer transistor M10B. As a result, the transistor M10B is rendered in complete ON state, and the n'th gate bus line GL(n) is charged to a complete H level from a first end (in FIG. 10, from the left). Moreover, in this case, in the n'th buffer circuit Buff(n) in the second output buffer portion 422, the (n+1)'th bistable circuit SR(n+1) precharges the first state node NAA(n+1) to H level, so that the transistor M10A is rendered in ON state, and thereafter, the boost capacitor $C_{bsA}$ pushes up the voltage at the first state node NAA(n+1). As a result, the transistor M10A is rendered in complete ON state, and the n'th gate bus line GL(n) is charged to the complete H level also from a second end (in FIG. 10, from the right). Note that the second state node NAB(n) is connected to the first state node NAA(n) via the boost isolation transistor MS. The boost isolation transistor MS is in OFF state during any boost operations of the first and second state nodes NAA(n) and NAB(n). Accordingly, the boost operation of the first state node NAA(n) does not affect the voltage at the second state node NAB(n), and the boost operation of the second state node NAB(n) does not affect the voltage at the first state node NAA(n) either.

The fourth gate clock signal GCK4 is changed from H level to L level at time t5 (see FIG. 11). As a result, the (n−1)'th gate bus line GL(n−1) is discharged from the first end (in FIG. 10, from the left) through the buffer transistor M10A of the buffer circuit Buff(n−1) in the first output buffer portion 412, and also from the second end (in FIG. 10, from the right) through the buffer transistor M10B of the buffer circuit Buff(n−1) in the second output buffer portion 422. As a result, the voltage on the (n−1)'th gate bus line GL(n−1) is quickly changed to L level. In this manner, the (n−1)'th gate bus line GL(n−1) selected at time t3 is deselected at time t5 (see FIG. 11).

The first gate clock signal GCK1 is changed from H level to L level at time t6 (see FIG. 11). Accordingly, the n'th gate bus line GL(n) is discharged from the first end (in FIG. 10, from the left) through the buffer transistor M10B of the buffer circuit Buff(n) in the first output buffer portion 412, and also from the second end (in FIG. 10, from the right) through the buffer transistor M10A of the buffer circuit Buff(n) in the second output buffer portion 422. As a result, the voltage on the n'th gate bus line GL(n) is quickly changed to L level. In this manner, the n'th gate bus line GL(n) selected at time t4 is deselected at time t6 (see FIG. 11).

The (n+1)'th gate bus line GL(n+1) is selected at time t5 and deselected at time t7 by being similarly charged or discharged by two buffer circuits Buff(n+1) connected to the respective ends of the line. The (n+2)'th gate bus line GL(n+2) is selected at time t6 and deselected at time t8 by being similarly charged or discharged by two buffer circuits Buff(n+2) connected to the respective ends of the line. Moreover, the (n+3)'th gate bus line GL(n+3) is changed from L level to H level at time t7 by being charged by two buffer circuits Buff(n+3) connected to the respective ends of the line.

Once the voltage on the (n+3)'th gate bus line GL(n+3) is changed from L level to H level at time t7, the H-level voltage is provided to the RESET terminal R of the n'th bistable circuit (n) in FIG. 9, so that the transistor M9 is rendered in ON state, with the result that the first state node NAA(n) is discharged, and the voltage at the first state node NAA(n) is changed to L level. In this case, the second state node NAB(n) is also discharged through the transistor MS, and the voltage at the second state node NAB(n) is changed to L level as well. Consequently, the n'th bistable circuit SR(n) is rendered in RESET state. On the other hand, since the third state node NB(n) is connected to the high-level power line VDD via the diode-connected transistor M5, when the transistor M9 is changed to ON state at time t7, whereby the transistor M6 is rendered in OFF state, with the result that the voltage at the third state node NB(n) is changed to H level. Accordingly, the transistor M8 is rendered in ON state, and the first state node NAA(n) is provided with a voltage on the low-level power line VSS (referred to below as a "low-level power voltage" and denoted by the same symbol "VSS" as the low-level power line). As a result of this, the first state node NAA(n) is kept at L level and the transistor M6 is turned off, whereby the third state node NB(n) is kept at H level.

In this manner, until the transistor M1 is rendered in ON state by the voltage on the (n−2)'th gate bus line GL(n−2) being changed to H level during the next frame period, the first state node NAA(n) and the third state node NB(n) are reliably kept at L level and H level, respectively. Specifically, until the next time the voltage on the gate bus line GL(n+2) connected to the SET terminal S is set to H level, the bistable circuit SR(n) is stably maintained in RESET state. Note that while the third state node NB(n) is at H level, the transistor M14 is in ON state, and therefore, the gate bus line GL(n) is stably maintained at L level (see FIG. 9).

In the gate driver thus configured, the first gate driver 410 is provided with a first scanning control signal GCT1, and a start pulse included in the first scanning control signal GCT1 is sequentially transferred through the bistable circuits cascaded together in the first shift register 411, whereas the second gate driver 420 is provided with a second scanning control signal GCT2, and a start pulse included in the second scanning control signal GCT2 is sequentially transferred through the bistable circuits cascaded together in the second shift register 421 (see FIGS. 1, 6, and 9). Specifically, the cascaded bistable circuits in the first shift register 411 sequentially output active signals (H-level signals, including H-level signals after a boost operation), and the cascaded bistable circuits in the second shift register 421 sequentially output active signals as well. Correspondingly, the buffer circuits in the first output buffer portion 412 apply H-level or L-level voltages to the first ends of the gate bus lines GL(1) to GL(N) of the display portion 500 as scanning signals G(1) to G(N), and the buffer circuits in the second output buffer portion 422 apply H-level or L-level voltages to the second ends of the gate bus lines GL(1) to GL(N) as scanning signals G(1) to G(N) (see FIGS. 9 to 11). As a result, the gate bus lines GL(1) to GL(N) of the display portion 500 are sequentially selected (i.e., sequentially set at H level) for each predetermined time period (see FIG. 11).

1.5 Effects

In the present embodiment as described above, the first output buffer portion 412 of the first gate driver 410 and the second output buffer portion 422 of the second gate driver 420 apply H-level or L-level voltages to the respective ends of each gate bus line GL(i) (where i=1 to N) of the display portion 500 as scanning signals G(i) (see FIGS. 6 and 10). Accordingly, the gate bus line GL(i) can be charged or discharged at high speed, with the result that even the large display portion 500 can display a satisfactory image by virtue of high-speed drive. On the other hand, in the present embodiment, one bistable circuit SR(i) in each of the first and second shift registers 411 and 421 controls two buffer circuits Buff(i−1) and Buff(i) (where i=1 to N), and therefore, it is possible to reduce the area that is required to realize a shift register, thereby achieving a narrow picture-frame area for the liquid crystal panel 600 serving as a display panel.

Furthermore, in the present embodiment, the gate driver, including the first and second gate drivers 410 and 420 respectively disposed near the first and second ends of the gate bus lines GL(1) to GL(N), employs an interlaced arrangement. Specifically, in the single-ended input scheme (FIG. 3) in which only one gate driver is disposed near the first end of the gate bus lines GL(1) to GL(N), the first gate driver 410 uses the first shift register 411 configured by a set of cascaded bistable circuits ( . . . , SR(n−2), SR(n), SR(n+2), . . . ) grouped by selecting every other bistable circuit from among the N bistable circuits SR(1) to SR(N) included in the shift register of the gate driver, and the second gate driver 420 uses the second shift register 421 configured by a set of cascaded bistable circuits SR(n−1), SR(n+1), SR(n+3), . . . ) which are from among the N bistable circuits SR(1) to SR(N) but are not included in the first shift register 411. This compensates for the difference in charge/discharge capability between the two buffer circuits Buff(i−1) and Buff(i) controlled by one bistable circuit SR(i), making it possible to provide satisfactory display free of artifacts such as stripe patterns. This will be described in detail below.

As has already been described, in the gate driver of the present embodiment, each unit circuit includes one bistable circuit SR(i) and two buffer circuits Buff(i−1) and Buff(i) controlled by the bistable circuit SR(i) (where i=1 to N). As can be appreciated from FIG. 9, the buffer transistor M10A of the buffer circuit Buff(i−1), which is connected to the (i−1)'th gate bus line GL(i−1), is controlled by the voltage at the first state node NAA(i), and the buffer transistor M10B of the buffer circuit Buff(i), which is connected to the i'th gate bus line GL(i), is controlled by the voltage at the second state node NAB(i) (hereinafter, the buffer circuit that includes the buffer transistor M10A controlled by the voltage at the first state node NAA(i) will be referred to as the "type-A buffer circuit", and the buffer circuit that includes the buffer transistor M10B controlled by the voltage at the second state node NAB(i) will be referred to as the "type-B buffer circuit"). Hereinafter, the difference in charge/discharge capability between the type-A and type-B buffer circuits will be described, focusing on the n'th unit circuit shown in FIG. 9, including the n'th bistable circuit (n) and the two buffer circuits Buff(n−1) and Buff(n) connected thereto.

Figure 12:
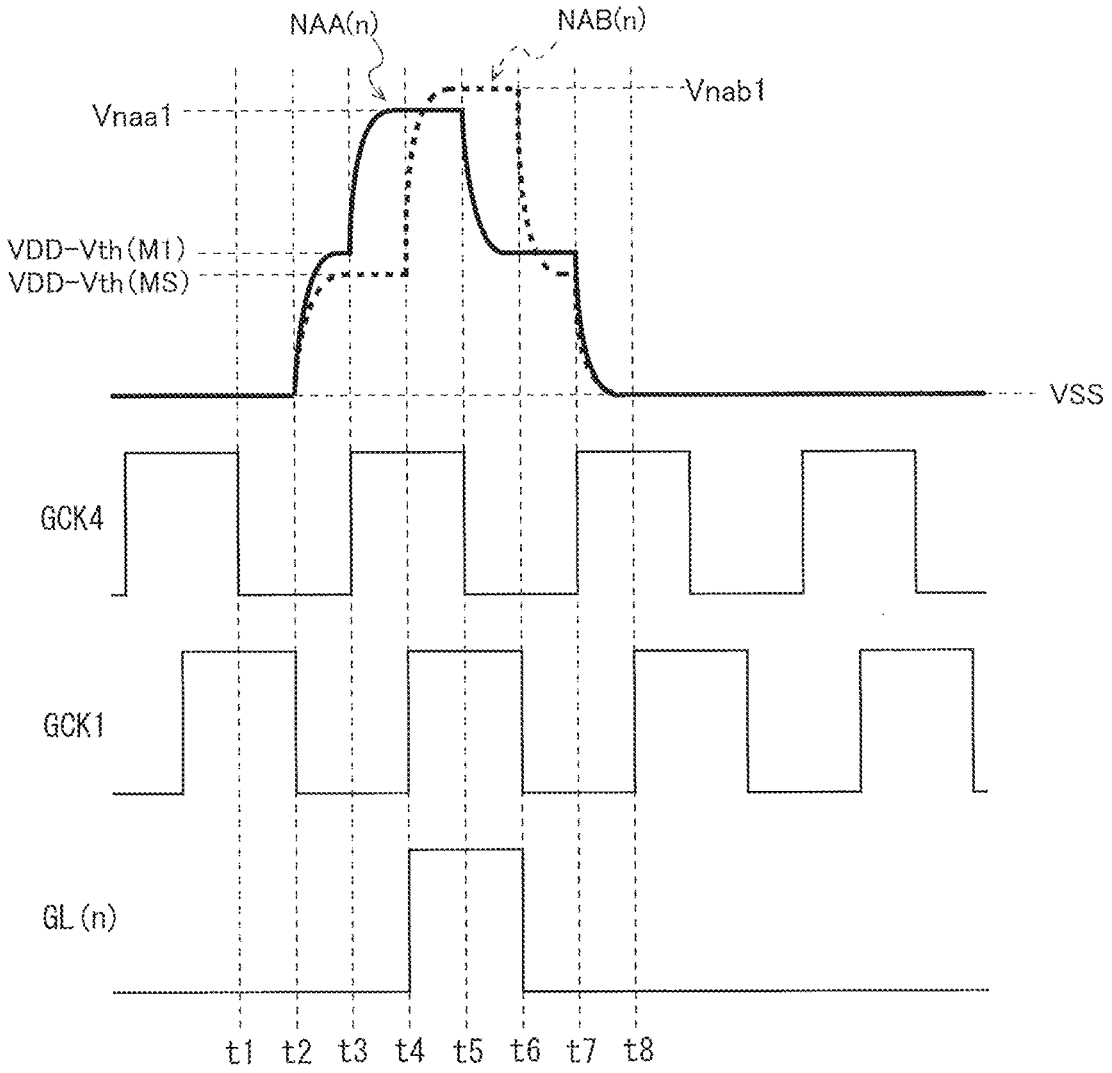
FIG. 12 is a detailed signal waveform chart for describing actions and effects of the first embodiment.

FIG. 12 is a detailed signal waveform chart for describing actions and effects of the present embodiment based on the interlaced arrangement and illustrates voltage waveforms for the first and second state nodes NAA(n) and NAB(n) in the n'th unit circuit, along with voltage waveforms for the gate clock signals GCK1 and GCK4 and the gate bus line GL(n). In FIG. 12, the voltage waveform for the first state node NAA(n) is represented by a bold solid line, and the voltage waveform for the second state node NAB(n) is represented by a bold dotted line.

As has already been described, once the voltage on the gate bus line GL(n−2) connected to the SET terminal S of the bistable circuit SR(n) in the n'th unit circuit is changed to H level at time t2, the transistor M1 is rendered in ON state, and the first state node NAA(n) is precharged to H level. Assuming that the transistor M1 has a threshold voltage expressed by Vth(M1), the voltage $V_{naa}$ at the first state node NAA(n) is as follows:

$$V_{naa}=VDD-Vth(M1)$$

The second state node NAB(n) is connected to the first state node NAA(n) via the transistor MS whose threshold voltage is Vth(MS), and therefore, the voltage $V_{nab}$ at the second state node NAB(n) is as follows:

$$V_{nab}=VDD-Vth(MS)$$

Here, the transistor MS is susceptible to deterioration because the high-level power supply voltage VDD, which brings the transistor MS into ON state, is constantly applied to the gate terminal of the transistor MS, and therefore, the threshold voltage Vth(MS), which is positive, is deemed to be greater than the threshold voltage Vth(M1) of the transistor M1. Accordingly, the precharge voltage $V_{nab}$=VDD−Vth(MS) for the second state node NAB(n) is lower than the precharge voltage $V_{naa}$=VDD−Vth(M1) for the first state node NAA(n), as shown in FIG. 12.

The fourth gate clock signal GCK4 being provided to the drain terminal of the buffer transistor M10A in the (n−1)'th buffer circuit Buff(n−1), which is a type-A buffer circuit, is changed to H level at time t3, and correspondingly, the boost capacitor $C_{bsA}$ performs a boost operation, with the result that the voltage $V_{naa}$ at the first state node NAA(n) is raised (due to a boost effect by the capacitor $C_{bsA}$). Specifically, when the fourth gate clock signal GCK4 is changed to H level, the buffer transistor M10A starts charging the (n−1)'th gate bus line GL(n−1), and due to a corresponding change in voltage on the gate bus line GL(n−1), the boost capacitor $C_{bsA}$ raises the voltage $V_{naa}$ at the first state node NAA(n). Consequently, the transistor M10A is rendered in complete ON state, so that the (n−1)'th gate bus line GL(n−1) is charged to a complete H level from the first end (see FIGS. 9 and 12). Moreover, the first gate clock signal GCK1 being provided to the drain terminal of the buffer transistor M10B in the n'th buffer circuit Buff(n), which is a type-B buffer circuit, is changed to H level at time t4, and correspondingly, the boost capacitor $C_{bsB}$ performs a boost operation, with the result the voltage $V_{nab}$ at the second state node NAB(n) is raised (due to a boost effect by the capacitor $C_{bsB}$). Specifically, when the first gate clock signal GCK1 is changed to H level, the buffer transistor M10B starts charging the n'th gate bus line GL(n), and due to a corresponding change in voltage on the gate bus line GL(n), the boost capacitor $C_{bsB}$ raises the voltage $V_{nab}$ at the second state node NAB(n). Consequently, the transistor M10B is rendered in complete ON state, so that the n'th gate bus line GL(n) is charged to a complete H level from the first end (see FIGS. 9 and 12). As can be appreciated from FIG. 9, the number of transistors connected to the second state node NAB(n) is considerably lower than the number of transistors connected to the first state node NAA(n), and therefore, the total capacitance attached to the second state node NAB(n) is considerably lower than the total capacitance attached to the first state node NAA(n). Accordingly, the boost effect of the capacitor $C_{bsB}$ on the voltage $V_{nab}$ at the second state node NAB(n) is considerably greater than the boost effect of the capacitor $C_{bsA}$, on the voltage $V_{naa}$ at the first state node NAA(n). Therefore, the voltage $V_{nab1}$ at the second state node NAB (n) after the boost operation caused by the first gate clock signal GCK1 being changed to H level at time t4 is higher than the voltage $V_{naa1}$ at the first state node NAA(n) after the boost operation caused by the fourth gate clock signal GCK4 being changed to H level at time t3, as shown in FIG. 12.

The fourth gate clock signal GCK4 is changed to L level at time t5, and correspondingly, the capacitor $C_{bsA}$ lowers the voltage $V_{naa}$ at the first state node NAA(n) to the value VDD−Vth(M1). Moreover, the first gate clock signal GCK1 is changed to L level at time t6, and correspondingly, the capacitor $C_{bsB}$ lowers the voltage $V_{nab}$ at the second state node NAB(n) to the value VDD−Vth(MS).

Thereafter, the voltage on the gate bus line GL(n+3) connected to the RESET terminal R of the bistable circuit SR(n) in the n'th unit circuit is changed to H level at time t7, whereby the transistor M9 is brought into ON state. As a result, the voltage at the first state node NAA(n) is set to L level, i.e., the low-level power voltage $V_{ss}$. At this time, the transistor MS is rendered in ON state, whereby the voltage at the second state node NAB(n) is also set to the low-level power voltage $V_{ss}$.

As described above, during the period (from t2 to t7) that includes the period (from t3 to t5) during which to select the (n−1)'th gate bus line GL(n−1) and the period (from t4 to t6) during which to select the n'th gate bus line GL(n), the first and second state nodes NAA(n) and NAB(n) have voltage waveforms as shown in FIG. 12, which are different from each other. In this manner, the voltage at the first state node NAA(n), which is provided to the gate terminal of the buffer transistor M10A in the type-A buffer circuit, and the voltage at the second state node NAB(n), which is provided to the gate terminal of the buffer transistor M10B in the type-B buffer circuit, have different waveforms, and therefore, the type-A buffer circuit (Buff(n−1)) and the type-B buffer circuit (Buff(n)) differ in their charge/discharge capability for the gate bus line. Accordingly, if each gate bus line GL(n) is driven from both ends either by the type-A or type-B buffer circuits, there might be differences in display luminance between the pixel circuits that are connected to gate bus lines driven by the type-A buffer circuits and the pixel circuits that are connected to gate bus lines driven by the type-B buffer circuits, and such differences might cause visible stripe patterns.

However, since the present embodiment employs an interlaced arrangement, the transistor M10A of the type-A buffer circuit applies an H- or L-level voltage to one of the two ends of each gate bus line GL(i) as a scanning signal G(i), and the transistor M10B of the type-B buffer circuit applies an H- or L-level voltage to the other end as a scanning signal G(i), as shown in FIG. 10. Accordingly, the charge/discharge capability of the gate driver of the display portion 500 is equalized for the gate bus lines GL(1) to GL(N), and therefore the display portion 500 can provide satisfactory display free of artifacts such as stripe patterns.

As described above, in the present embodiment, scanning signals G(i) are applied to each gate bus line GL(i) from both ends so that the large-sized display portion 500 can be driven at high speed (see FIG. 1), each bistable circuit SR(i) in the shift register controls two buffer circuits Buff(i−1) and Buff(i) so that the picture-frame area of the display panel (the liquid crystal panel 600) can be narrowed (see FIG. 6), and further, the interlaced arrangement using the boost isolation transistors MS is employed so that the charge/discharge capability is equalized for the gate bus lines GL(1) to GL(N), whereby the display portion 500 can provide satisfactory display free of artifacts such as stripe patterns (see FIG. 10).

2. Second Embodiment

Next, a display device according to a second embodiment will be described. The display device according to the present embodiment is also an active-matrix liquid crystal display device, and has the same configuration as in the first embodiment, except for the buffer circuits in the gate driver serving as a scanning signal line drive circuit (see FIGS. 1, 2, 6, and 11). In the following, the present embodiment will be described, mainly focusing on the configuration of the buffer circuit in the gate driver, and the other elements, either the same or corresponding elements, are denoted by the same reference characters and will not be elaborated upon.

2.1 Configuration of the Gate Driver

Figure 13:
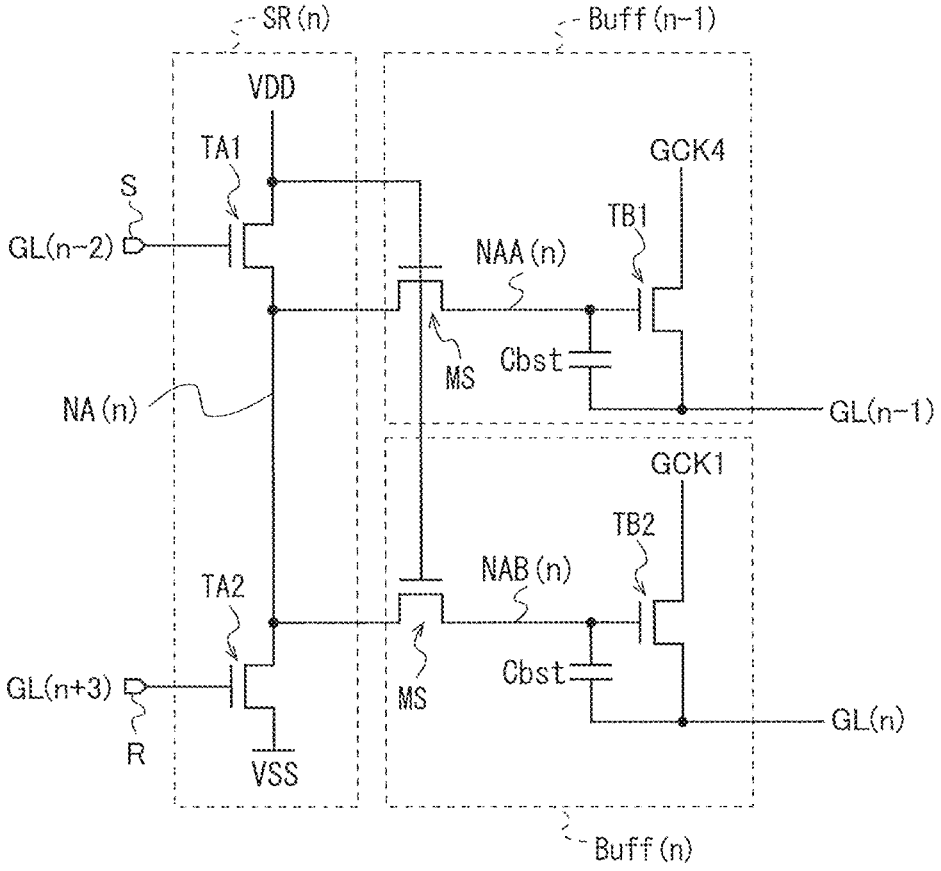
FIG. 13 is a circuit diagram illustrating a basic configuration of a unit circuit of a gate driver in a display device according to a second embodiment.

FIG. 13 is a circuit diagram illustrating the basic configuration of the n'th unit circuit of the gate driver in the present embodiment. The other unit circuits also have the same configuration thereas, except for input and output signals. The basic configuration of the unit circuit in the present embodiment will be described below, taking as an example the n'th unit circuit shown in FIG. 13.

The n'th unit circuit of the gate driver in the present embodiment includes a bistable circuit SR(n) and (n−1)'th and n'th buffer circuits Buff(n−1) and Buff(n). Since the bistable circuit SR(n) has the same configuration as in the first embodiment (see FIG. 8), the same elements are denoted by the same reference characters, and any descriptions thereof will be omitted.

The (n−1)'th buffer circuit Buff(n−1) has the same configuration as the n'th buffer circuit Buff(n) shown in FIG. 8, and includes a boost isolation transistor MS, which is an N-channel thin-film transistor, in addition to a buffer transistor TB1, which is also an N-channel thin-film transistor, and a boost capacitor $C_{bst}$. The buffer transistor TB1 has a drain terminal to which a fourth gate clock signal GCK4 corresponding to the buffer circuit Buff(n−1) is provided. The buffer transistor TB1 has a gate terminal connected to an output terminal (a connecting point of transistors TA1 and TA2) of the bistable circuit SR(n) via the transistor MS, which is connected to the output terminal at a conductive terminal that serves as an input terminal of the buffer circuit Buff(n−1). The buffer transistor TB1 has a source terminal serving as an output terminal of the buffer circuit Buff(n−1) and connected to the gate terminal of the buffer transistor TB1 via the boost capacitor $C_{bst}$ and also to the (n−1)'th gate bus line GL(n−1). In the present embodiment, a node NAA(n), which includes the gate terminal of the buffer transistor TB1, will be referred to as a "first state node", and a node NA(n), which serves as the connecting point of the transistors TA1 and TA2, i.e., the output terminal of the bistable circuit SR(n), will be referred to as a "primary state node". The primary state node NA(n) is connected to the first state node NAA(n) via the boost isolation transistor MS.

The n'th buffer circuit Buff(n) has the same configuration as that shown in FIG. 8, and corresponding components are denoted by the same reference characters. Note that the transistor MS has a conductive terminal connected to the primary state node (output terminal) of the bistable circuit SR(n) and serving as an input terminal of the buffer circuit Buff(n), and the buffer transistor TB2 has a source terminal connected to the n'th gate bus line GL(n) and serving as an output terminal of the buffer circuit Buff(n). Moreover, a node including a gate terminal of the buffer transistor TB2 is a second state node NAB(n).

Figure 14:
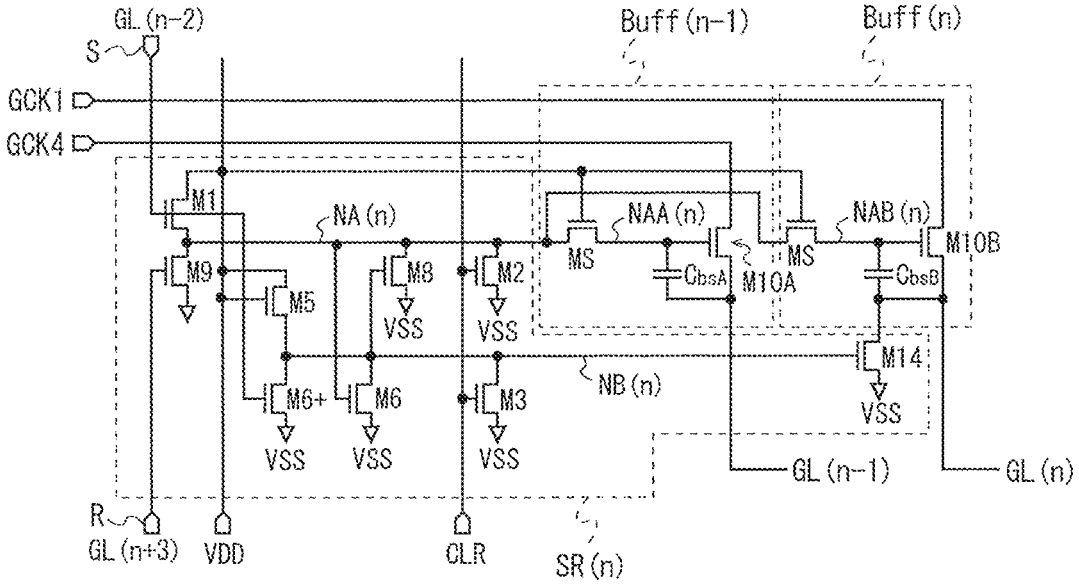
FIG. 14 is a circuit diagram for describing a detailed configuration example of the unit circuit of the gate driver in the second embodiment.

FIG. 14 is a circuit diagram for describing a detailed configuration example of the gate driver in the present embodiment and illustrates an example of the actual configuration of the n'th unit circuit in the first gate driver 410, as shown in FIG. 13. The unit circuit that corresponds to the n'th bistable circuit SR(n) in the first gate driver 410 will be described herein by way of example, and other unit circuits also have the same configuration as the n'th unit circuit.

In the configuration example shown in FIG. 14, the n'th bistable circuit SR(n) has the same configuration as that shown in FIG. 9 for the first embodiment, and includes N-channel thin-film transistors M1, M2, M3, M5, M6, M6+, M8, M9, and M14. The transistors M1 and M9 respectively correspond to the transistors TA1 and TA2 shown in FIG. 13. Moreover, the signals that are provided to the SET terminal S, the RESET terminal R, and the CLEAR terminal CLR are the same as those provided to their respectively corresponding terminals of the n'th bistable circuit SR(n) shown in FIG. 9. Note that in the bistable circuit SR(n) in FIG. 14, a node including a connecting point of the transistors M1 and M9 is a primary state node NA(n).

The (n−1)'th buffer circuit Buff(n−1) shown in FIG. 14 has the same configuration as that shown in FIG. 13, and includes two N-channel thin-film transistors M10A and MS and a boost capacitor $C_{bsA}$. The transistors M10A and MS and the capacitor $C_{bsA}$ respectively correspond to the buffer transistor TB1, the boost isolation transistor MS, and the boost capacitor $C_{bst}$ of the buffer circuit Buff(n−1) shown in FIG. 13. Note that a gate terminal of the buffer transistor M10A is included in the first state node NAA(n), which is connected to the primary state node NA(n) of the n'th bistable circuit SR(n) via the boost isolation transistor MS.

The n'th buffer circuit Buff(n) shown in FIG. 14 has the same configuration as that shown in FIG. 13, and includes two N-channel thin-film transistors M10B and MS and a boost capacitor $C_{bsB}$. The transistors M10B and MS and the capacitor $C_{bsB}$ respectively correspond to the buffer transistor TB2, the boost isolation transistor MS, and the boost capacitor $C_{bst}$ of the buffer circuit Buff(n) shown in FIG. 13. Note that a gate terminal of the buffer transistor M10B is included in a second state node NAB(n), which is connected to the primary state node NA(n) of the n'th bistable circuit SR(n) via the boost isolation transistor MS.

2.2 Operation of the Gate Driver

Figure 15:
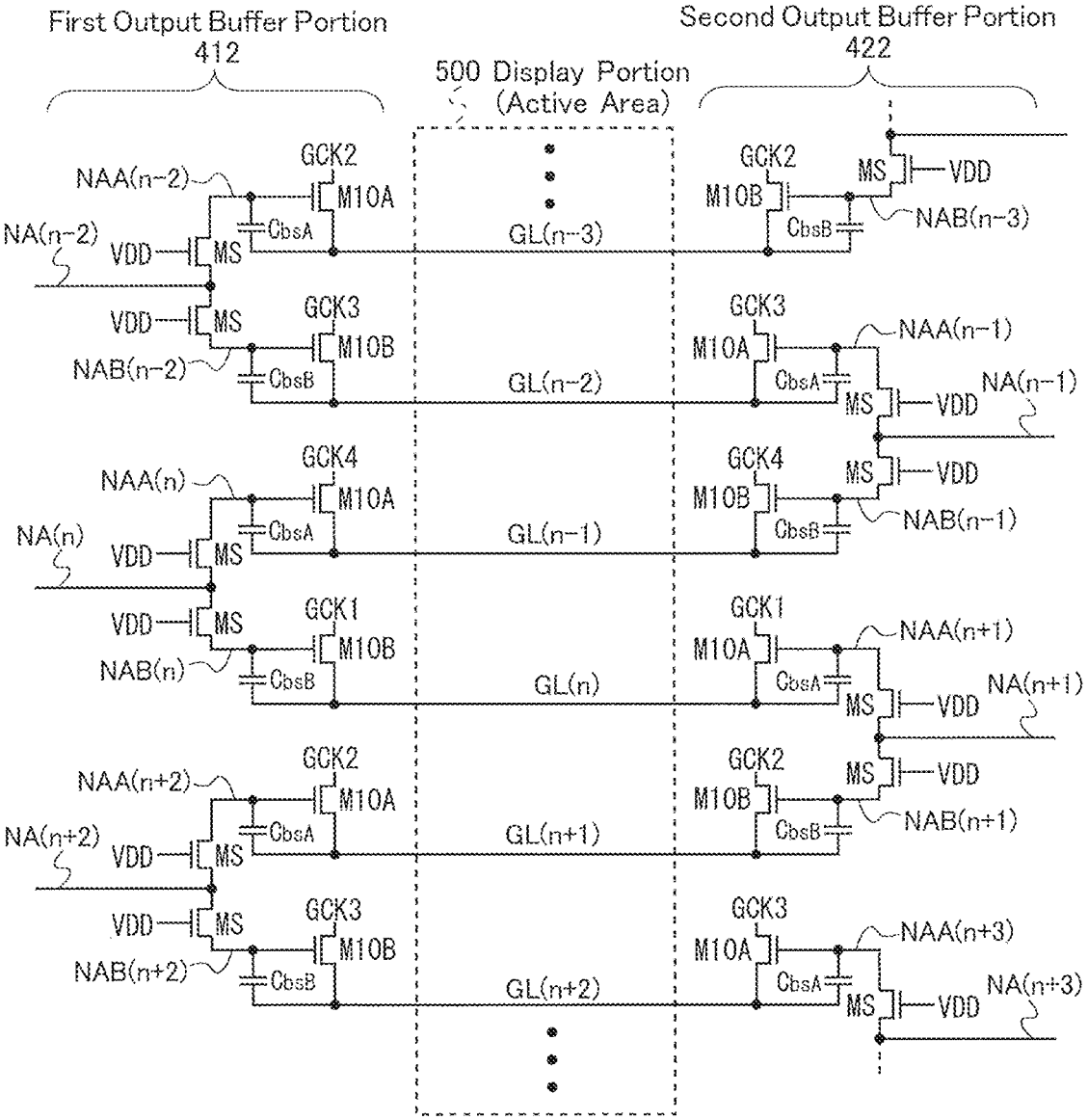
FIG. 15 is a circuit diagram for describing an operation of the gate driver in the second embodiment.

FIG. 15 is a circuit diagram for describing the operation of the gate driver in the present embodiment and illustrates gate bus lines GL(i) (where i=1, . . . , n−3, n−2, n−1, n, n+1, n+2, . . . ) of the display portion 500 and buffer circuits Buff(i) in the first and second output buffer portions 412 and 422 of the first and second gate drivers 410 and 420 connected to their respective ends of the gate bus lines. Signal waveforms demonstrating the operation of the gate driver in the present embodiment are basically the same as in the first embodiment (see FIG. 11). The operation of the gate driver in the present embodiment will be described below with reference to FIGS. 11 and 15, along with FIG. 14 illustrating the configuration of the unit circuit of the gate driver in the present embodiment.

In each unit circuit of the gate driver, an initialization signal, which is a signal that is set at H level for a predetermined time period, is provided to the CLEAR terminal CLR of the bistable circuit SR(i) at startup of the display device. As a result, in the present embodiment, the voltages at the first, second, and third state nodes NAA(i), NAB(i), and NB(i) in the unit circuit, along with the voltage at the primary state node NA(i), are set to L level (where i=1 to N). Consider now the operation of the first gate driver 410 where the (n−2)'th gate bus line GL(n−2) connected to the SET terminal S of the n'th bistable circuit SR(n) experiences a voltage change from L level to H level at time t2 after the initialization, as shown in FIG. 11. The gate driver in the present embodiment differs from that in the first embodiment only in that the buffer circuit Buff(i−1) connected to the bistable circuit SR(i) includes the boost isolation transistor MS (see FIGS. 9 and 14), and there is no difference in input signals. Accordingly, when the voltage on the gate bus line GL(n−2) is changed from L level to H level at time t2, the gate driver in the present embodiment is operated similarly to the gate driver in the first embodiment, as described with reference to FIG. 11 (in relation to the operation during the period from time t2 to time t8 shown in FIG. 11).

In this regard, in the present embodiment, each of the two buffer circuits Buff(i) and Buff(i−1) connected to the bistable circuit SR(i) includes the boost isolation transistor MS, as shown in FIGS. 13 and 14, and both the first and second state nodes NAA(i) and NAB(i) are connected to the primary state node NA(i) via the respective boost isolation transistors MS. Accordingly, the first and second state nodes NAA(i) and NAB(i) are affected by boost effect to almost the same degree. This will be described below with reference to FIG. 16.

2.3 Effects

Figure 16:
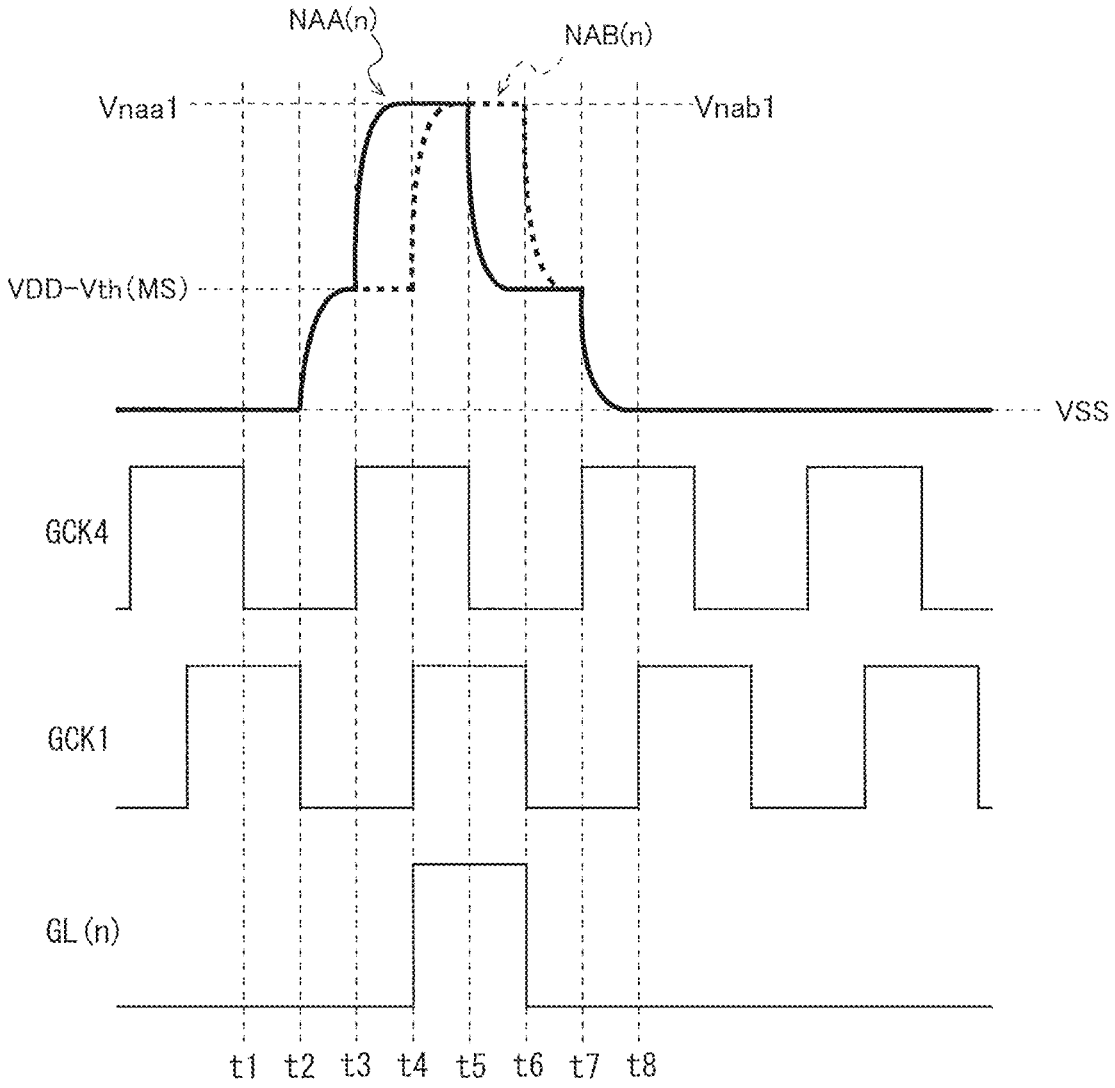
FIG. 16 is a detailed signal waveform chart for describing actions and effects of the gate driver in the second embodiment.

FIG. 16 is a detailed signal waveform chart for describing actions and effects of the present embodiment based on the interlaced arrangement and illustrates voltage waveforms for the first and second state nodes NAA(n) and NAB(n) in the n'th unit circuit, along with voltage waveforms for the gate clock signals GCK1 and GCK4 and the gate bus line GL(n). In FIG. 16, the voltage waveform for the first state node NAA(n) is represented by a bold solid line, and the voltage waveform for the second state node NAB(n) is represented by a bold dotted line.

As has already been described, once the voltage on the gate bus line GL(n−2) connected to the SET terminal S of the bistable circuit SR(n) in the n'th unit circuit is changed to H level at time t2, the transistor M1 is rendered in ON state, and the primary state node NA(n) is precharged to H level. In this case, the voltage $V_{na}$ at the primary state node NA(n) is as follows:

$$V_{na}=VDD-Vth(M1)$$

The first state node NAA(n) is connected to the primary state node NA(n) via a transistor MS whose threshold voltage is Vth(MS), and the second state node NAB(n) is also connected to the primary state node NA(n) via another transistor MS whose threshold voltage is Vth(MS) (see FIGS. 13 and 14). Accordingly, the voltage $V_{naa}$ at the first state node NAA(n) and the voltage $V_{nab}$ at the second state node NAB(n) are expressed together as follows:

$$V_{naa}=V_{nab}=VDD-Vth(MS)$$

Note that the threshold voltages of the boost isolation transistors MS in the two buffer circuits Buff(n−1) and Buff(n) are equally Vth(MS), which is higher than the threshold voltage Vth(M1) of the transistor M1.

The fourth gate clock signal GCK4 being provided to the drain terminal of the buffer transistor M10A in the (n−1)'th buffer circuit Buff(n−1), which is a type-A buffer circuit, is changed to H level at time t3, and correspondingly, the boost capacitor $C_{bsA}$ performs a boost operation, with the result that the voltage $V_{naa}$ at the first state node NAA(n) is raised (see FIGS. 14 and 16). Moreover, the first gate clock signal GCK1 being provided to the drain terminal of the buffer transistor M10B in the n'th buffer circuit Buff(n), which is a type-B buffer circuit, is changed to H level at time t4, and correspondingly, the boost capacitor $C_{bsB}$ performs a boost operation, with the result the voltage $V_{nab}$ at the second state node NAB(n) is raised (see FIGS. 14 and 16). As can be appreciated from FIG. 14, the first state node NAA(n) and the second state node NAB(n) are equal in the number of transistors connected thereto and therefore can be considered equal in the total capacitance attached thereto. Accordingly, the boost effect of the capacitor $C_{bsA}$ on the voltage $V_{naa}$ at the first state node NAA(n) is approximately equal to the boost effect of the capacitor $C_{bsB}$ on the voltage $V_{nab}$ at the second state node NAB(n). Therefore, the voltage $V_{naa}$ at the first state node NAA(n) after the boost operation caused by the fourth gate clock signal GCK4 being changed to H level at time t3 is at the same level as the voltage $V_{nab}$ at the second state node NAB(n) after the boost operation caused by the first gate clock signal GCK1 being changed to H level at time t4, as shown in FIG. 16.

Since the voltages $V_{naa}$ and $V_{nab}$ at the first and second state nodes NAA(n) and NAB(n) as above are provided to the respective gate terminals of the buffer transistors M10A and M10B, the charge/discharge for driving the gate bus lines can be stably performed. However, the first state node NAA(n) and the second state node NAB(n) differ in the time of starting the boost operation and hence in the duration of a precharge period (from t2 to t3 or from t2 to t4) preceding the boost operation. Moreover, the first state node NAA(n) and the second state node NAB(n) also differ in the time of ending the boost operation and hence in the duration of a precharge period (from t5 to t7 or from t6 to t7) following the boost operation. Therefore, the type-A buffer circuit, which includes the buffer transistor M10A controlled by the voltage $V_{naa}$ at the first state node NAA(n), and the type-B buffer circuit, which includes the buffer transistor M10B controlled by the voltage $V_{nab}$ at the second state node NAB(n), differ not a little in drive capability (i.e., charge/discharge capability) for the gate bus line.

On the other hand, since the present embodiment employs an interlaced arrangement, the transistor M10A of the type-A buffer circuit applies an H- or L-level voltage to one of two ends of each gate bus line GL(i) as a scanning signal G(i), and the transistor M10B of the type-B buffer circuit applies an H- or L-level voltage to the other end of the gate bus line GL(i) as a scanning signal G(i), as shown in FIG. 15. Accordingly, the charge/discharge capability is equalized for the gate bus lines GL(1) to GL(N) of the display portion 500, whereby the display portion 500 can provide satisfactory display free of artifacts such as stripe patterns.

Therefore, in the present embodiment, not only the type-A buffer circuit but also the type-B buffer circuit uses the boost isolation transistor MS, thereby stably driving the gate bus lines in a balanced manner and achieving effects similar to those achieved by the first embodiment.

3. Third Embodiment

Next, a display device according to a third embodiment will be described. The display device according to the present embodiment is also an active-matrix liquid crystal display device, and has the same configuration as in the first embodiment, except for the buffer circuits in the gate driver serving as a scanning signal line drive circuit (see FIGS. 1, 2, and 6 to 11). In the following, the present embodiment will be described, mainly focusing on the configuration of the buffer circuit in the gate driver, and the other elements, either the same or corresponding elements, are denoted by the same reference characters and will not be elaborated upon.

3.1 Configuration of the Gate Driver

Figure 17:
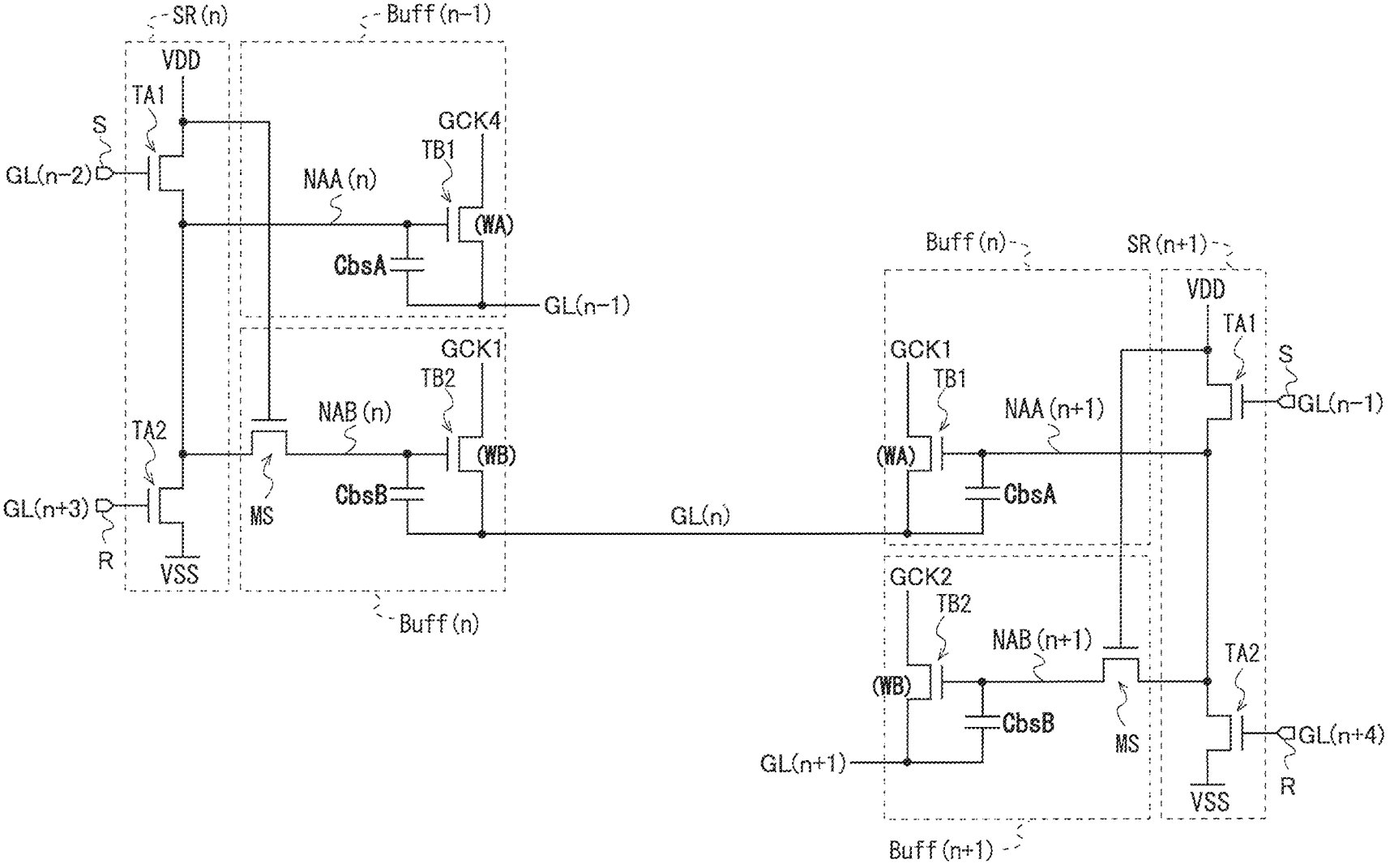
FIG. 17 is a circuit diagram for describing a basic configuration of a gate driver in a display device according to a third embodiment.

FIG. 17 is a circuit diagram for describing the basic configuration of the gate driver in the present embodiment and illustrates the configuration of the n'th and (n+1)'th unit circuits for driving the n'th gate bus line GL(n). The n'th unit circuit is included in the first gate driver 410 and includes an n'th bistable circuit SR(n) and two buffer circuits Buff(n−1) and Buff(n) connected thereto. The (n+1)'th unit circuit is included in the second gate driver 420 and includes an (n+1)'th bistable circuit SR(n+1) and two buffer circuits Buff(n) and Buff(n+1) connected thereto.

As can be appreciated from FIGS. 6 to 8 illustrating the configuration of the gate driver in the first embodiment, the configuration shown in FIG. 17, including the n'th and (n+1)'th unit circuits for driving the n'th gate bus line GL(n), is basically the same as the configuration of the corresponding portion in the first embodiment. However, the gate driver in the present embodiment is characterized by setting the size of the buffer transistors TB1 and TB2 in the buffer circuit Buff(i) and the capacitance value of the boost capacitor $C_{bst}$, and in this regard differs from the first embodiment.

Specifically, in the present embodiment and the first embodiment, the voltage $V_{naa}$ at the first state node NAA, which is provided to the gate terminal of the buffer transistor M10A (or TB1) in the type-A buffer circuit included in the buffer circuits Buff(i) (where i=1 to N) of the gate driver, differs in waveform from the voltage $V_{nab}$ at the second state node NAB, which is provided to the gate terminal of the buffer transistor M10B (or TB2) in the type-B buffer circuit, as shown in FIG. 12. This is because of the difference in degree of boost effect of the boost capacitor $C_{bst}$ and the difference in threshold voltage Vth between the transistors that provide voltages to the first and second state nodes NAA and NAB (the transistors M1 and MS shown in FIG. 9 or the transistors TA1 and MS shown in FIG. 8). Here, the degree of boost effect depends on the ratio of the capacitance value of the boost capacitor $C_{bst}$ to the total capacitance value attached to the first or second state node NAA or NAB (simply referred to below as the "capacitance ratio"). Accordingly, considering the threshold voltages and the capacitance ratios of these transistors, the size of the buffer transistor and the capacitance value of the boost capacitor are set for each of the type-A buffer circuit, which includes the buffer transistor controlled by the voltage $V_{naa}$ at the first state node NAA, and the type-B buffer circuit, which includes the buffer transistor controlled by the voltage $V_{nab}$ at the second state node NAB, such that the type-A buffer circuit and the type-B buffer circuit are equalized in drive capability. Note that in general, the drive capability of a field-effect or MOS transistor, such as a thin-film transistor, is determined by the ratio W/L, i.e., the ratio of channel width W to channel length L, but in the following, the channel length L is assumed to be constant. Accordingly, in the following, setting the transistor size is intended to mean setting the channel width W.

Setting the size of the buffer transistor and the capacitance value of the boost capacitor for each of the type-A and type-B buffer circuits as above will be described, taking as examples the buffer circuits Buff (n−1) and Buff(n), which are type-A and type-B buffer circuits in the n'th unit circuit employing the detailed configuration shown in FIG. 9.

3.2 Effects

Figure 18:
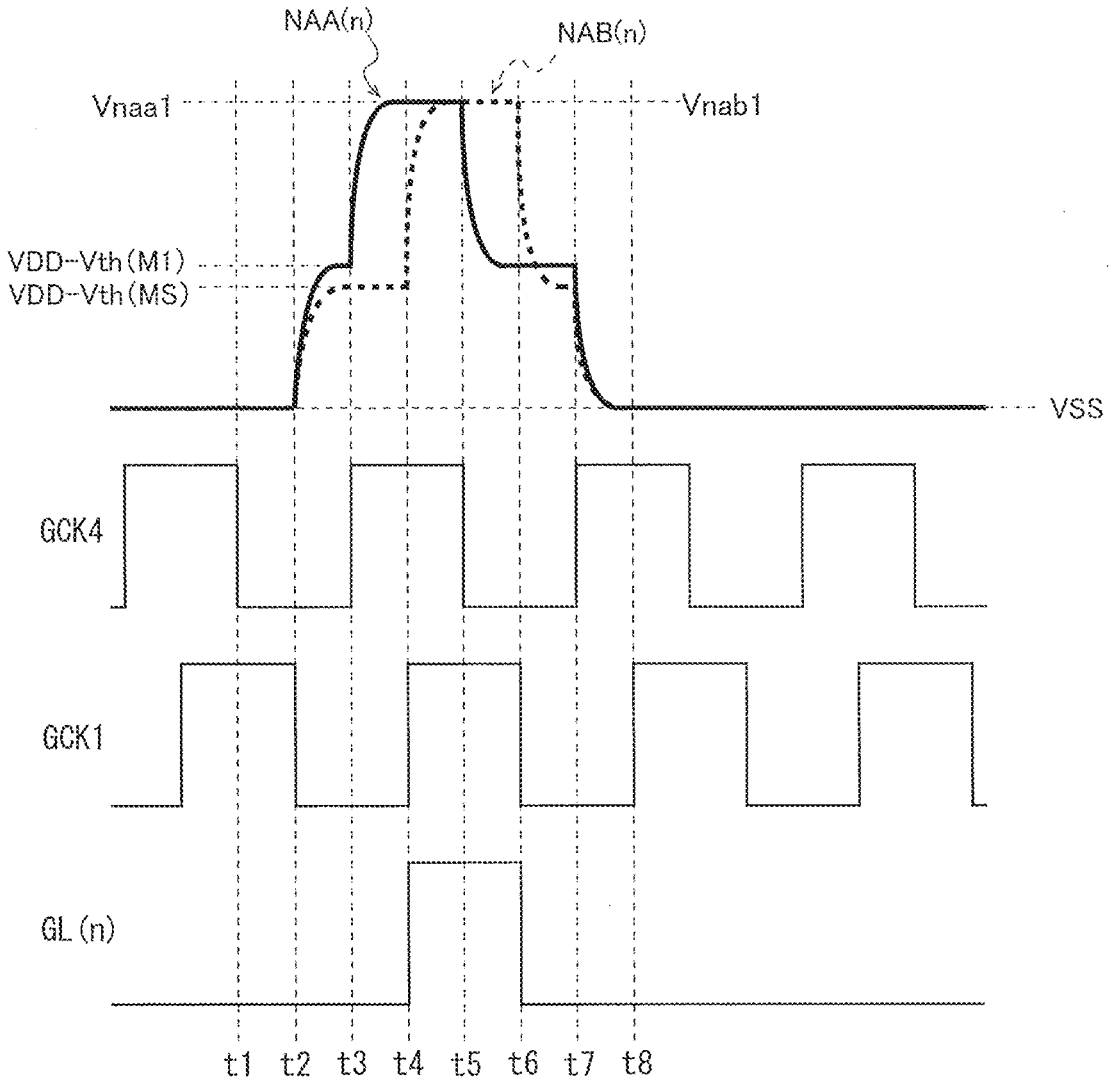
FIG. 18 is a detailed signal waveform chart for describing actions and effects of the third embodiment.

FIG. 18 is a detailed signal waveform chart for describing actions and effects of the gate driver in the present embodiment and illustrates voltage waveforms for the first and second state nodes NAA(n) and NAB(n) in the n'th unit circuit, along with voltage waveforms for the gate clock signals GCK1 and GCK4 and the gate bus line GL(n). In FIG. 18, the voltage waveform for the first state node NAA(n) is represented by a bold solid line, and the voltage waveform for the second state node NAB(n) is represented by a bold dotted line.

Once the voltage on the gate bus line GL(n−2) connected to the SET terminal S of the bistable circuit SR(n) in the n'th unit circuit is changed to H level at time t2, the transistor M1 (or TA1) is rendered in ON state, and the first state node NAA(n) is precharged to H level. In this case, as in the first embodiment (see FIG. 12), the voltage $V_{naa}$ on the first state node NAA(n) is as follows:

$$V_{naa}=VDD-Vth(M1)$$

Moreover, the voltage $V_{nab}$ at the second state node NAB(n) is as follows:

$$V_{nab}=VDD-Vth(MS)$$

Here, the transistor MS is susceptible to deterioration, and therefore, Vth(MS)>Vth(M1). Accordingly, the precharge voltage $V_{nab}$=VDD−Vth(MS) for the second state node NAB(n) is lower than the precharge voltage $V_{naa}$=VDD−Vth(M1) for the first state node NAA(n), as shown in FIG. 18.

The fourth gate clock signal GCK4 being provided to the drain terminal of the buffer transistor M10A (or TB1) in the (n−1)'th buffer circuit Buff(n−1), which serves as a type-A buffer circuit, is changed to H level at time t3, and correspondingly, the boost capacitor $C_{bsA}$ raises the voltage $V_{naa}$ at the first state node NAA(n) (see FIGS. 8 and 18).

Moreover, the first gate clock signal GCK1 being provided to the drain terminal of the buffer transistor M10B (or TB2) in the n'th buffer circuit Buff(n), which serves as a type-B buffer circuit, is changed to H level at time t4, and correspondingly, the boost capacitor $C_{bsB}$ raises the voltage $V_{nab}$ at the second state node NAB(n) (see FIGS. 8 and 18).

In the first embodiment, by such a boost operation, the voltage $V_{nab}$ at the second state node reaches $V_{nab1}$, which is higher than the value $V_{naa1}$ reached by the voltage $V_{naa}$ at the first state node after the boost operation. On the other hand, in the present embodiment, for example, to equalize these values $V_{naa1}$ and $V_{nab1}$ reached after the boost operation, the boost capacitor $C_{bsA}$ of the type-A buffer circuit Buff(n−1) and the boost capacitor $C_{bsB}$ of the type-B buffer circuit Buff(n) are set to have different values (here, it is assumed that the channel width WA of the buffer transistor M10A (or TB1) in the type-A buffer circuit is the same as the channel width WB of the buffer transistor M10B (or TB2) in the type-B buffer circuit). Accordingly, the type-A buffer circuit and the type-B buffer circuit have equal drive capability for the gate bus line. Alternatively, to allow the type-A buffer circuit and the type-B buffer circuit to have equal drive capability for the gate bus line, the channel width WA of the buffer transistor M10A (or TB1) and the channel width WB of the buffer transistor M10B (or TB2) may be set at different values. Yet alternatively, to allow the type-A buffer circuit and the type-B buffer circuit to have equal drive capability for the gate bus line, the capacitance value of the boost capacitor $C_{bsA}$ and the capacitance value of the boost capacitor $C_{bsB}$ may be set at different values, and further, the channel width WA and the channel width WB may be set at different values.

In this manner, in the present embodiment, the gate driver is configured such that the type-A buffer circuit, which includes the buffer transistor M10A (or TB1), and the type-B buffer circuit, which includes the buffer transistor M10B (or TB2), are equal in their drive capability for the gate bus line, whereby it is rendered possible to achieve effects similar to those achieved by the first embodiment and also possible to achieve the effect of driving each gate bus line GL(i) from both ends in a balanced manner by virtue of the interlaced arrangement (FIGS. 6 and 10). Thus, the amount of change in the voltage of the pixel electrode Ep due to parasitic capacitance in a transition from selection to deselection of the gate bus line GL(i) (referred to as the "field-through voltage" or the "pull-in voltage") is approximately equalized on both sides of the display portion 500, whereby the occurrence of flicker due to the pull-in voltage can be suppressed. Moreover, to allow the buffer transistor M10A (or TB1) of the type-A buffer circuit and the buffer transistor M10B (or TB2) of the type-B buffer circuit to be equal in drive capability, the channel widths WA and WB of the buffer transistors M10A (or TB1) and M10B (or TB2) or the capacitance values of the boost capacitors $C_{bsA}$ and $C_{bsB}$ are set lower than are conventionally set, and as a result of this, a narrower picture-frame area can be achieved.

4. Fourth Embodiment

In the gate drivers of the above embodiments, two buffer circuits Buff(i−1) and Buff(i) are controlled by one bistable circuit SR(i) (see FIG. 6), but three or more buffer circuits may be controlled by one bistable circuit. In a fourth embodiment to be described below, a display device includes a gate driver which is configured such that four buffer circuits are controlled by one bistable circuit.

The display device according to the present embodiment is also an active-matrix liquid crystal display device, and has the same configuration as in the first embodiment, except for the gate driver serving as a scanning signal line drive circuit (see FIGS. 1 and 2). In the following, the present embodiment will be described, mainly focusing on the configuration of the gate driver, and the other elements, either the same or corresponding elements, are denoted by the same reference characters and will not be elaborated upon.

4.1 Configuration of the Gate Driver

Figure 19:
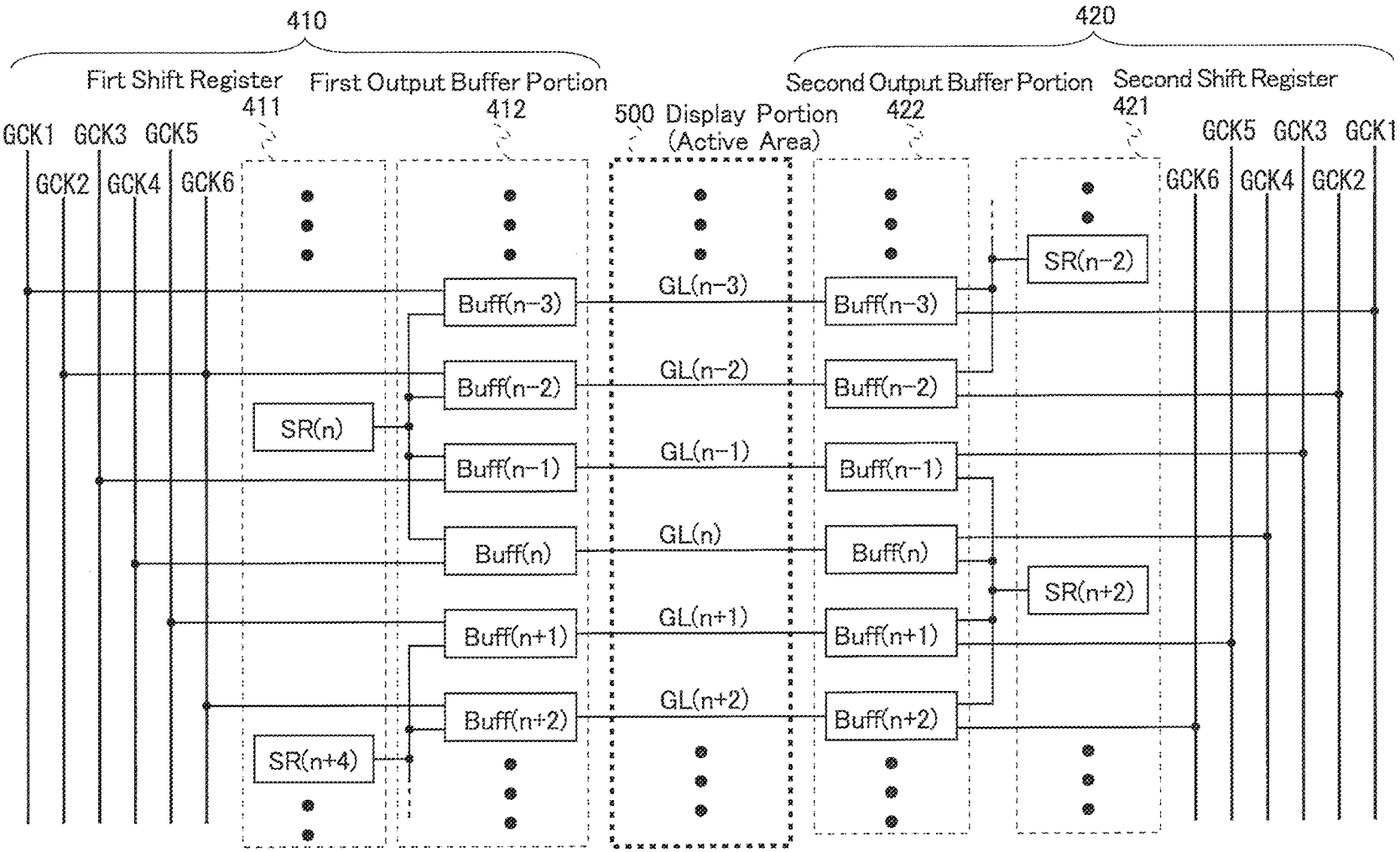
FIG. 19 is a schematic circuit diagram illustrating an overall configuration of a gate driver in a display device according to a fourth embodiment.

FIG. 19 is a schematic circuit diagram illustrating the overall configuration of the gate driver of the display device according to the present embodiment. This gate driver also includes first and second gate drivers 410 and 420 disposed respectively to first-end and second-end sides of gate bus lines GL(1) to GL(N). However, unlike in the first embodiment, the gate driver is operated in accordance with a six-phase clock signal consisting of first to sixth gate clock signals GCK1 to GCK6, and the gate driver is configured such that each bistable circuit controls four buffer circuits. In the present embodiment, the first gate driver 410 includes a first shift register 411 and a first output buffer portion 412, and the first shift register 411 is configured by a set of cascaded bistable circuits ( . . . , SR(n−4), SR(n), SR(n+4), . . . ) grouped by selecting every fourth bistable circuit from among N bistable circuits SR(1) to SR(N), as included in the shift register 401 of the single-ended-input gate driver 400 shown in FIG. 3.

In the present embodiment, the second gate driver 420 includes a second shift register 421 and a second output buffer portion 422, and the second shift register 421 is configured by a different set of cascaded bistable circuits ( . . . , SR(n−6), SR(n−2), SR(n+2), . . . ) grouped by selecting every fourth bistable circuit from among the N bistable circuits SR(1) to SR(N), as included in the shift register 401 of the single-ended-input gate driver 400 shown in FIG. 3. Each bistable circuit SR(j) in the first and second shift registers 411 and 421 corresponds to four buffer circuits Buff(j−3), Buff(j−2), Buff(j−1), and Buff(j) and controls the four buffer circuits Buff(j−3), Buff(j−2), Buff(j−1), and Buff(j) by providing output signals thereto (where j=4, 8, 12, . . . ).

In the present embodiment, the gate bus line GL(i) is connected at each end to buffer circuits Buff(i) (where i=1 to N), as shown in FIG. 19. In the present embodiment, correspondingly, the first to sixth gate clock signals GCK1 to GCK6 are supplied to both the first and second gate drivers 410 and 420, and in each of the first and second output buffer portions 412 and 422, the first to sixth gate clock signals GCK1 to GCK6 cyclically correspond to the N buffer circuits Buff(1) to Buff(N). Each buffer circuit Buff(i) receives an output signal from a corresponding bistable circuit and a corresponding gate clock signal GCKk (where k is any number from 1 to 6), and from these signals, the buffer circuit Buff(i) generates a scanning signal G(i) to be applied to the gate bus line GL(i). For example, in the first output buffer portion 412, the (n−3)'th to n'th buffer circuits Buff(n−3) to Buff(n) each receive an output signal from the bistable circuits SR(n) and the first to fourth gate clock signals GCK1 to GCK4, and from these signals, the (n−3)'th to n'th buffer circuits Buff(n−3) to Buff(n) respectively generate and provide scanning signals G(n−3) to G(n) respectively to the (n−3)'th to n'th gate bus lines GL(n−3) to GL(n).

The gate driver configuration in the present embodiment will be described in further detail below, focusing on the first gate driver 410. In the gate driver in the present embodiment, one bistable circuit and four buffer circuits controlled thereby constitute one unit circuit, and the unit circuit that consists of a bistable circuit SR(n) and four buffer circuits Buff(n−3) to Buff(n) controlled thereby will be referred to below as the "n'th unit circuit".

Figure 20:
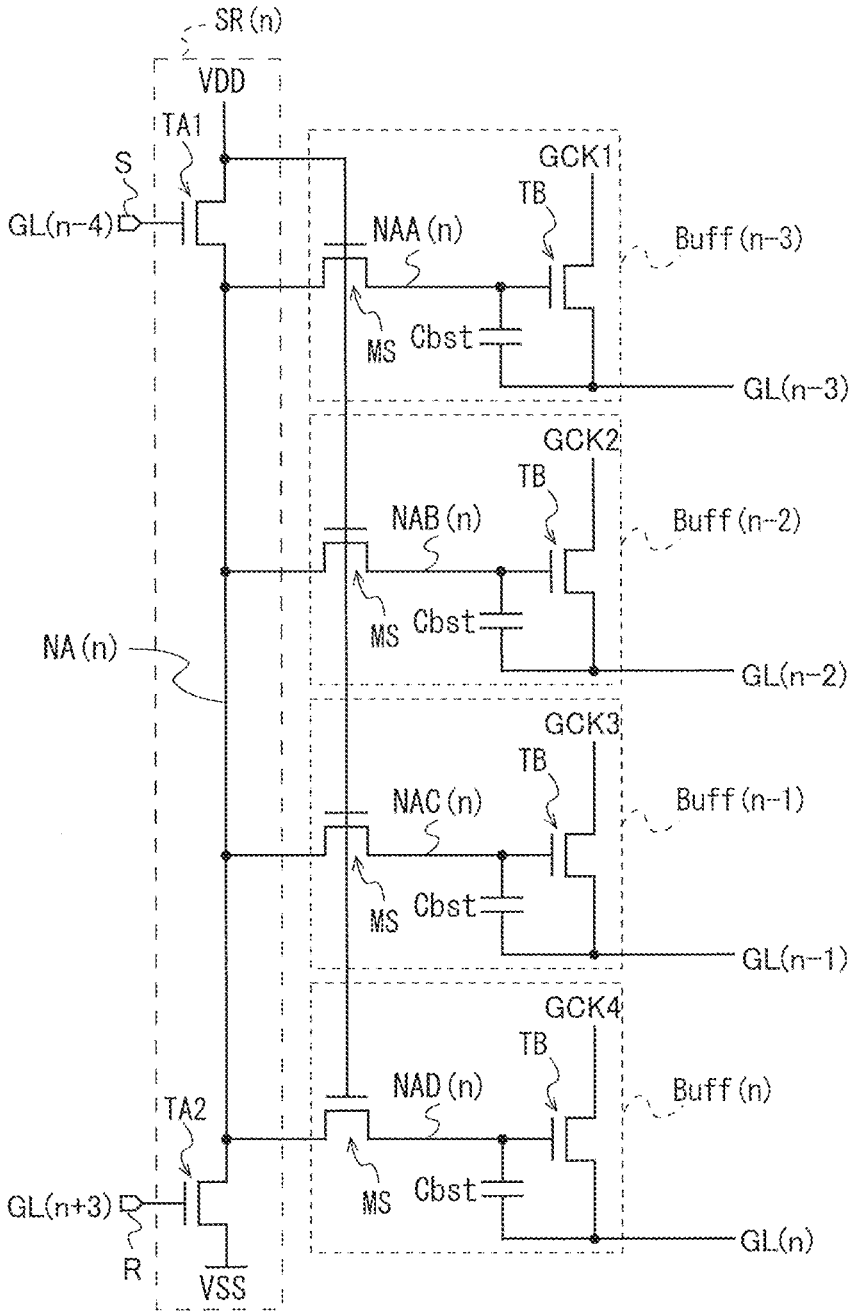
FIG. 20 is a circuit diagram for describing a basic configuration of a unit circuit of the gate driver in the fourth embodiment.

FIG. 20 is a circuit diagram illustrating the basic configuration of the n'th unit circuit of the gate driver in the present embodiment. The other unit circuits also have the same configuration thereas, except for input and output signals. The configuration of the unit circuit in the present embodiment will be described below, taking as an example the n'th unit circuit shown in FIG. 20.

In the present embodiment, the bistable circuit SR(n) of the n'th unit circuit in the gate driver has the same configuration as in the first embodiment (FIG. 8), and includes two N-channel thin-film transistors TA1 and TA2. The transistor TA1 has a source terminal connected to a drain terminal of the transistor TA2, and a connecting point thereof serves as an output terminal of the bistable circuit SR(n). The output terminal is included in a node, which can selectively hold either an H-level or L-level voltage by utilizing capacitance attached thereto (the node will be referred to below as the "primary state node"). In the bistable circuit SR(n), gate terminals of the transistors TA1 and TA2 respectively serve as a SET terminal S and a RESET terminal R. In the present embodiment, unlike in the first embodiment, the four buffer circuits Buff(n−3) to Buff(n) are controlled by one bistable circuit SR(n), and correspondingly, the SET terminal S and the RESET terminal R are respectively connected to the (n−4)'th gate bus line GL(n−4) and the (n+3)'th gate bus line GL(n+3), such that the bistable circuit SR(n) outputs an H-level signal during each period during which to select any of the gate bus lines GL(n−3) to GL(n) connected to the buffer circuits Buff(n−3) to Buff(n).

The four buffer circuits Buff(n−3) to Buff(n) controlled by one bistable circuit SR(n) are configured in the same manner, as shown in FIG. 20, and each buffer circuit has the same configuration as the type-B buffer circuit Buff(n) in the first embodiment (see FIG. 8). Specifically, each of the four buffer circuits Buff(n−3) to Buff(n) includes a buffer transistor TB, a boost isolation transistor MS, and a boost capacitor $C_{bst}$, and in any of the four buffer circuits Buff (n−3) to Buff(n), the buffer transistor TB has a gate terminal connected to the primary state node NA(n) of the bistable circuit SR(n) via the boost isolation transistor MS having a gate terminal connected to the high-level power line VDD. In the present embodiment, nodes including the gate terminals of the buffer transistors TB in the buffer circuits Buff(n−3) to Buff(n) will respectively be referred to as a "1A state node", "1B state node", "1C state node", and "1D state node".

4.2 Detailed Configuration of the Gate Driver

Figure 21:
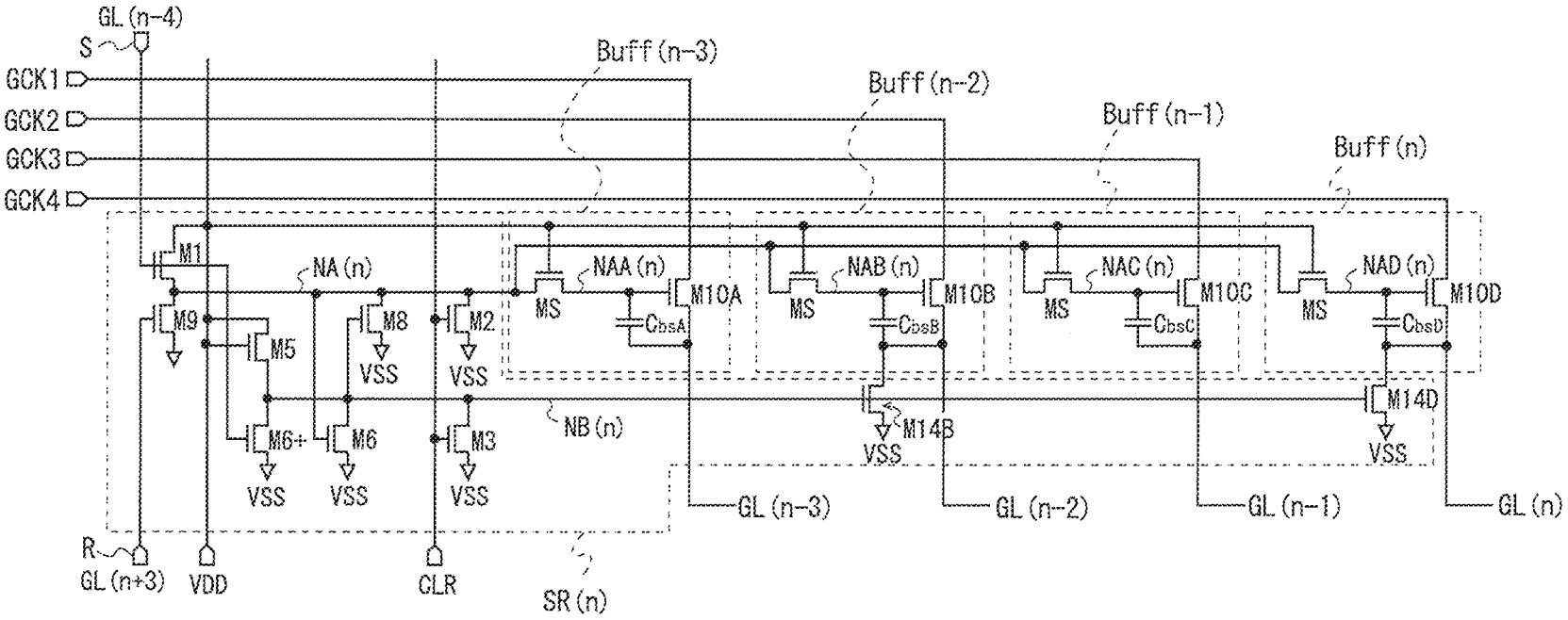
FIG. 21 is a circuit diagram for describing a detailed configuration example of the unit circuit of the gate driver in the fourth embodiment.

FIG. 21 is a circuit diagram for describing a detailed configuration example of the gate driver in the present embodiment, specifically, an example of the actual configuration of the n'th unit circuit in the first gate driver 410, as shown in FIG. 20. The n'th unit circuit in the first gate driver 410 will be described herein by way of example, and the other unit circuits also have the same configuration.

In the configuration example shown in FIG. 21, the bistable circuit SR(n) includes N-channel thin-film transistors M1, M2, M3, M5, M6, M6+, M8, M9, M14B, and M14D, and has the same configuration as shown in FIG. 9 for the first embodiment, except that the N-channel thin-film transistors M14B and M14D are included. The transistors M14B and M14D in this configuration example are respectively connected to the (n−2)'th gate bus line GL(n−2) and the n'th gate bus line GL(n). The transistors M1 and M9 respectively correspond to the transistors TA1 and TA2 shown in FIG. 20. Moreover, the SET terminal S and the RESET terminal R are respectively connected to the (n−4) 'th gate bus line GL(n−4) and the (n+3)'th gate bus line GL(n+3), such that the bistable circuit SR(n) outputs an H-level signal during each period during which to select any of the gate bus lines GL(n−3) to GL(n) connected to the four buffer circuits Buff(n−3) to Buff(n) controlled by the bistable circuit SR(n). The signal that is provided to the CLEAR terminal CLR is the same signal as that provided to a corresponding terminal of the n'th bistable circuit SR(n) shown in FIG. 9. Note that in the bistable circuit SR(n) in FIG. 21, a connecting point of the transistors M1 and M9 is a primary state node NA(n).

The (n−3)'th to n'th buffer circuits Buff(n−3) to Buff(n) shown in FIG. 21 have the same configuration as those shown in FIG. 20. Specifically, the (n−3)'th buffer circuit Buff(n−3) includes two N-channel thin-film transistors M10A and MS and a boost capacitor $C_{bsA}$, the (n−2)'th buffer circuit Buff(n−2) includes two N-channel thin-film transistors M10B and MS and a boost capacitor $C_{bsB}$, the (n−1)'th buffer circuit Buff(n−1) includes two N-channel thin-film transistors M10C and MS and a boost capacitor $C_{bsc}$, and the n'th buffer circuit Buff(n) includes two N-channel thin-film transistors M10D and MS and a boost capacitor $C_{bsD}$. Here, the transistors M10A to M10D correspond to the buffer transistors TB in the buffer circuits Buff(n−3) to Buff(n) shown in FIG. 20, and the boost capacitors $C_{bsA}$ to $C_{bsC}$ correspond to the boost capacitors $C_{bst}$ in the buffer circuits Buff(n−3) to Buff(n) shown in FIG. 20. Moreover, nodes respectively including the gate terminals of the transistors M10A, M10B, M10C, and M10D will respectively be referred to as a "1A state node NAA(n)", a "1B state node NAB(n)", a "1C state node NAC(n)", and a "1D state node NAD(n)". Note that the respective gate terminals of the buffer transistors M10A to M10D are connected to the primary state node NA(n) via the boost isolation transistors MS.

4.3 Operation of the Gate Driver

Figure 22:
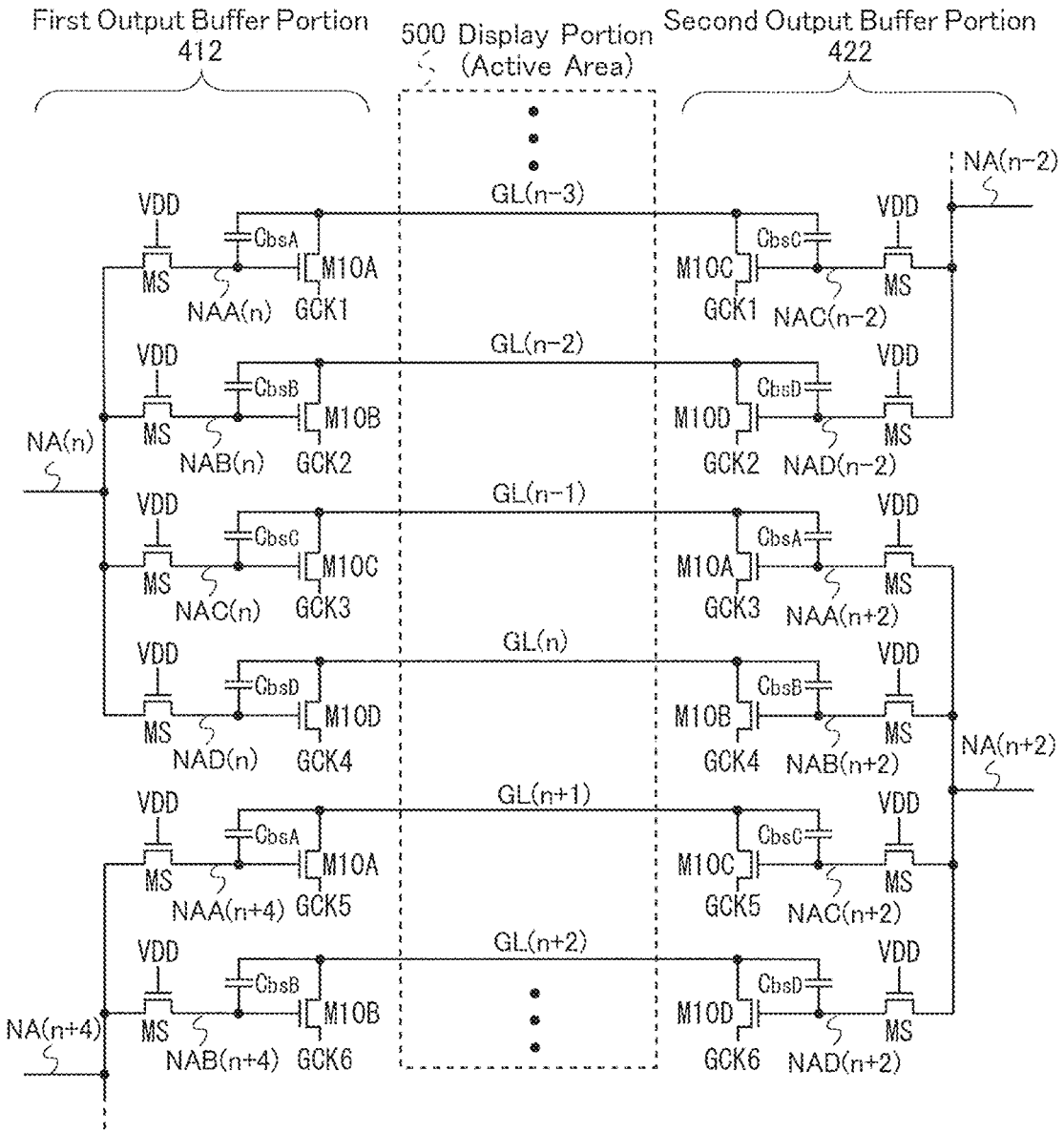
FIG. 22 is a circuit diagram for describing an operation of the gate driver in the fourth embodiment.
Figure 23:
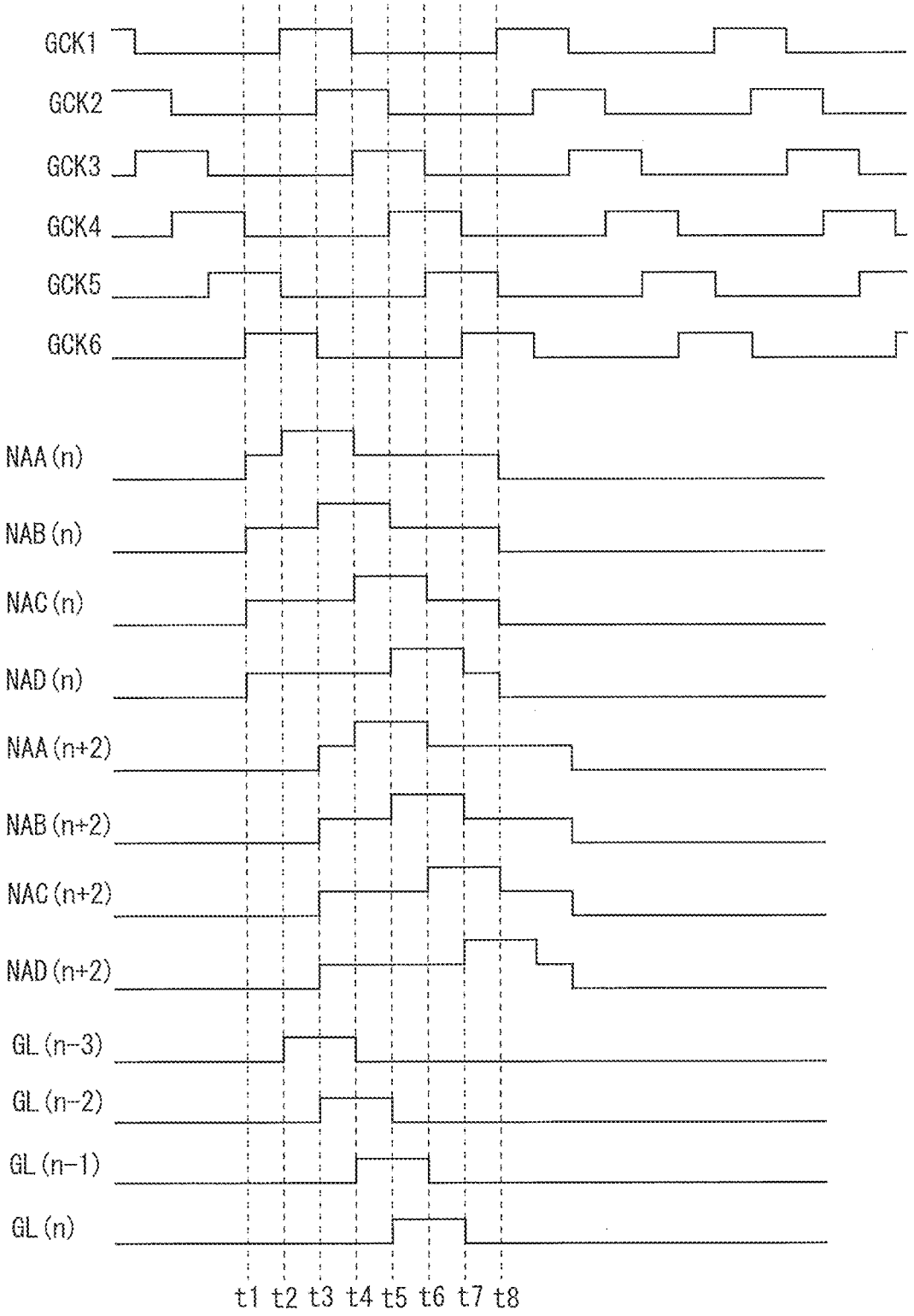
FIG. 23 is a signal waveform chart for describing the operation of the gate driver in the fourth embodiment.

FIG. 22 is a circuit diagram for describing the operation of the gate driver in the present embodiment and illustrates gate bus lines GL(i) (where i=1, . . . , n−3, n−2, n−1, n, n+1, n+2, . . . ) of the display portion 500 and buffer circuits Buff(i) of the first and second output buffer portions 412 and 422 in the first and second gate drivers 410 and 420 connected to their respective ends of the gate bus lines GL(i) (see FIG. 19). FIG. 23 is a signal waveform chart for describing the operation of the gate driver in the present embodiment. The operation of the gate driver in the present embodiment will be described below with reference to FIGS. 22 and 23, along with FIG. 21 illustrating the configuration of the unit circuit of the gate driver in the present embodiment.

In each unit circuit of the gate driver, an initialization signal, which is a signal that is set at H level for a predetermined time period, is provided to the CLEAR terminal CLR of the bistable circuit SR(i) at startup of the display device. Accordingly, in the present embodiment, voltages at the 1A state node NAA(n), the 1B state node NAB(n), the 1C state node NAC(n), and the 1D state node NAD(n) in the unit circuit, along with voltages at the primary state node NA(i) and the third state node NB(i), are set to L level (where i=1 to N). Consider now the operation of the first gate driver 410 after the initialization where the (n−4)'th gate bus line GL(n−4) connected to the SET terminal S of the n'th bistable circuit SR(n) experiences a voltage change from L level to H level at time t1, as shown in FIG. 23. In this case, the transistor M1 in the n'th bistable circuit SR(n) is changed to ON state, with the result that the primary state node NA(n) is precharged to H level. A high-level power supply voltage VDD is being provided to the gate terminal of the transistor MS, and therefore, by rendering the transistor M1 in ON state, the 1A state node NAA(n), the 1B state node NAB(n), the 1C state node NAC(n), and the 1D state node NAD(n) are precharged to H level as well.

The first gate clock signal GCK1 is changed from L level to H level at time t2 (see FIG. 23). Accordingly, in the (n−3)'th buffer circuit Buff(n−3) in the first output buffer portion 412, the buffer transistor M10A starts charging the (n−3)'th gate bus line GL(n−3). In this case, due to a change in voltage on the gate bus line GL(n−3), the boost capacitor $C_{bsA}$ pushes up the voltage on the 1A state node NAA(n), so that a voltage sufficiently higher than a normal H level is applied to the gate terminal of the buffer transistor M10A. As a result, the transistor M10A is rendered in complete ON state, and the (n−3)'th gate bus line GL(n−3) is charged to a complete H level from a first end (in FIG. 22, from the left). Moreover, in this case, in the (n−3)'th buffer circuit Buff(n−3) in the second output buffer portion 422, the (n−2)'th bistable circuit SR(n−2) precharges the 1C state node NAC(n−2) to H level, so that the transistor M10C is rendered in ON state, and thereafter, the boost capacitor $C_{bsC}$ pushes up the voltage at the 1C state node NAC(n−2). As a result, the transistor M10C is rendered in complete ON state, and the (n−3)'th gate bus line GL(n−3) is charged to a complete H level also from a second end (in FIG. 22, from the right).

The second gate clock signal GCK2 is changed from L level to H level at time t3 (see FIG. 23). As has already been described above, at time 1 preceding this change, the n'th bistable circuit SR(n) in the first gate driver 410 precharges the 1B state node NAB(n) to H level, so that the buffer transistor M10B is rendered in ON state, but the second gate clock signal GCK2 is set at L level during the period from time t1 to time t3. Once the second gate clock signal GCK2 is changed to H level at time t3, the buffer transistor M10B starts charging the (n−2)'th gate bus line GL(n−2). In this case, due to a change in voltage on the gate bus line GL(n−2), the boost capacitor $C_{bsB}$ pushes up the voltage at the 1B state node NAB(n), so that a voltage sufficiently higher than a normal H level is applied to the gate terminal of the buffer transistor M10B. As a result, the transistor M10B is rendered in complete ON state, and the (n−2)'th gate bus line GL(n−2) is charged to a complete H level from a first end (in FIG. 22, from the left). Moreover, in this case, in the (n−2)'th buffer circuit Buff(n−2) in the second output buffer portion 422, the (n−2)'th bistable circuit SR(n−2) precharges the 1D state node NAD(n−2) to H level, so that the transistor M10D is rendered in ON state, and thereafter, the boost capacitor $C_{bsC}$ pushes up the voltage at the 1D state node NAD(n−2). As a result, the transistor M10D is rendered in complete ON state, and the (n−2)'th gate bus line GL(n−2) is charged to the complete H level also from a second end (in FIG. 22, from the right).

The third gate clock signal GCK3 is changed from L level to H level at time t4 (see FIG. 23), and similarly, at this time, a voltage boost operation is performed on the 1C state node NAC(n) of the buffer circuit Buff(n−1) in the first output buffer portion 412, so that the buffer transistor M10C is rendered in complete ON state, and the (n−1)'th gate bus line GL(n−1) is charged to a complete H level from a first end (in FIG. 22, from the left). Correspondingly, in the buffer circuit Buff(n−1) of the second output buffer portion 422, a voltage boost operation is performed on the 1A state node NAA(n+2), so that the buffer transistor M10A is rendered in complete ON state, and the (n−1)'th gate bus line GL(n−1) is charged to a complete H level also from a second end (in FIG. 22, from the right).

The fourth gate clock signal GCK4 is changed from L level to H level at time t5 (see FIG. 23), and similarly, at this time, a voltage boost operation is performed on the 1D state node NAD(n) of the buffer circuit Buff(n) in the first output buffer portion 412, so that the buffer transistor M10D is rendered in complete ON state, and the n'th gate bus line GL(n) is charged to a complete H level from a first end (in FIG. 22, from the left). Correspondingly, in the buffer circuit Buff(n) of the second output buffer portion 422, a voltage boost operation is performed on the 1B state node NAB(n+2), so that the buffer transistor M10B is rendered in complete ON state, and the n'th gate bus line GL(n) is charged to a complete H level also from a second end (in FIG. 22, from the right).

Furthermore, the first gate clock signal GCK1 is changed from H level to L level at time t4 (see FIG. 23). As a result, the (n−3)'th gate bus line GL(n−3) is discharged from the first end (in FIG. 23, from the left) via the buffer transistor M10A of the buffer circuit Buff(n−3) in the first output buffer portion 412, and also from the second end (in FIG. 23, from the right) via the buffer transistor M10C of the buffer circuit Buff(n−3) in the second output buffer portion 422. Consequently, the voltage on the (n−3)'th gate bus line GL(n−3) is quickly changed to L level. In this manner, the (n−3)'th gate bus line GL(n−3) selected at time t2 is deselected at time t4 (see FIG. 23).

The second gate clock signal GCK2 is changed from H level to L level at time t5 (see FIG. 23), and similarly, at this time, the (n−2)'th gate bus line GL(n−2) is discharged from the first end (in FIG. 23, from the left) via the buffer transistor MOB of the buffer circuit Buff(n−2) in the first output buffer portion 412, and also from the second end (in FIG. 23, from the right) via the buffer transistor MOD of the buffer circuit Buff(n−2) in the second output buffer portion 422. Consequently, the voltage on the (n−2)'th gate bus line GL(n−2) is quickly changed to L level. In this manner, the (n−2)'th gate bus line GL(n−2) selected at time t3 is deselected at time t5 (see FIG. 23).

The third gate clock signal GCK3 is changed from H level to L level at time t6 (see FIG. 23), and similarly, at this time, the (n−1)'th gate bus line GL(n−1) is discharged from the first end (in FIG. 23, from the left) via the buffer transistor M10C of the buffer circuit Buff(n−1) in the first output buffer portion 412, and also from the second end (in FIG. 23, from the right) via the buffer transistor M10A of the buffer circuit Buff(n−1) in the second output buffer portion 422. Consequently, the voltage on the (n−1)'th gate bus line GL(n−1) is quickly changed to L level. In this manner, the (n−1)'th gate bus line GL(n−1) selected at time t4 is deselected at time t6 (see FIG. 23).

The fourth gate clock signal GCK4 is changed from H level to L level at time t7 (see FIG. 23), and similarly, at this time, the n'th gate bus line GL(n) is discharged from the first end end (in FIG. 23, from the left) via the buffer transistor M10D of the buffer circuit Buff(n) in the first output buffer portion 412, and also from the second end (in FIG. 23, from the right) via the buffer transistor M10B of the buffer circuit Buff(n) in the second output buffer portion 422. Consequently, the voltage on the n'th gate bus line GL(n) is quickly changed to L level. In this manner, the n'th gate bus line GL(n) selected at time t5 is deselected at time t7 (see FIG. 23).

The voltage on the (n+3)'th gate bus line GL(n+3) is changed to H level at time t8, and at this time, the H-level voltage is applied to the RESET terminal R of the bistable circuit SR(n) in FIG. 21, so that the transistor M9 is changed to ON state, with the result that the primary state node NA(n) is discharged, and the voltage at the primary state node NA(n) is changed to L level. At this time, the 1A state node NAA(n), the 1B state node NAB(n), the 1C state node NAC(n), and the 1D state node NAD(n) are also discharged via their corresponding transistors MS, so that the voltages at the 1A state node NAA(n), the 1B state node NAB(n), the 1C state node NAC(n), and the 1D state node NAD(n) are also changed to L level. As a result, the bistable circuit SR(n) in FIG. 21 is rendered in RESET state. On the other hand, the third state node NB(n) is connected to the high-level power line VDD via the diode-connected transistor M5, and therefore, when the transistor M9 is changed to ON state at time t8, so that the transistor M6 is rendered in OFF state, the voltage on the third state node NB(n) is changed to H level. As a result, the transistor M8 is rendered in ON state, whereby the primary state node NA(n) is provided with a low-level power voltage VSS. This causes the primary state node NA(n) to be kept at L level and also causes the third state node NB(n) to be kept at H level by turning off the transistor M6.

In this manner, until the voltage on the (n−4)'th gate bus line GL(n−4) is changed to H level during the next frame period, whereby the transistor M1 is rendered in ON state, the primary state node NA(n) and the third state node NB(n) are reliably kept at L level and H level, respectively. Specifically, until the next time the voltage on the gate bus line GL(n−4) connected to the SET terminal S is set to H level, the bistable circuit SR(n) is stably kept in RESET state. Note that while the third state node NB(n) is at H level, the transistors M14B and M14D are in ON state, and the gate bus line GL(n) is stably kept at L level (see FIG. 21).

In the gate driver thus configured, as with the gate driver in the first embodiment, the scanning signals G(1) to G(N), which are generated based on the first and second scanning control signals GCT1 and GCT2, are applied to the gate bus lines GL(1) to GL(N) from opposite ends, thereby driving the gate bus lines GL(1) to GL(N). Thus, each of the gate bus lines GL(1) to GL(N) of the display portion 500 is sequentially charged to H level, i.e., sequentially selected, for a predetermined time period (see FIG. 23).

4.4 Effects

As with the first embodiment, the present embodiment as described above renders it possible to drive the large-sized display portion 500 at high speed and narrow the picture-frame area of the display panel (i.e., the liquid crystal panel 600), and also allows the display portion 500 to provide satisfactory display free of artifacts such as stripe patterns (see FIG. 10, FIG. 22). Further, in the present embodiment, four buffer circuits are controlled by one bistable circuit, whereby the circuit volume of the shift register can be reduced (FIGS. 19 to 21), and therefore, the picture-frame area can be further narrowed compared to the first embodiment (see FIGS. 6 to 9).

5. Fifth Embodiment

Next, a display device according to a fifth embodiment will be described. The display device according to the present embodiment is also an active-matrix liquid crystal display device, and has the same configuration as in the first embodiment, except for the buffer circuits in the gate driver serving as the scanning signal line drive circuit (see FIGS. 1, 2, 6, and 11). In the following, the present embodiment will be described, mainly focusing on the configuration of the buffer circuit in the gate driver, and the other elements, either the same or corresponding elements, are denoted by the same reference characters and will not be elaborated upon.

5.1 Configuration of the Gate Driver

Figure 24:
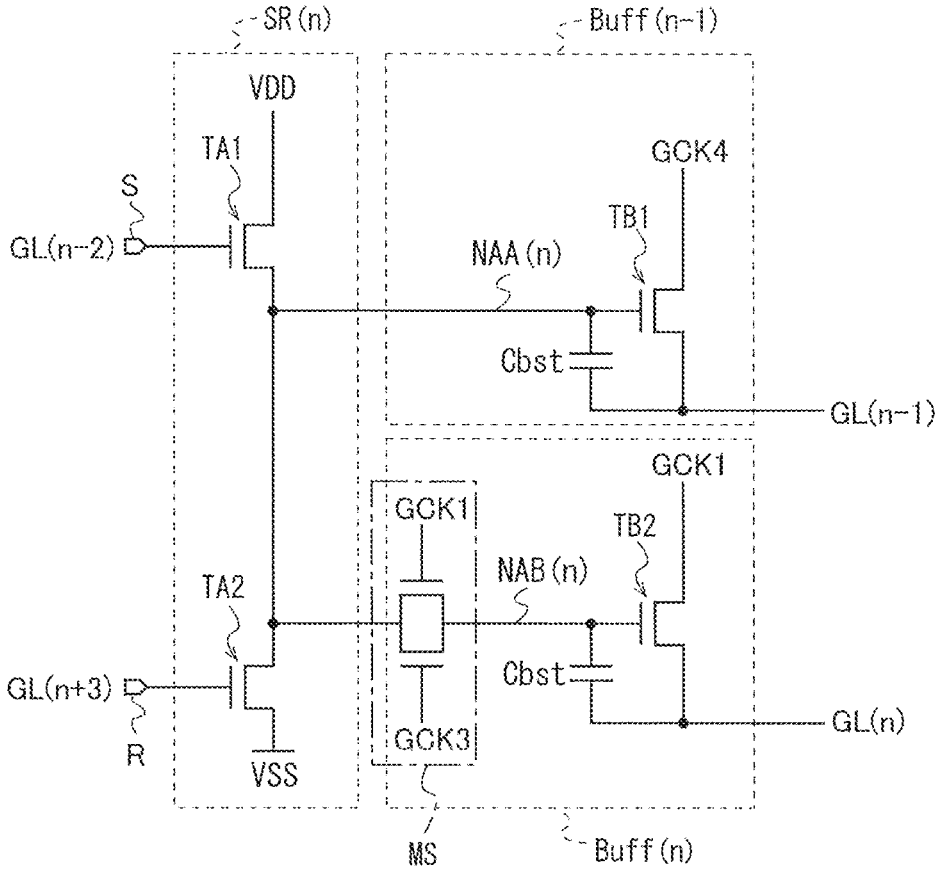
FIG. 24 is a circuit diagram for describing a basic configuration of a unit circuit of a gate driver in a display device according to a fifth embodiment.

FIG. 24 is a circuit diagram illustrating the basic configuration of the n'th unit circuit of the gate driver in the present embodiment. The other unit circuits also have the same configuration thereas, except for input and output signals. The basic configuration of the unit circuit in the present embodiment will be described below, taking as an example the n'th unit circuit shown in FIG. 24.

The n'th unit circuit of the gate driver in the present embodiment includes one bistable circuit SR(n) and (n−1)'th and n'th buffer circuits Buff(n−1) and Buff(n). Since the bistable circuit SR(n) and the (n−1)'th buffer circuit Buff (n−1) have the same configuration as in the first embodiment (FIG. 8), the same elements are denoted by the same reference characters, and any descriptions thereof will be omitted.

In the present embodiment, the n'th buffer circuit Buff(n) has the same configuration as that shown in FIG. 8, except that the boost isolation transistor MS is replaced by a boost isolation circuit MS consisting of two N-channel thin-film transistors connected in parallel. Specifically, the n'th buffer circuit Buff(n) in the present embodiment includes a buffer transistor TB2, which is an N-channel thin-film transistor, a boost capacitor $C_{bst}$, and a boost isolation circuit MS. The buffer transistor TB2 has a drain terminal to which a first gate clock signal GCK1 is provided and a source terminal connected to the n'th gate bus line GL(n).

The buffer transistor TB2 has a gate terminal connected to the source terminal via the boost capacitor $C_{bst}$ and also to an output terminal of the bistable circuit SR(n), i.e., a connecting point of the transistors TA1 and TA2, via the boost isolation circuit MS.

One of the two transistors in the boost isolation circuit MS has a gate terminal to which a first gate clock signal GCK1 is provided, and the other transistor has a gate terminal to which a third gate clock signal GCK3 is provided. Note that the two clock signals respectively provided to the gate terminals of the two transistors in the boost isolation circuit MS are not limited to the first and third gate clock signals GCK1 and GCK3, and may be other clock signals opposite in phase to each other. For example, in the case where a 4-phase clock signal consisting of first to fourth gate clock signals as shown in FIG. 11 is used, the second gate clock signal may be provided to the gate terminal of one of the two transistors, and the fourth gate clock signal may be provided to the gate terminal of the other transistor. Such a boost isolation circuit MS in the present embodiment is operated as a transmission gate having essentially the same function as the boost isolation transistor MS in the first embodiment (see FIG. 8).

Figure 25:
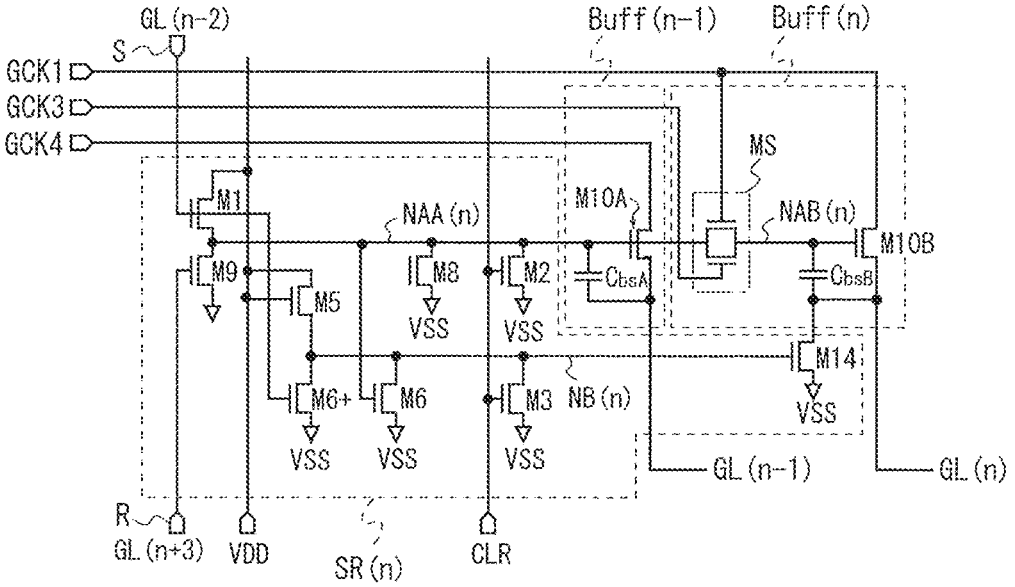
FIG. 25 is a circuit diagram for describing a detailed configuration example of the unit circuit of the gate driver in the fifth embodiment.

FIG. 25 is a circuit diagram for describing a detailed configuration example of the gate driver in the present embodiment and illustrates an example of the actual configuration of the n'th unit circuit in the first gate driver 410, as shown in FIG. 24. The unit circuit that corresponds to the n'th bistable circuit SR(n) in the first gate driver 410 will be described below by way of example, and the other unit circuits also have the same configuration.

The n'th unit circuit shown in FIG. 25 has the same configuration as that shown in FIG. 9 for the first embodiment, except for the n'th buffer circuit Buff(n); therefore, the same elements are denoted by the same reference characters and any descriptions thereof will be omitted.

The n'th buffer circuit Buff(n) shown in FIG. 25 has the same configuration as that shown in FIG. 24, and includes an N-channel thin-film transistor M10B, a boost capacitor $C_{bsB}$, and a boost isolation circuit MS. The transistor M10B, the capacitor $C_{bsB}$, and the circuit MS respectively correspond to the buffer transistor TB2, the boost capacitor $C_{bst}$, and the boost isolation circuit MS in the buffer circuit Buff(n) shown in FIG. 24. Note that a second state node NAB(n), which includes a gate terminal of the buffer transistor M10B, is connected to a first state node NAA(n) in the n'th bistable circuit SR(n) via the boost isolation circuit MS.

5.2 Operation of the Gate Driver

Figure 26:
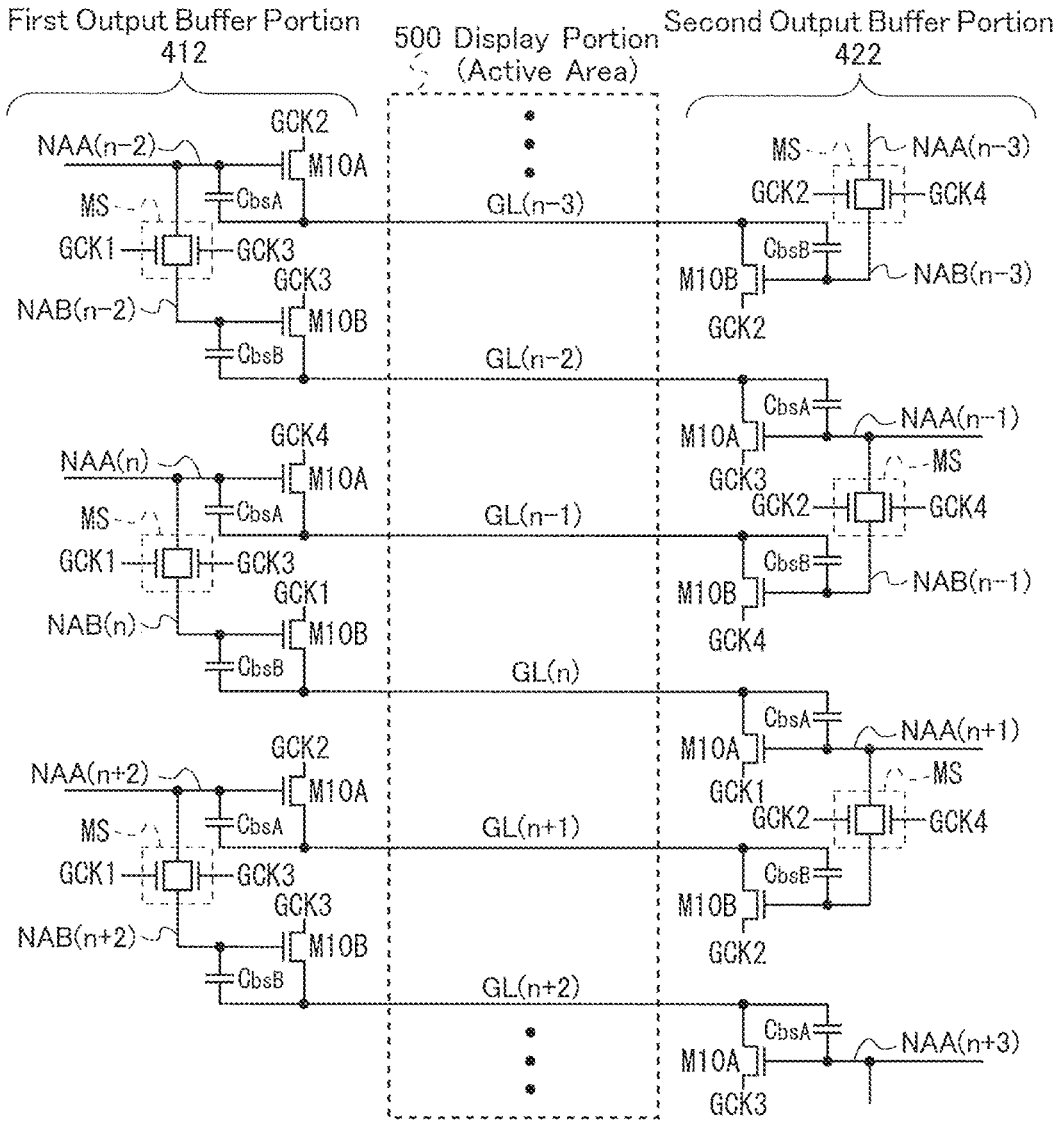
FIG. 26 is a circuit diagram for describing an operation of the gate driver in the fifth embodiment.

FIG. 26 is a circuit diagram for describing the operation of the gate driver in the present embodiment and illustrates gate bus lines GL(i) (where i=1, . . . , n−3, n−2, n−1, n, n+1, n+2, . . . ) of the display portion 500 and buffer circuits Buff(i) of the first and second output buffer portions 412 and 422 in the first and second gate drivers 410 and 420 connected to their respective ends of the gate bus lines GL(i).

As has already been described, the boost isolation circuit MS in the present embodiment includes two N-channel transistors (more generally, transistors of the same channel type) connected in parallel, and the clock signals that are respectively provided to the gate terminals of the two transistors are opposite in phase to each other. Accordingly, the boost isolation circuit MS has the same function as the N-channel transistor that has a gate terminal to which a high-level power supply voltage VDD is provided, i.e., the boost isolation transistor MS as used in the first embodiment. Specifically, even when a boost operation raises a voltage at the second state node NAB(n) connected to one side of the boost isolation circuit MS, such a voltage rise does not affect a voltage at the first state node NAA(n) connected to the other side of the boost isolation circuit MS. Moreover, even when a boost operation raises the voltage at the first state node NAA(n), such a voltage rise does not affect the voltage at the second state node NAB(n).

Accordingly, in the present embodiment, the gate driver is operated in the same manner as in the first embodiment, i.e., in the manner as shown in FIG. 11.

5.3 Effects

In the present embodiment as described above, the gate driver is operated in the same manner as in the first embodiment, thereby achieving the same effects as those achieved by the first embodiment. In addition, the present embodiment renders it possible to achieve the following effects by virtue of the configuration of the boost isolation circuit MS.

In the first embodiment, during the operation, a high-level power supply voltage VDD is constantly provided to the gate terminal of the boost isolation transistor MS, which is an N-channel thin-film transistor, as shown in FIG. 8. Accordingly, characteristics of the boost isolation transistor MS deteriorate as the period of use increases.

In contrast, in the present embodiment, instead of using such a boost isolation transistor MS, another boost isolation circuit MS as described earlier is used, and clock signals are provided to respective gate terminals of two transistors in that boost isolation circuit MS. Accordingly, when compared to the case where the high-level power supply voltage is provided to the gate terminal of the boost isolation transistor MS, less stress is applied to the transistors of the boost isolation circuit MS, whereby the speed of characteristics deterioration can be reduced. Thus, it is possible to provide a more reliable gate driver capable of achieving the same effects as those achieved by the first embodiment.

6. Sixth Embodiment

Next, a display device according to a sixth embodiment will be described. The display device according to the present embodiment is an active-matrix liquid crystal display device with an integrated touchscreen panel.

6.1 Configuration and Operation of the Touchscreen Panel

Figure 27:
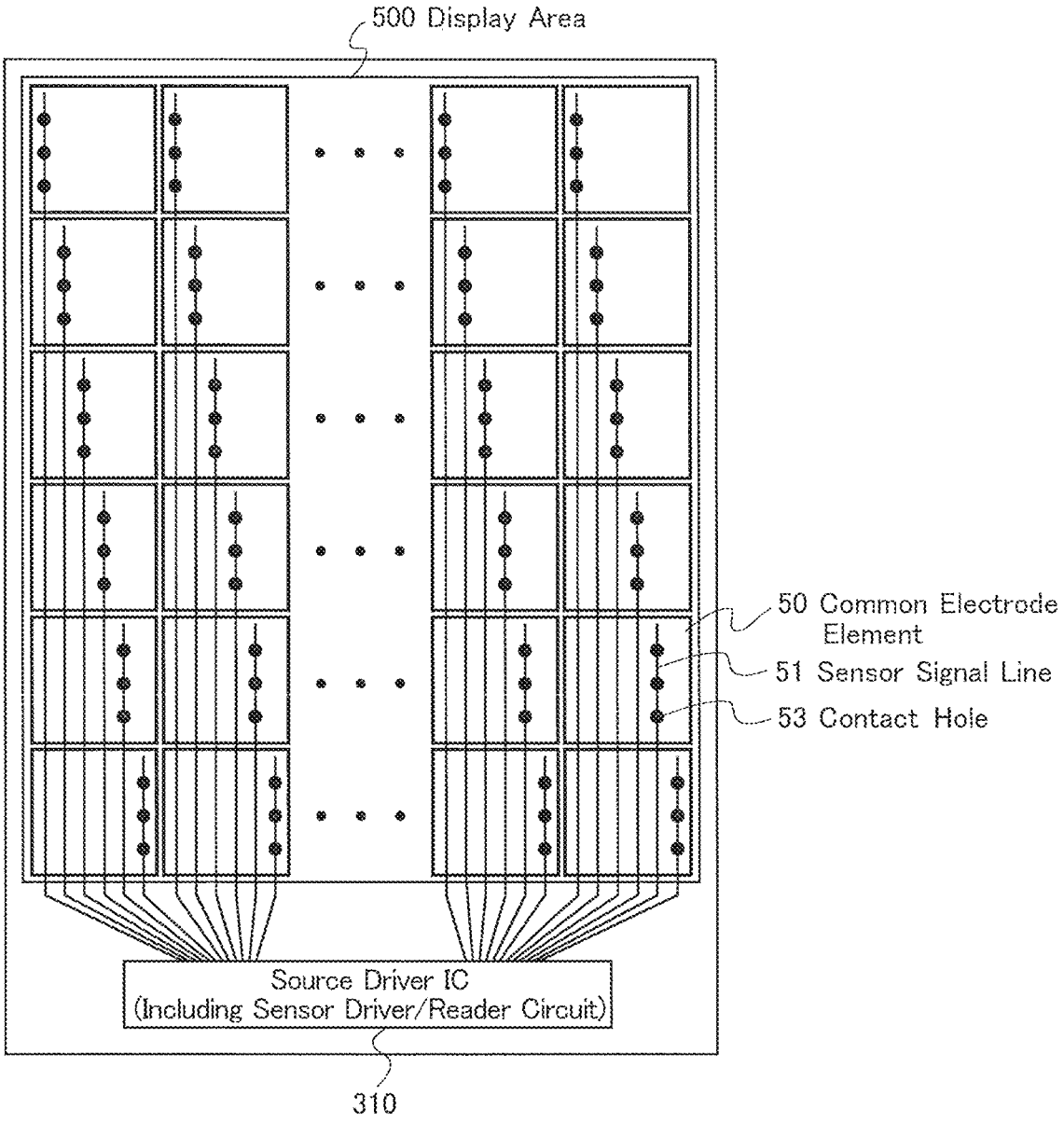
FIG. 27 is a schematic diagram for describing the configuration of a touchscreen panel of a display device according to a sixth embodiment.

FIG. 27 is a schematic diagram for describing the configuration of the touchscreen panel in the present embodiment. In the present embodiment, a fringe field switching (FFS) liquid crystal panel is used. This liquid crystal panel includes an active-matrix substrate 610 in which pixel circuits, a plurality of source bus lines, a plurality of gate bus lines crossing the source bus lines, and a gate driver, etc., are formed. Disposed on the active-matrix substrate 610 are a matrix of rectangular common electrode elements 50. One common electrode element 50 is, for example, approximately in the shape of a square with each side measuring several millimeters, and is larger than a pixel electrode.

The active-matrix substrate 610 has a source driver integrated circuit (IC) 310 mounted in a picture-frame area, and the source driver IC includes a sensor driver/reader circuit for realizing the touchscreen panel function. The active-matrix substrate 610 also has a plurality of sensor signal lines 51 provided in one-to-one correspondence with the common electrode elements 50 and extending in parallel to the source bus lines. Each common electrode element 50 is electrically connected to a corresponding sensor signal line 51 by several contact holes 53 and also to the source driver IC by the corresponding sensor signal line 51. The common electrode element 50 is used for applying a voltage across the pixel electrode and the common element 50 for the purpose of image display, and also used for forming capacitance for touch position sensing.

The display device according to the present embodiment has the same configuration as in the first embodiment, except for the elements related to the touchscreen panel described with reference to FIG. 27, and the same or corresponding elements are denoted by the same reference characters and will not be elaborated upon (see FIGS. 1, 2, and 6 to 10). Note that the common electrode elements 50 correspond to the common electrode Ec in the first embodiment (see FIG. 2).

Figure 28:
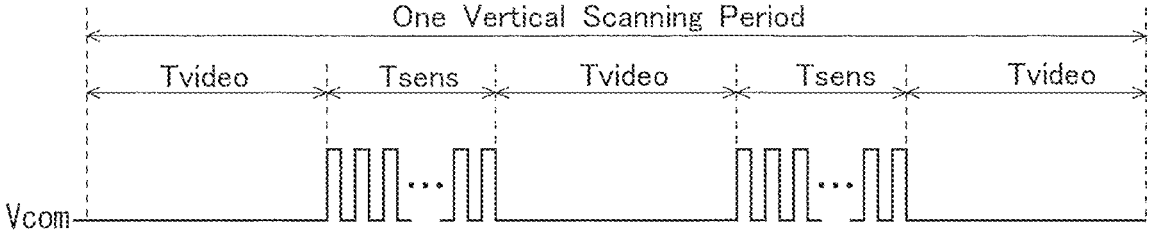
FIG. 28 is a timing chart for describing the general operation of the touchscreen panel in the sixth embodiment.

FIG. 28 is a timing chart for describing the general operation of the touchscreen panel in the present embodiment. The display device according to the present embodiment is configured such that an image writing period $T_{video}$, in which to write data to the liquid crystal panel 600 for image display, and a position sensing period $T_{sens}$, in which to detect a touch position in a display area 500 of the liquid crystal panel 600, alternate with each other during one vertical scanning period (i.e., one frame period), as shown in FIG. 28.

During the image writing period $T_{video}$ with each common electrode element 50 being supplied with a DC voltage through the sensor signal line 51 as a common voltage $V_{com}$, the source driver IC 310 drives the source bus lines $SL_1$ to $SL_M$ simultaneously with the gate driver driving the gate bus lines GL(1) to GL(N), thereby writing pixel data representing a display image to corresponding pixel circuits as data voltages.

On the other hand, during the touch position sensing period $T_{sens}$, with the gate bus lines GL(1) to GL(N) and the source bus lines $SL_1$ to $SL_M$ stopped from being driven, the source driver IC 310 supplies each common electrode element 50 with an AC signal having a constant amplitude through the sensor signal line 51. When the display area 500 of the liquid crystal panel is touched by, for example, a human finger, capacitance is formed between the common electrode element 50 at the touched position and the human finger. The source driver IC 310 senses a change in capacitance in the common electrode element 50 at the touched position (i.e., the touch position) on the basis of the AC signal. In this manner, the touchscreen panel function is realized by sensing a change in capacitance in the common electrode element 50 at the touch position.

6.2 Operation of the Gate Driver

In the present embodiment, since the touchscreen panel function is realized as described above, the image writing period $T_{video}$ is a period in which the gate bus lines are scanned, and the touch position sensing period $T_{sens}$ is a period in which the gate bus lines are not scanned. The gate driver in the present embodiment is operated in accordance with the configuration that allows a scanning period, which corresponds to the image writing period $T_{video}$, and a non-scanning period, which corresponds to the touch position sensing period $T_{sens}$, to alternate with each other during one vertical scanning period.

Figure 29:
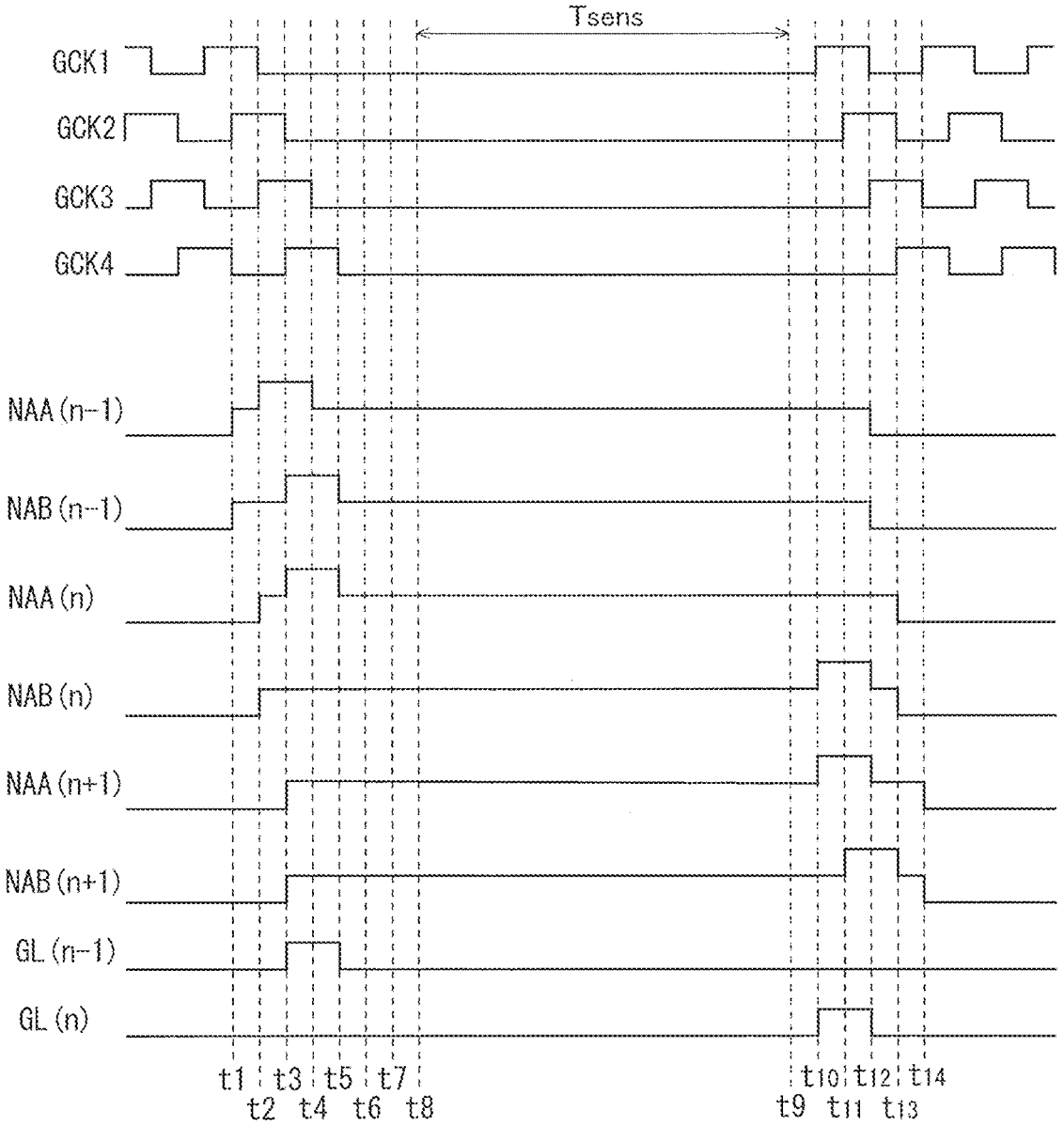
FIG. 29 is a signal waveform chart for describing an operation of the gate driver in the sixth embodiment.

FIG. 29 is a signal waveform chart for describing such an operation of the gate driver in the present embodiment. As shown in FIG. 29, in the present embodiment, the sequential driving of the gate bus lines GL(1) to GL(N) is stopped upon start of the touch position sensing period $T_{sens}$ and then restarted after the touch position sensing period $T_{sens}$. During the touch position sensing period $T_{sens}$, the display control circuit 200 generates first and second scanning control signals GCT1 and GCT2 such that first to fourth gate clock signals GCK1 to GCK4 are kept at L level.

In the operation example shown in FIG. 29, the touch position sensing period $T_{sens}$ intervenes between a period in which to select the (n−1)'th gate bus line GL(n−1) and a period in which to select the n'th gate bus line GL(n). The first to fourth gate clock signals GCK1 to GCK4 are changed to L level at respective times t2 to t5 preceding the touch position sensing period $T_{sens}$, and kept at L level (i.e., the gate clock signals are stopped) before the first to fourth gate clock signals GCK1 to GCK4 are changed to H level at respective times t10 to t13 following the touch position sensing period $T_{sens}$, and thereafter, the first to fourth gate clock signals GCK1 to GCK4 alternate between H level and L level in normal cycles (i.e., the gate clock signals starts to be transmitted again).

In this manner, the first to fourth gate clock signals GCK1 to GCK4 are stopped during the period from t5 to t10, including the touch position sensing period $T_{sens}$. Looking at the second state node NAB(n−1) in the n'th−1 unit circuit in relation to these clock signals, the voltage at the second state node NAB(n−1) is changed by a boost operation to a level sufficiently higher than a normal H level at time t3 as a result of the fourth gate clock signal GCK4 being changed to H level. Thereafter, once the fourth gate clock signal GCK4 is changed to L level at time t5, the voltage at the second state node NAB(n−1) is reduced to a precharge voltage level (i.e., a voltage level (VDD−Vth(MS)) close to a high-level power supply voltage). The precharge voltage level is maintained even after the touch position sensing period $T_{sens}$ until the voltage at the second state node NAB(n−1) is changed to L level at time t12, at which the third gate clock signal GCK3 is changed to H level. As for the first state node NAA(n) in the n'th unit circuit, the voltage at the first state node NAA(n) is changed by the boost operation to a level sufficiently higher than the normal H level at time t3 as a result of the fourth gate clock signal GCK4 being changed to H level. Thereafter, once the fourth gate clock signal GCK4 is changed to L level at time t5, the voltage at the first state node NAA(n) is reduced to a precharge voltage level (i.e., a voltage level (VDD−Vth(M1)) close to the high-level power supply voltage). The precharge voltage level is maintained even after the touch position sensing period $T_{sens}$ until the voltage at the first state node NAA(n) is changed to L level at time t13, at which the fourth gate clock signal GCK4 is changed to H level. Because of the voltages at the first and second state nodes NAA(n) and NAB(n−1), the (n−1)'th gate bus line GL(n−1) is selected (or set at H level) during the period from time t3 to time t5 preceding the touch position sensing period $T_{sens}$ (see FIGS. 10 and 29). Thereafter, the (n−1)'th gate bus line GL(n−1) is deselected (or set at L level) and maintains the deselected state (L level) until the (n−1)'th gate bus line GL(n−1) is selected again during the next vertical scanning period.

Furthermore, looking at the second state node NAB(n) in the n'th unit circuit in relation to the first to fourth gate clock signals GCK1 to GCK4, which are stopped during the period from t5 to t10, including the touch position sensing period $T_{sens}$, the voltage at the second state node NAB(n) is changed to the precharge voltage level, i.e., the voltage level (VDD−Vth(MS)) close to the high-level power supply voltage, at time t2, at which the third gate clock signal GCK3 is changed to H level. Thereafter, the precharge voltage level is maintained even after the touch position sensing period $T_{sens}$ until the voltage at the second state node NAB(n) is raised by a boost operation at time t10 as a result of the first gate clock signal GCK1 being changed to H level. Thereafter, once the first gate clock signal GCK1 is changed to L level at time t12, the voltage at the second state node NAB(n) is reduced to the precharge voltage level and then changed to L level at time t13, at which the fourth gate clock signal GCK4 is changed to H level. As for the first state node NAA(n+1) in the (n+1)'th unit circuit, the voltage at the first state node NAA(n+1) is changed to the precharge voltage level, i.e., the voltage level (VDD−Vth(M1)) close to the high-level power supply voltage, at time t3, at which the fourth gate clock signal GCK4 is changed to H level. Thereafter, the precharge voltage level is maintained even after the touch position sensing period $T_{sens}$ until the voltage at the first state node NAA(n+1) is raised by the boost operation at time t10 as a result of the first gate clock signal GCK1 being changed to H level.

Thereafter, once the first gate clock signal GCK1 is changed to L level at time t12, the voltage at the first state node NAA(n+1) is reduced to the precharge voltage level and then changed to L level at time t14, at which the first gate clock signal GCK1 is changed to H level. The buffer transistors M10A and M10B are respectively controlled by the voltages at the first and second state nodes NAA(n+1) and NAB(n), such that the n'th gate bus line GL(n) is selected (or set at H level) during the period from time t10 to time t12 following the touch position sensing period $T_{sens}$ (see FIGS. 10 and 29). Thereafter, the n'th gate bus line GL(n) is deselected (or set at L level) and maintains the deselected state (L level) until the n'th gate bus line GL(n) is selected again during the next vertical scanning period.

In this manner, due to the first to fourth gate clock signals GCK1 to GCK4 being stopped as above, all the gate bus lines GL(1) to GL(N) are kept in the deselected state (L level) during the touch position sensing period $T_{sens}$. Immediately after the touch position sensing period $T_{sens}$, the gate bus lines GL(1) to GL(N) resume to be scanned from the gate bus line GL(n) next to the gate bus line GL(n−1) selected immediately before the touch position sensing period $T_{sens}$.

6.3 Effects

In the present embodiment as above, two buffer circuits Buff(i−1) and Buff(i) are controlled by one bistable circuit SR(i) (where i=1 to N). The two buffer circuits Buff(i−1) and Buff(i) charge or discharge the gate bus lines GL(i−1) and GL(i) through the buffer transistors M10A and M10B (or TB1 and TB2) in accordance with their respectively different gate clock signals $GCK_a$ and $GCK_b$ (where a=1 to 4, b=1 to 4, and a≠b; see FIGS. 6 to 10). Accordingly, for the display device having the touchscreen panel function, there is provided the touch position sensing period $T_{sens}$ during which the scanning for image display is stopped, as described above, with the result that even when the scanning for selecting the gate bus lines GL(1) to GL(N) is stopped prematurely (FIG. 28), the gate bus lines GL(1) to GL(N) can be normally driven for image display (FIG. 29). Thus, in the present embodiment, by providing the touch position sensing period $T_{sens}$ during which to stop the scanning for image display, it is rendered possible to achieve the effect of realizing a high-performance touchscreen function, as well as effects as achieved in the first embodiment, such as driving the large-sized display portion 500 at high speed and narrowing the picture-frame area of the display panel.

7. Variants

While the invention has been described in detail, the foregoing description is in all aspects illustrative and not restrictive. It is understood that numerous other modifications and variations can be devised without departing from the scope of the invention.

For example, in the gate drivers of the above embodiments, the number of buffer circuits controlled by one bistable circuit is two or four, but the present invention can also be applied to configurations in which three, five, or more buffer circuits are controlled by one bistable circuit. Note that in the fourth embodiment, each of the four buffer circuits controlled by one bistable circuit includes a boost isolation transistor MS (see FIGS. 20 to 22), but one of the four buffer circuits may include no boost isolation transistor, and the buffer transistor TB may be directly connected to the output terminal of the bistable circuit (i.e., the connecting point of the transistors TA1 and TA2). More generally, one of a plurality of buffer circuits controlled by one bistable circuit may include no boost isolation transistor MS, and the buffer transistor TB may be directly connected to the output terminal of the bistable circuit (the connecting point of the transistors TA1 and TA2). This configuration also renders it possible to keep the gate terminal of each buffer transistor from being affected by a voltage boost effect on the gate terminal of another buffer transistor.

Furthermore, for the gate driver consisting of the first and second gate drivers respectively disposed near the first and second ends of the N gate bus lines in the display portion, the interlaced arrangement is not limited to those of the above embodiments, and more generally, the following configurations are included. Specifically, the first gate driver includes q1 first bistable circuits (where q1≥2) in one-to-one correspondence with q1 gate bus line groups, each consisting of p (where 2≤p<N) adjacent gate bus lines selected from among the N gate bus lines in the display portion, and N first buffer circuits in one-to-one correspondence with the N gate bus lines. The first gate driver is operated in accordance with a multi-phase gate clock signal. The second gate driver includes q2 second bistable circuits (where q2≥2, and |q1−q2|≤1) in one-to-one correspondence with q2 gate bus line groups, each consisting of p adjacent gate bus lines selected from among the N gate bus lines, and N second buffer circuits in one-to-one correspondence with the N gate bus lines. The second gate driver is operated in accordance with the multi-phase gate clock signal. In the first gate driver, the q1 first bistable circuits are cascaded together so as to constitute a shift register, and control their respective groups of p first buffer circuits connected to the first ends of the p gate bus lines in their corresponding groups. The p first buffer circuits drive their corresponding p gate bus lines in accordance with gate clock signals included in the multi-phase gate clock signal and out of phase with one another. In the second gate driver, the q2 second bistable circuits are cascaded together so as to constitute a shift register, and control their respective groups of p second buffer circuits connected to the second ends of the p gate bus lines in their corresponding groups. The p second buffer circuits drive their corresponding p gate bus lines in accordance with the gate clock signals included in the multi-phase gate clock signal and out of phase with one another. Note that the first and second buffer circuits that are connected to the same gate bus line are supplied with the same gate clock signal in the multi-phase gate clock signal. Based on the premise of the above configuration, the gate driver is configured as an interlaced-arrangement-type gate driver in which none of the q1 gate bus line groups corresponding to the q1 first bistable circuits are identical to any of the q2 gate bus line groups corresponding to the q2 second bistable circuits. In such an interlaced-arrangement-type gate driver, the first end of each gate bus line is driven by a first buffer circuit controlled by a first bistable circuit included in one of two shift registers sequentially outputting active signals out of phase with each other (the two shift registers being operated out of phase with each other). The second end of the gate bus line is driven by a second buffer circuit controlled by a second bistable circuit included in the other of the two shift registers. Such a gate driver configuration encompasses the aforementioned gate driver configurations in the above embodiments.

It should be noted that display devices according to a variety of variants can be configured by optionally combining the features of the display devices according to the embodiments and variants described above unless contrary to the nature thereof. Moreover, the above embodiments have been described taking as an example the liquid crystal display device, but the present invention is not limited to this and can also be applied to other types of display devices such as organic electroluminescent (EL) display devices, so long as the display devices are matrix display devices.

What is claimed is:

1. A scanning signal line drive circuit for selectively driving a plurality of scanning signal lines provided in a display portion of a display device, the circuit comprising:

a first scanning signal line driver portion configured to be operated in accordance with a multi-phase clock signal and disposed near first ends of the plurality of scanning signal lines; and a second scanning signal line driver portion configured to be operated in accordance with the multi-phase clock signal and disposed near second ends of the plurality of scanning signal lines, wherein, the first scanning signal line driver portion includes:

a first shift register having a plurality of first bistable circuits cascaded together and provided in one-to-one correspondence with a plurality of scanning signal line groups, each group consisting of two or more adjacent scanning signal lines selected from the plurality of scanning signal lines; and a plurality of buffer circuits connected to the first ends of the plurality of scanning signal lines in one-to-one correspondence to the plurality of scanning signal lines, the second scanning signal line driver portion includes:

a second shift register having a plurality of second bistable circuits cascaded together and provided in one-to-one correspondence with a plurality of scanning signal line groups, each group consisting of two or more adjacent scanning signal lines selected from the plurality of scanning signal lines; and a plurality of buffer circuits connected to the second ends of the plurality of scanning signal lines in one-to-one correspondence to the plurality of scanning signal lines, the plurality of scanning signal lines are grouped such that none of the scanning signal line groups corresponding to the first bistable circuits are identical to any of the scanning signal line groups corresponding to the second bistable circuits, the first and second shift registers are configured such that the first bistable circuits and the second bistable circuits sequentially output active signals out of phase with each other in accordance with the grouping of the plurality of scanning signal lines, the first and second scanning signal line driver portions are configured such that:

for each of the groups respectively corresponding to the first bistable circuits, the buffer circuits that are respectively connected to the first ends of the two or more scanning signal lines in the group are supplied with clock signals included in the multi-phase clock signal and being out of phase with each other, for each of the groups respectively corresponding to the second bistable circuits, the buffer circuits that are respectively connected to the second ends of the two or more scanning signal lines in the group are supplied with clock signals included in the multi-phase clock signal and being out of phase with each other, and the buffer circuits that are respectively connected to the first and second ends of the same scanning signal line are supplied with the same clock signal in the multi-phase clock signal, the buffer circuits that are respectively connected to the first ends of the plurality of scanning signal lines each include a buffer transistor that has a control terminal at which to receive an output signal from a corresponding first bistable circuit, a first conductive terminal at which to receive the supplied clock signal, and a second conductive terminal connected to the first end of a corresponding scanning signal line, and the buffer circuits that are respectively connected to the second ends of the plurality of scanning signal lines each include a buffer transistor that has a control terminal at which to receive an output signal from a corresponding second bistable circuit, a first conductive terminal at which to receive the supplied clock signal, and a second conductive terminal connected to the second end of a corresponding scanning signal line.

2. The scanning signal line drive circuit according to claim 1, wherein, the buffer circuits that are respectively connected to the first ends of the plurality of scanning signal lines and the buffer circuits that are respectively connected to the second ends of the plurality of scanning signal lines each further include a capacitor and a transmission gate, the control terminal of the buffer transistor is connected to the second conductive terminal via the capacitor and to an output terminal of the corresponding bistable circuit via the transmission gate, and the transmission gate is configured to transmit a voltage within a range between a predetermined value corresponding to a power supply voltage for turning on the buffer transistor among power supply voltages for the first and second scanning signal line driver portions and a voltage value for turning off the buffer transistor, and to prevent a voltage that turns on the buffer transistor but is out of the range from being transmitted.

3. The scanning signal line drive circuit according to claim 2, wherein, the transmission gate includes a field-effect transistor having a control terminal to which a power supply voltage for either the first or second scanning signal line driver portion is provided for turning on the buffer transistor in the buffer circuit that includes the transmission gate, and the control terminal of the buffer transistor in the buffer circuit that includes the transmission gate is connected to the output terminal of the corresponding bistable circuit via the field-effect transistor.

4. The scanning signal line drive circuit according to claim 2, wherein, the transmission gate includes two field-effect transistors of the same channel type, the two field-effect transistors being connected in parallel, each of the two field-effect transistors has a control terminal to which one clock signal included in the multi-phase clock signal is provided such that clock signals provided to the control terminals of the two field-effect transistors are opposite in phase, and the control terminal of the buffer transistor in the buffer circuit that includes the transmission gate is connected to the output terminal of the corresponding bistable circuit via the two field-effect transistors.

5. The scanning signal line drive circuit according to claim 1, wherein, the first bistable circuits are in one-to-one correspondence with a plurality of scanning signal line groups, each consisting of two adjacent scanning signal lines selected from the plurality of scanning signal lines, the second bistable circuits are in one-to-one correspondence with a plurality of scanning signal line groups, each consisting of two adjacent scanning signal lines selected from the plurality of scanning signal lines, for each bistable circuit of the first and second bistable circuits, the buffer circuit that is connected to one of two scanning signal lines in a group corresponding to the bistable circuit and receives an output signal from the bistable circuit is a first-type buffer circuit that includes the buffer transistor as a first transistor and further includes a first capacitor, the control terminal of the first transistor is connected to the second conductive terminal of the first transistor via the first capacitor and also directly connected to the output terminal of the corresponding bistable circuit, for each bistable circuit of the first and second bistable circuits, the buffer circuit that is connected to the other of the two scanning signal lines in the group corresponding to the bistable circuit and receives the output signal from the bistable circuit is a second-type buffer circuit that includes the buffer transistor as a second transistor and further includes a second capacitor and a transmission gate, the control terminal of the second transistor is connected to the second conductive terminal of the second transistor via the second capacitor as well as to the output terminal of the corresponding bistable circuit via the transmission gate, and the transmission gate is configured to transmit a voltage within a range between a predetermined value corresponding to a power supply voltage for turning on the second buffer transistor among power supply voltages for the first and second scanning signal line driver portions and a voltage value for turning off the second buffer transistor, and to prevent a voltage that turns on the second buffer transistor but is out of the range from being transmitted.

6. The scanning signal line drive circuit according to claim 5, wherein, either or both of different size setting for the first and second transistors and different capacitance value setting for the first and second transistors are performed so as to reduce or eliminate a difference in scanning signal line drive capability between the first-type buffer circuit and the second-type buffer circuit.

7. The scanning signal line drive circuit according to claim 5, wherein, the transmission gate includes a field-effect transistor having a control terminal to which a power supply voltage for either the first or second scanning signal line driver portion is provided for turning on the buffer transistor in the buffer circuit that includes the transmission gate, and the control terminal of the buffer transistor in the buffer circuit that includes the transmission gate is connected to the output terminal of the corresponding bistable circuit via the field-effect transistor.

8. The scanning signal line drive circuit according to claim 5, wherein, the transmission gate includes two field-effect transistors of the same channel type, the two field-effect transistors being connected in parallel, each of the two field-effect transistors has a control terminal to which one clock signal included in the multi-phase clock signal is provided such that clock signals provided to the control terminals of the two field-effect transistors are opposite in phase, and the control terminal of the buffer transistor in the buffer circuit that includes the transmission gate is connected to the output terminal of the corresponding bistable circuit via the two field-effect transistors.

9. A display device having a display portion provided with a plurality of data signal lines, a plurality of scanning signal lines crossing the data signal lines, and a plurality of pixel forming portions arranged in a matrix along the data signal lines and the scanning signal lines, the device comprising:

a data signal line drive circuit configured to drive the data signal lines;

a scanning signal line drive circuit of claim 1; and a display control circuit configured to control the data signal line drive circuit and the scanning signal line drive circuit.

10. The display device according to claim 9, wherein the scanning signal line drive circuit and the display portion are integrally formed on the same substrate.

11. The display device according to claim 9, wherein, the display control circuit controls the data signal line drive circuit and the scanning signal line drive circuit such that one frame period includes a non-scanning period in which the scanning signal lines are stopped from being driven between scanning periods in which the scanning signal lines are driven, the multi-phase clock signal consists of a plurality of clock signals out of phases with each other, voltage levels of the clock signals alternating between ON and OFF levels in predetermined cycles during the scanning period, the ON and OFF levels respectively corresponding to selection and deselection of the scanning signal lines, and the display control circuit generates the multi-phase clock signal such that, before the non-scanning period starts, the voltage levels of the clock signals are sequentially changed from the ON level to the OFF level and kept at the OFF level, and after the non-scanning period, the voltage levels of the clock signals are sequentially changed from the OFF level to the ON level and then alternate between the ON level and the OFF level in the predetermined cycles.

12. A drive method for selectively driving a plurality of scanning signal lines provided in a display portion of a display device, the method comprising:

a first scanning signal line drive step of driving the plurality of scanning signal lines from first ends of the plurality of scanning signal lines in accordance with a multi-phase clock signal; and a second scanning signal line drive step of driving the plurality of scanning signal lines from second ends of the plurality of scanning signal lines in accordance with the multi-phase clock signal, wherein, the first scanning signal line drive step includes:

a first shift operation step of sequentially outputting active signals from a plurality of first bistable circuits constituting a first shift register by being cascaded together and provided in one-to-one correspondence with a plurality of scanning signal line groups, each group consisting of two or more adjacent scanning signal lines selected from the plurality of scanning signal lines; and a first charge/discharge step of charging or discharging the plurality of scanning signal lines by a plurality of buffer circuits connected to the first ends of the plurality of scanning signal lines in one-to-one correspondence with the plurality of scanning signal lines, the second scanning signal line drive step includes:

a second shift operation step of sequentially outputting active signals from a plurality of second bistable circuits constituting a second shift register by being cascaded together and provided in one-to-one correspondence with a plurality of scanning signal line groups, each group consisting of two or more adjacent scanning signal lines selected from the plurality of scanning signal lines; and a second charge/discharge step of charging or discharging the plurality of scanning signal lines by a plurality of buffer circuits connected to the second ends of the plurality of scanning signal lines in one-to-one correspondence with the plurality of scanning signal lines, the plurality of scanning signal lines are grouped such that none of the scanning signal line groups corresponding to the first bistable circuits are identical to any of the scanning signal line groups corresponding to the second bistable circuits, in the first and second shift operation steps, the first bistable circuits and the second bistable circuits sequentially output active signals out of phase with each other in accordance with the grouping of the plurality of scanning signal lines, the first charge/discharge step includes a first clock supply step of supplying clock signals included in the multi-phase clock signal and being out of phase with each other, to the buffer circuits respectively connected to the first ends of the two or more scanning signal lines in each of the groups respectively corresponding to the first bistable circuits, the second charge/discharge step includes a second clock supply step of supplying clock signals included in the multi-phase clock signal and being out of phase with each other, to the buffer circuits respectively connected to the second ends of the two or more scanning signal lines in each of the groups respectively corresponding to the second bistable circuits, in the first and second clock supply steps, the buffer circuits that are respectively connected to the first and second ends of the same scanning signal line are supplied with the same clock signal in the multi-phase clock signal, in the first charge/discharge step, by means of buffer transistors each having a control terminal at which to receive an output signal from a corresponding first bistable circuit, a first conductive terminal at which to receive the supplied clock signal, and a second conductive terminal connected to the first end of a corresponding scanning signal line, the buffer circuits that are respectively connected to the first ends of the plurality of scanning signal lines charge or discharge the corresponding scanning signal lines from the first ends in accordance with the supplied clock signals when active signals are being outputted by the corresponding first bistable circuits, and in the second charge/discharge step, by means of buffer transistors each having a control terminal at which to receive an output signal from a corresponding second bistable circuit, a first conductive terminal at which to receive the supplied clock signal, and a second conductive terminal connected to the second end of a corresponding scanning signal line, the buffer circuits that are respectively connected to the second ends of the plurality of scanning signal lines charge or discharge the corresponding scanning signal lines from the second ends in accordance with the supplied clock signals when active signals are being outputted by the corresponding second bistable circuits.

13. The drive method according to claim 12, wherein, the buffer circuits that are respectively connected to the first ends of the plurality of scanning signal lines and the buffer circuits that are respectively connected to the second ends of the plurality of scanning signal lines each further include a capacitor and a transmission gate, the control terminal of the buffer transistor is connected to the second conductive terminal via the capacitor and to an output terminal of the corresponding bistable circuit via the transmission gate, and the transmission gate is configured to transmit a voltage within a range between a predetermined value corresponding to a power supply voltage for turning on the buffer transistor among power supply voltages for the first and second scanning signal line driver portions and a voltage value for turning off the buffer transistor, and to prevent a voltage that turns on the buffer transistor but is out of the range from being transmitted.

14. The drive method according to claim 12, wherein, the first bistable circuits are in one-to-one correspondence with a plurality of scanning signal line groups, each consisting of two adjacent scanning signal lines selected from the plurality of scanning signal lines, the second bistable circuits are in one-to-one correspondence with a plurality of scanning signal line groups, each consisting of two adjacent scanning signal lines selected from the plurality of scanning signal lines, for each bistable circuit of the first and second bistable circuits, the buffer circuit that is connected to one of two scanning signal lines in a group corresponding to the bistable circuit and receives an output signal from the bistable circuit is a first-type buffer circuit that includes the buffer transistor as a first transistor and further includes a first capacitor, the control terminal of the first transistor is connected to the second conductive terminal of the first transistor via the first capacitor as well as directly connected to the output terminal of the corresponding bistable circuit, for each bistable circuit of the first and second bistable circuits, the buffer circuit that is connected to the other of the two scanning signal lines in the group corresponding to the bistable circuit and receives the output signal from the bistable circuit is a second-type buffer circuit that includes the buffer transistor as a second transistor and further includes a second capacitor and a transmission gate, the control terminal of the second transistor is connected to the second conductive terminal of the second transistor via the second capacitor as well as to the output terminal of the corresponding bistable circuit via the transmission gate, and the transmission gate is configured to transmit a voltage within a range between a predetermined value corresponding to a power supply voltage for turning on the second buffer transistor among power supply voltages for the first and second scanning signal line drive steps and a voltage value for turning off the second buffer transistor, and to prevent a voltage that turns on the second buffer transistor but is out of the range from being transmitted.

* * * * *